US012241248B2

(12) United States Patent
Adhikari

(10) Patent No.: US 12,241,248 B2
(45) Date of Patent: Mar. 4, 2025

(54) COLLAPSIBLE ASSEMBLY AND A METHOD OF OPERATING THE SAME

(71) Applicants: Anwit Adhikari, Langley Township (CA); University of Regina, Regina (CA)

(72) Inventor: Anwit Adhikari, Langley Township (CA)

(73) Assignee: University of Regina

( * ) Notice: Subject to any disclaimer, the term of this patent is extended or adjusted under 35 U.S.C. 154(b) by 138 days.

(21) Appl. No.: 17/897,361

(22) Filed: Aug. 29, 2022

(65) Prior Publication Data

US 2024/0068234 A1 Feb. 29, 2024

(51) Int. Cl.
*E04B 1/32* (2006.01)
*E04C 3/30* (2006.01)

(52) U.S. Cl.
CPC ..... *E04C 3/30* (2013.01)

(58) Field of Classification Search
CPC . E04C 3/30; E04C 2/405; E04B 1/344; E04B 1/34384; E04B 1/3442; E04B 1/3445; E04B 1/3449; E04B 1/343; E04B 1/19; E04B 1/1903
USPC ..... 52/843, 80.1, 81.1, 641, 645
See application file for complete search history.

(56) References Cited

U.S. PATENT DOCUMENTS 3,524,288 A * 8/1970 Coppa ..... E04B 1/3449 D25/13
3,640,034 A * 2/1972 Shotwell, Jr. ..... E04B 1/344 D25/13
4,055,019 A * 10/1977 Harvey ..... A63H 33/065 446/124
4,089,147 A * 5/1978 Bain ..... E04B 1/344 52/646
4,630,745 A * 12/1986 Shiotani ..... B65D 11/182 217/15
4,651,589 A * 3/1987 Lambert ..... B25J 18/06 52/646
5,069,948 A * 12/1991 Fromson ..... E04B 1/344 428/33
5,107,652 A * 4/1992 Sosa ..... E04H 17/18 52/586.1
5,429,851 A * 7/1995 Sallee ..... B64G 1/222 428/221
5,540,013 A * 7/1996 Diamond ..... G09B 23/04 52/80.1
8,181,806 B2 * 5/2012 Hidalgo Vargas ..... B65D 11/1833 220/4.28

(Continued)

*Primary Examiner* — James M Ference
(74) *Attorney, Agent, or Firm* — Christopher A. Proskey; BrownWinick Law Firm

(57) ABSTRACT

A collapsible assembly configured to change, along a collapsibility axis, between an extended configuration and a collapsed configuration is described. The collapsible assembly comprises at least two symmetrical peripheral units, each comprising a primary cell and a secondary cell. The primary cell includes a corresponding cell surface and a primary cell hinge element. The secondary cell includes a corresponding cell surface and a secondary cell hinge element, where the secondary cell hinge element is complementary to the primary cell hinge element. The collapsible assembly also includes an intermediary cell positioned within the two peripheral unit assemblies and is coupled to the secondary cells of each peripheral unit assembly using coupling elements.

20 Claims, 89 Drawing Sheets

(56) References Cited

U.S. PATENT DOCUMENTS

| | | | | |
|---|---|---|---|---|
| 9,676,515 | B2 * | 6/2017 | Huggett | B65D 13/04 |
| 9,840,837 | B1 * | 12/2017 | Matsuoka | A63H 33/00 |
| 10,259,598 | B2 * | 4/2019 | Rygaard | B64G 1/12 |
| 2002/0083675 | A1 * | 7/2002 | Hoberman | E04B 1/3441 52/645 |
| 2002/0190161 | A1 * | 12/2002 | Patel | B64G 1/12 244/158.1 |
| 2005/0060951 | A1 * | 3/2005 | Kalnay | E04B 1/3441 52/641 |
| 2006/0010821 | A1 * | 1/2006 | Schipani | E04C 3/005 52/641 |
| 2006/0249642 | A1 * | 11/2006 | Mavis | A47B 91/005 248/188.1 |
| 2012/0318926 | A1 * | 12/2012 | Ingham | B64G 1/54 244/159.4 |
| 2020/0148399 | A1 * | 5/2020 | de Jong | B64G 1/226 |
| 2021/0340763 | A1 * | 11/2021 | Golozar | E04B 1/344 |
| 2024/0068234 | A1 * | 2/2024 | Adhikari | E04C 3/30 |

* cited by examiner

COLLAPSIBLE ASSEMBLY AND A METHOD OF OPERATING THE SAME

FIELD

The described embodiments relate to a collapsible assembly that can change between an extended configuration and a collapsed configuration.

BACKGROUND

The following is not an admission that anything discussed below is part of the prior art or part of the common general knowledge of a person skilled in the art.

In recent years, there have been many explorations and applications where there is a need for expandable assemblies that can change between an extended configuration and a collapsed configuration. This allows for the assembly to be carried far distances, in tight spaces, in a collapsed configuration and expanded only once it reaches its destination.

SUMMARY

In accordance with an aspect of the invention, some embodiments provide a collapsible assembly configured to change, along a collapsibility axis, between an extended configuration and a collapsed configuration. The collapsible assembly may comprise a first primary cell and a first secondary cell. The first primary cell may comprise: a corresponding primary cell surface; and a corresponding first primary cell hinge element coupled to the primary cell surface along a first primary cell edge. The first secondary cell may comprise: a corresponding secondary cell surface; a corresponding first secondary cell hinge element coupled to the secondary cell surface along a first secondary cell edge, wherein the first secondary cell hinge element is complementary to the first primary cell hinge element. The first primary cell hinge element and the first secondary cell hinge element may be coupled to provide a first hinge connection. When the collapsible assembly changes from the extended configuration to the collapsed configuration, the first hinge connection may move in a corresponding direction causing movement of the primary cell surface of the first primary cell and the secondary cell surface of the first secondary cell from a first axis generally parallel to the collapsibility axis to a second axis generally perpendicular to the collapsibility axis to reduce a surface area of the collapsible assembly.

In accordance with an aspect of the invention, some embodiments provide a collapsible assembly configured to change, along a collapsibility axis, between an extended configuration and a collapsed configuration. The collapsible assembly may comprise two symmetrical peripheral unit assemblies separated from each other by an intermediary distance and being arranged in parallel rows along the collapsibility axis, an intermediary cell and two coupling elements. Each peripheral unit assembly may comprise a primary cell and a secondary cell. The primary cell may comprise: a primary cell surface; and a first primary cell hinge element coupled to the primary cell surface along a first primary cell edge. The secondary cell may comprise: a secondary cell surface; a first secondary cell hinge element coupled to the secondary cell surface along a first secondary cell edge, wherein the first secondary cell hinge element is complementary to the first primary cell hinge element, and wherein the first secondary cell hinge element connects with the first primary cell hinge element to form a hinge connection; and at least one secondary cell connection element coupled to the secondary cell surface, the secondary cell connection element being offset from the hinge connection. The intermediary cell may be positioned within the two peripheral unit assemblies. The intermediary cell may comprise: an intermediary cell surface provided within the two peripheral unit assemblies such that the intermediary cell surface extends between at least a portion of side edges of the primary and the secondary cells of each peripheral unit assembly when the collapsible assembly is in the extended configuration, and wherein the intermediary cell surface is offset from the secondary cell surfaces of the secondary cells of the peripheral unit assemblies as the collapsible assembly changes from the extended configuration to the collapsed configuration; and two intermediary cell connection elements coupled to the intermediary cell surface along a first intermediary cell edge and each proximate to a secondary cell connection element of a corresponding secondary cell of each peripheral unit assembly. Each coupling element may comprise: a first end complementary to an intermediary cell connection element; and a second end complementary to the corresponding proximate secondary cell connection element. When the collapsible assembly changes from the extended configuration to the collapsed configuration: the hinge connection for each peripheral unit assembly moves in a corresponding direction causing movement of the corresponding primary cell surface and the secondary cell surface from a first axis generally parallel to the collapsibility axis to a second axis generally perpendicular to the collapsibility axis, and the two coupling elements move in opposing directions causing movement of the intermediary cell surface from the first axis to the second axis such that the secondary cells of the two peripheral unit assemblies fold above the intermediary cell.

In accordance with an aspect of the invention, a method of manufacturing a collapsible assembly configured to change between an extended configuration and a collapsed configuration along a collapsibility axis is provided. The collapsible assembly may comprise a first primary cell and a first secondary cell. The first primary cell comprises: a corresponding primary cell surface; and a corresponding first primary cell hinge element coupled to the primary cell surface along a first primary cell edge. The first secondary cell comprises: a corresponding secondary cell surface; a corresponding first secondary cell hinge element coupled to the secondary cell surface along a first secondary cell edge, wherein the first secondary cell hinge element is complementary to the first primary cell hinge element. The method may comprise: providing a first hinge connection between the first primary cell hinge element and the first secondary cell hinge element, wherein, when the collapsible assembly changes from the extended configuration to the collapsed configuration, the first hinge connection moves in a corresponding direction causing movement of the primary cell surface of the first primary cell and the secondary cell surface of the first secondary cell from a first axis generally parallel to the collapsibility axis to a second axis generally perpendicular to the collapsibility axis to reduce a surface area of the collapsible assembly. The method may further comprise providing a joint lock at the first hinge connection, the joint lock configured to control the movement of the primary cell surface and the secondary cell surface from the first axis to the second axis.

In accordance with an aspect of the invention, a method of manufacturing a collapsible assembly configured to change between an extended configuration and a collapsed configuration along a collapsibility axis is provided. The collapsible assembly may comprise two symmetrical peripheral unit assemblies separated from each other by an intermediary distance and being arranged in parallel rows along the collapsibility axis, an intermediary cell positioned within the two peripheral unit assemblies, and two coupling elements. Each peripheral unit assembly may comprise a primary cell and a secondary cell. The primary cell may comprise: a primary cell surface; and a first primary cell hinge element coupled to the primary cell surface along a first primary cell edge. The secondary cell may comprise: a secondary cell surface; a first secondary cell hinge element coupled to the secondary cell surface along a first secondary cell edge, wherein the first secondary cell hinge element is complementary to the first primary cell hinge element, and wherein the first secondary cell hinge element connects with the first primary cell hinge element to form a hinge connection; and at least one secondary cell connection element coupled to the secondary cell surface, the secondary cell connection element being offset from the hinge connection. The intermediary cell may comprise: an intermediary cell surface provided within the two peripheral unit assemblies such that the intermediary cell surface extends between at least a portion of side edges of the primary and the secondary cells of each peripheral unit assembly when the collapsible assembly is in the extended configuration, and wherein the intermediary cell surface is offset from the secondary cell surfaces of the secondary cells of the peripheral unit assemblies as the collapsible assembly changes from the extended configuration to the collapsed configuration; and two intermediary cell connection elements coupled to the intermediary cell surface along a first intermediary cell edge and each proximate to a secondary cell connection element of a corresponding secondary cell of each peripheral unit assembly. Each coupling element may comprise: a first end complementary to an intermediary cell connection element; and a second end complementary to the corresponding proximate secondary cell connection element. The method may comprise providing a coupling connection of the second end of each of the two coupling elements with the corresponding proximate secondary cell connection element. The method may further comprise providing a coupling connection of the first end of each of the two coupling elements with corresponding intermediary cell connection element, wherein when the collapsible assembly moves from the extended configuration to the collapsed configuration, the hinge connection for each peripheral unit assembly moves in a corresponding direction causing movement of the corresponding primary cell surface and the secondary cell surface from a first axis generally parallel to the collapsibility axis to a second axis generally perpendicular to the collapsibility axis, and the two coupling elements move in opposing directions causing movement of the intermediary cell surface from the first axis to the second axis such that the secondary cells of the two peripheral unit assemblies fold above the intermediary cell. The method may also comprise providing a joint lock position at the intermediary cell, the joint lock being configured to control movement of the intermediary cell surface from the first axis to the second axis.

BRIEF DESCRIPTION OF THE DRAWINGS

The drawings included herewith are for illustrating various examples of articles, methods, and apparatuses of the present specification and are not intended to limit the scope of what is taught in any way. In the drawings.

DETAILED DESCRIPTION

Figure 1A:
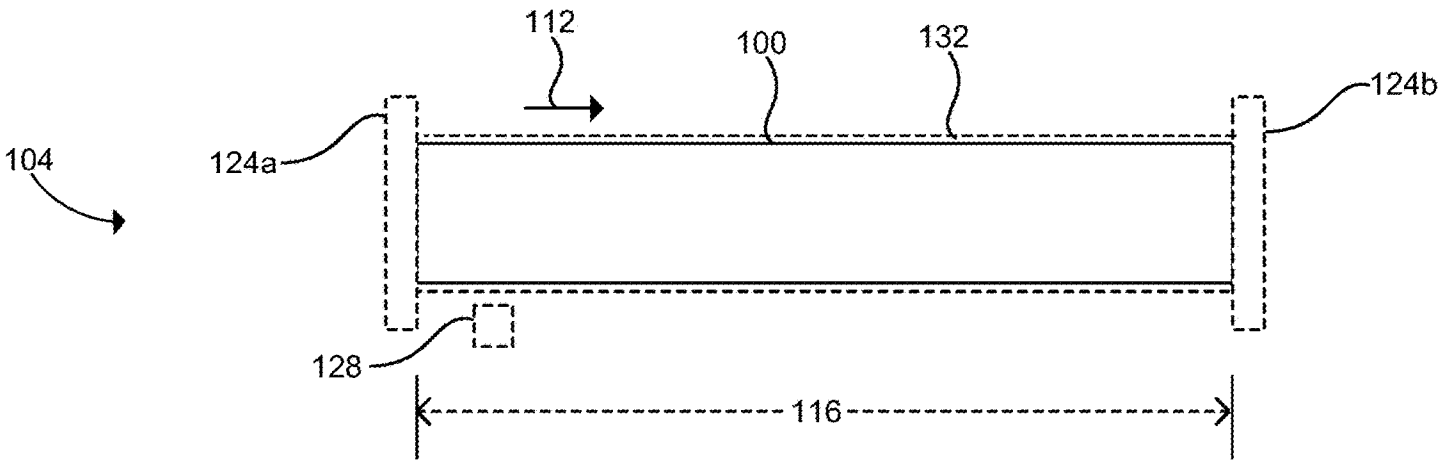
FIG. 1A is a schematic illustration of an example collapsible assembly, in accordance with an embodiment.

Several example embodiments are described below. Numerous specific details are set forth in order to provide a thorough understanding of the example embodiments. However, it will be understood by those of ordinary skill in the art that the embodiments described herein may be practiced without these specific details. In other instances, well-known methods, procedures and components have not been described in detail so as not to obscure the embodiments described herein. Furthermore, this description and the drawings are not to be considered as limiting the scope of the embodiments described herein in any way, but rather as merely describing the implementation of the various embodiments described herein.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more parts are said to be "coupled", "connected", "attached", "joined", "affixed", or "fastened" where the parts are joined or operate together either directly or indirectly (i.e., through one or more intermediate parts), so long as a link occurs. As used herein and in the claims, two or more parts are said to be "directly coupled", "directly connected", "directly attached", "directly joined", "directly affixed", or "directly fastened" where the parts are connected in physical contact with each other. As used herein, two or more parts are said to be "rigidly coupled", "rigidly connected", "rigidly attached", "rigidly joined", "rigidly affixed", or "rigidly fastened" where the parts are coupled so as to move as one while maintaining a constant orientation relative to each other. None of the terms "coupled", "connected", "attached", "joined", "affixed", and "fastened" distinguish the manner in which two or more parts are joined together.

Further, although method steps may be described (in the disclosure and/or in the claims) in a sequential order, such methods may be configured to work in alternate orders. In other words, any sequence or order of steps that may be described does not necessarily indicate a requirement that the steps be performed in that order. The steps of methods described herein may be performed in any order that is practical. Further, some steps may be performed simultaneously.

As used herein and in the claims, a group of elements are said to "collectively" perform an act where that act is performed by any one of the elements in the group, or performed cooperatively by two or more (or all) elements in the group.

As used herein and in the claims, a first element is said to be "received" in a second element where at least a portion of the first element is received in the second element unless specifically stated otherwise.

Some elements herein may be identified by a part number, which is composed of a base number followed by an alphabetical or subscript-numerical suffix (e.g., 112*a*, or 112$_1$). Multiple elements herein may be identified by part numbers that share a base number in common and that differ by their suffixes (e.g., 112*a*, 112*b*, and 112*c*). All elements with a common base number may be referred to collectively or generically using the base number without a suffix (e.g., 112).

As used herein and in the claims, "up", "down", "above", "below", "upwardly", "vertical", "elevation" and similar terms are in reference to a directionality generally aligned with (e.g., parallel to) gravity. However, none of the terms referred to in this paragraph imply any particular alignment between elements. For example, a first element may be said to be "vertically above" a second element, where the first element is at a higher elevation than the second element, and irrespective of whether the first element is vertically aligned with the second element.

It should be noted that terms of degree such as "substantially", "about" and "approximately" when used herein mean a reasonable amount of deviation of the modified term such that the end result is not significantly changed. These terms of degree should be construed as including a deviation of the modified term if this deviation would not negate the meaning of the term it modifies.

In addition, as used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

Figure 1B:
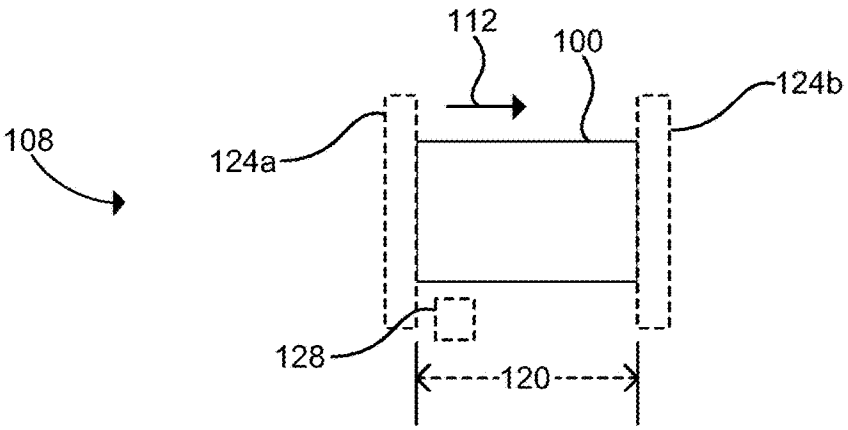
FIG. 1B is a schematic illustration of an example collapsible assembly, in accordance with another embodiment.

Described herein are a collapsible assembly and a method of operating the same. The collapsible assembly may be configured to change, along a collapsibility axis, between an extended configuration and a collapsed configuration. Referring now to FIGS. 1A and 1B, shown therein are schematic illustrations of an example collapsible assembly 100. FIG. 1A shows collapsible assembly 100 in extended configuration 104; and FIG. 1B shows collapsible assembly 100 in collapsed configuration 108. Collapsible assembly 100 can change positions between extended configuration 104 and collapsed configuration 108 along a collapsibility axis 112. The length of collapsible assembly 100 along collapsibility axis 112 may reduce from extended length 116 in extended configuration 104 to collapsed length 120 in collapsed configuration 108. The ratio of extended length 116 to collapsed length 120 may indicate a collapsibility efficiency of collapsible assembly 100. The reduction in length may also result in a corresponding reduction in surface area and volume of collapsible assembly 100 in collapsed configuration 108.

In some embodiments, collapsible assembly 100 may be connected between end plates 124*a* and 124*b*. End plates 124*a,b* may have any design suitable for connection to collapsible assembly 100 and to provide sufficient mechanical support to collapsible assembly 100. End plates 124*a,b* may be used to connect collapsible assembly 100 to other devices or structures.

In some embodiments, a control unit 128 may control the change of collapsible assembly 100 between extended configuration 104 and collapsed configuration 108. Control unit 128 may control the movement of collapsible assembly 100 by providing a force (e.g., to end plate 124*a* or end plate 124*b*) to collapse or extend collapsible assembly 100. In some embodiments, collapsible assembly 100 may include a locking mechanism that prevents collapse of collapsible assembly 100 when it is in extended configuration 104. Control unit 128 may unlock the locking mechanism before initiating collapse of collapsible assembly 100. Control unit 128 may also lock the locking mechanism after extension of collapsible assembly 100 is complete.

Depending on the structure and design of the collapsible assembly 100, the collapsible assembly 100 may have a smaller length, surface area and/or volume in the collapsed configuration 108 compared to the extended configuration 104. Collapsible assembly 100 may be used in various applications requiring a reduced length, surface area and/or volume in collapsed configuration 108 that can be changed to an increased length, surface area and/or volume in extended configuration 104. For example, collapsible assembly 100 may be used in deep-space or underwater applications. Collapsible assembly 100 can provide a reduced collapsed volume and surface area during transportation and/or storage. Collapsible assembly 100 may then be changed to an extended configuration 104 to provide a larger volume and surface area once the transportation is completed or once the assembly 100 is ready for use. This may enable structures like air locks, extraterrestrial habitats etc. to be transported to their location of use with a reduced collapsed volume. Collapsible assembly 100 can then be changed to extended configuration 104 to provide a larger usable volume. In some embodiments, collapsible assembly 100 may then be changed back to collapsed configuration 108 for further transportation and/or storage.

Collapsible assemblies 100 can be made of different designs and different materials for use with different applications. The selection of assembly designs and/or materials may be based on factors such as structural strength provided by the collapsible assembly in the extended configuration, reduction in length/surface area/volume in collapsed configuration compared with extended configuration, speed and reversibility of change between the extended and collapsed configurations, durability of the collapsible assembly, and complexity of the collapsible assembly.

In some embodiments, collapsible assembly 100 may be used to provide a fully enclosed structure in extended configuration 104. Optionally, collapsible assembly 100 may be used as an endoskeleton with an outer layer 132 attached to collapsible assembly 100 to provide a fully enclosed structure. The outer layer 132 can be made of non-rigid materials, for example, fabric.

Figure 2:
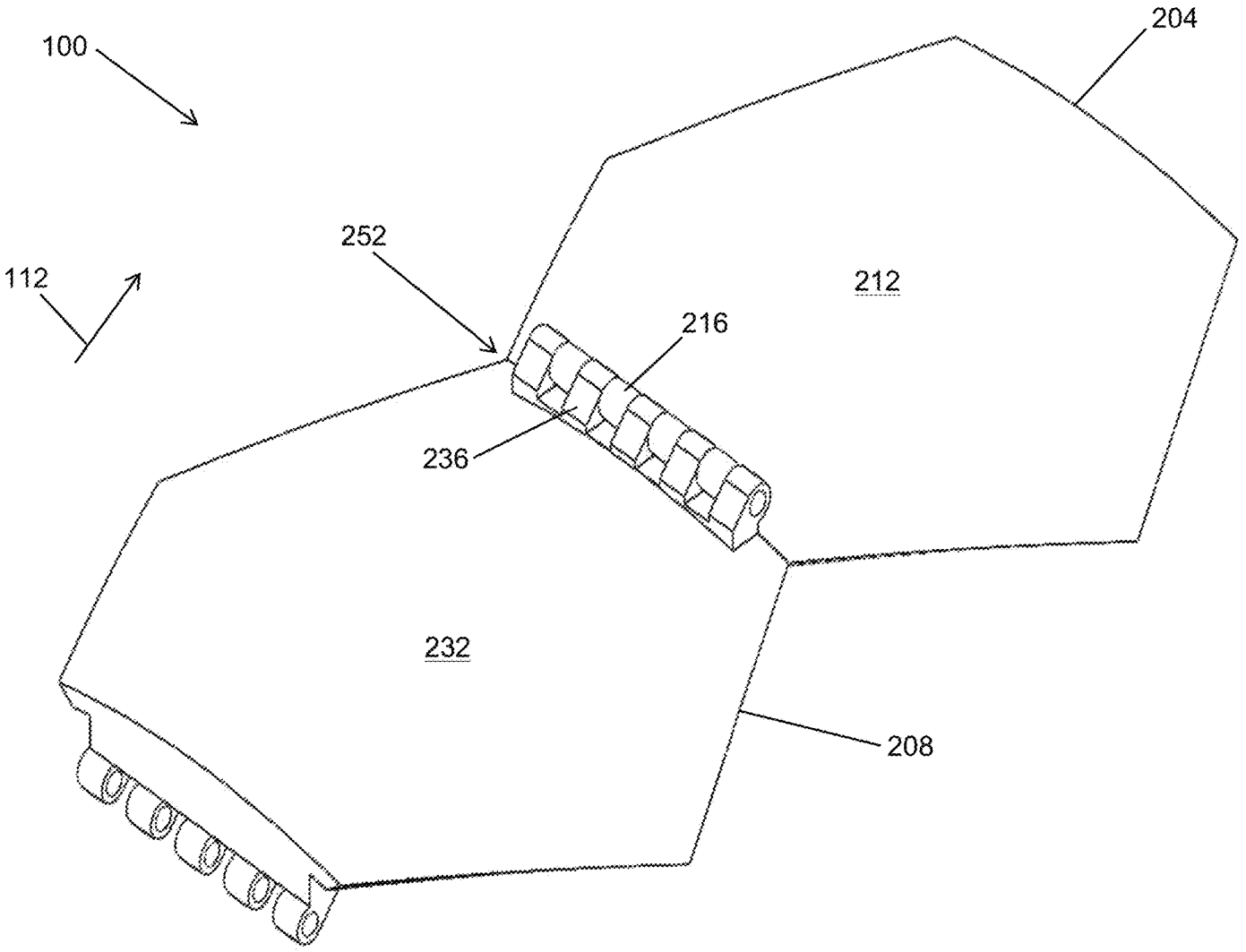
FIG. 2 is a perspective view of an example collapsible assembly in an extended configuration, in accordance with an embodiment.

Referring now to FIG. 2, shown therein is a perspective view of an example embodiment of collapsible assembly 100 in an extended configuration. Collapsible assembly 100 can be configured to change, along collapsibility axis 112, between the extended configuration and a collapsed configuration (not shown in FIG. 2).

Collapsible assembly 100 comprises a primary cell 204 and a secondary cell 208. The cells 204 and 208 may be made of any material suitable to operate as a rigid structure and provide sufficient mechanical strength based on the usage of collapsible assembly 100. In some embodiments, cells 204 and 208 may be made of metallic materials (e.g., steel, aluminum) or polymer materials (e.g., polyethylene terephthalate glycol (PETG), polyetherimide). Both cells 204 and 208 may be made of the same material in some cases, and different materials in other cases.

Referring now to FIGS. 3A to 3D, shown therein are a perspective view, a side view, a top view and a front view respectively of primary cell 204. Primary cell 204 comprises a primary cell surface 212, a first primary cell hinge element 216 and a second primary cell hinge element 220.

In the illustrated embodiment, primary cell surface 212 is hexagonal in shape. In some embodiments, primary cell surface 212 can be other shapes, for example, square or rectangle. Primary cell surface 212 can include a first primary cell edge 224 and an opposing primary cell edge 228 that are opposing edges of primary cell surface 212. First primary cell hinge element 216 can be coupled to primary cell surface 212 along first primary cell edge 224. Second primary cell hinge element 220 can be coupled to an opposite side 214 of primary cell surface 212 along opposing primary cell edge 228.

As shown in the illustrated embodiment, the first primary cell hinge element 216 is connected to the top of the primary cell surface 212, and the second primary cell hinge element 220 is connected to the bottom of the primary cell surface 212.

Referring now to FIGS. 4A to 4D, shown therein are a perspective view, a side view, a top view and a front view respectively of secondary cell 208. Secondary cell 208 comprises a secondary cell surface 232, a first secondary cell hinge element 236 and a second secondary cell hinge element 240.

In the illustrated embodiment, secondary cell surface 232 is hexagonal in shape. In some embodiments, secondary cell surface 232 can be other shapes, for example, square or rectangle. Secondary cell surface 232 can include a first secondary cell edge 244 and an opposing secondary cell edge 248 that are opposing edges of secondary cell surface 232. First secondary cell hinge element 236 can be coupled to secondary cell surface 232 along first secondary cell edge 244. Second secondary cell hinge element 240 can be coupled to an opposite side 234 of secondary cell surface 232 along opposing secondary cell edge 248.

As shown in the illustrated embodiment, the first secondary cell hinge element 236 is connected to the top of the primary cell surface 232, and the second secondary cell hinge element 240 is connected to the bottom of the primary cell surface 232.

Figure 3A:
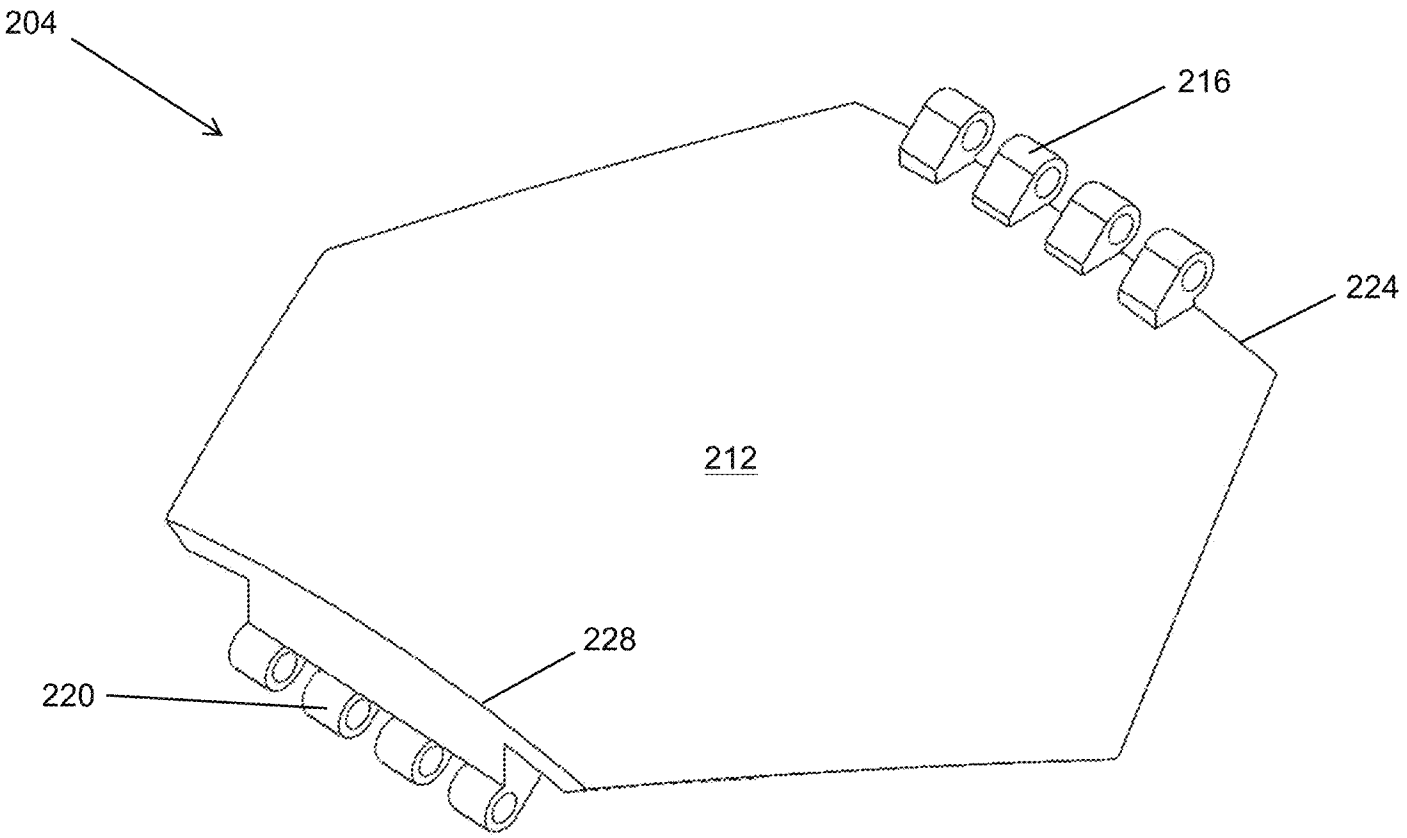
FIG. 3A is a perspective view of an example primary cell of the collapsible assembly of FIG. 2.
Figure 3B:
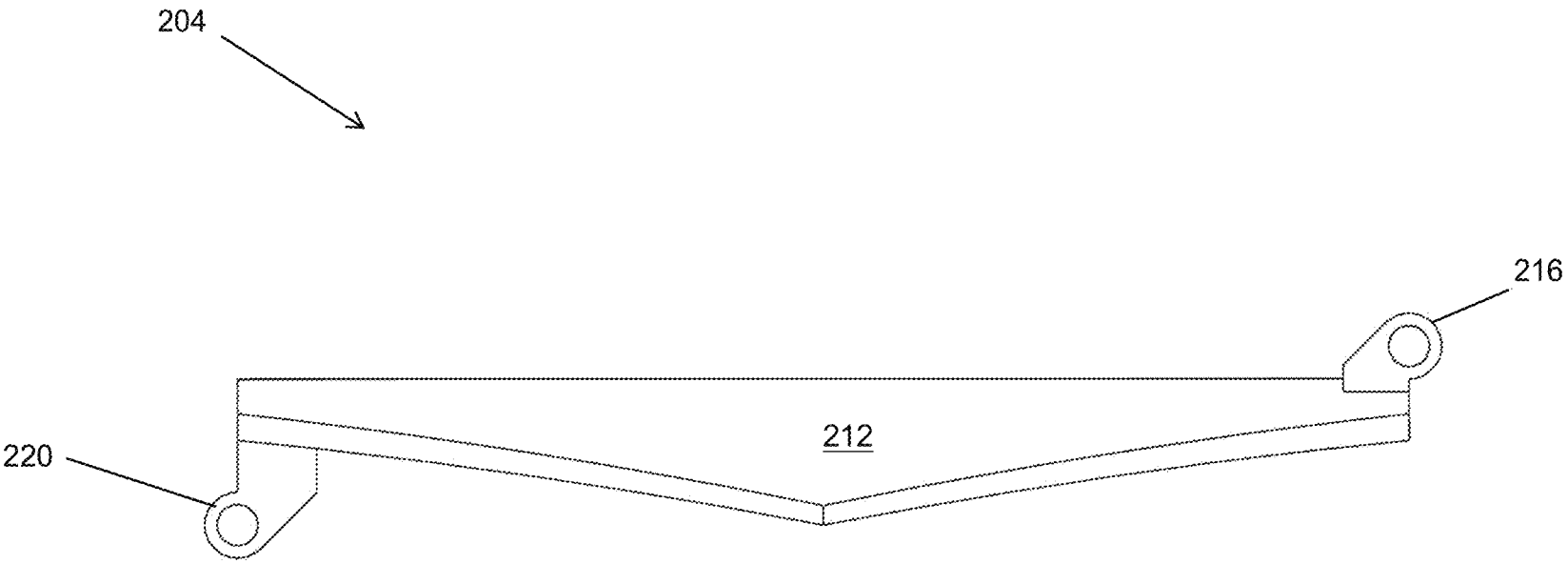
FIG. 3B is a side view of the example primary cell of FIG. 3A.
Figure 3C:
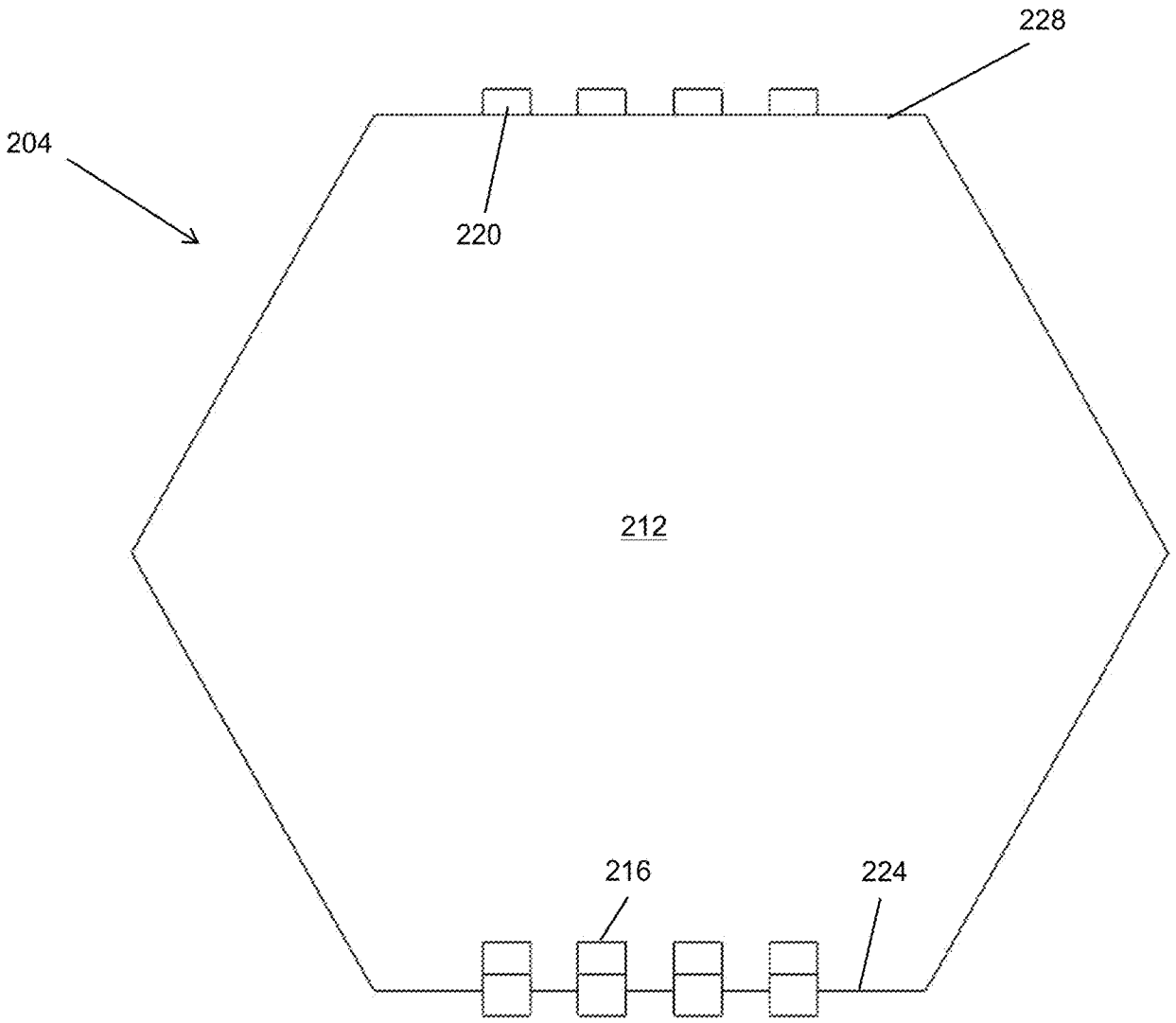
FIG. 3C is a top view of the example primary cell of FIG. 3A.
Figure 3D:
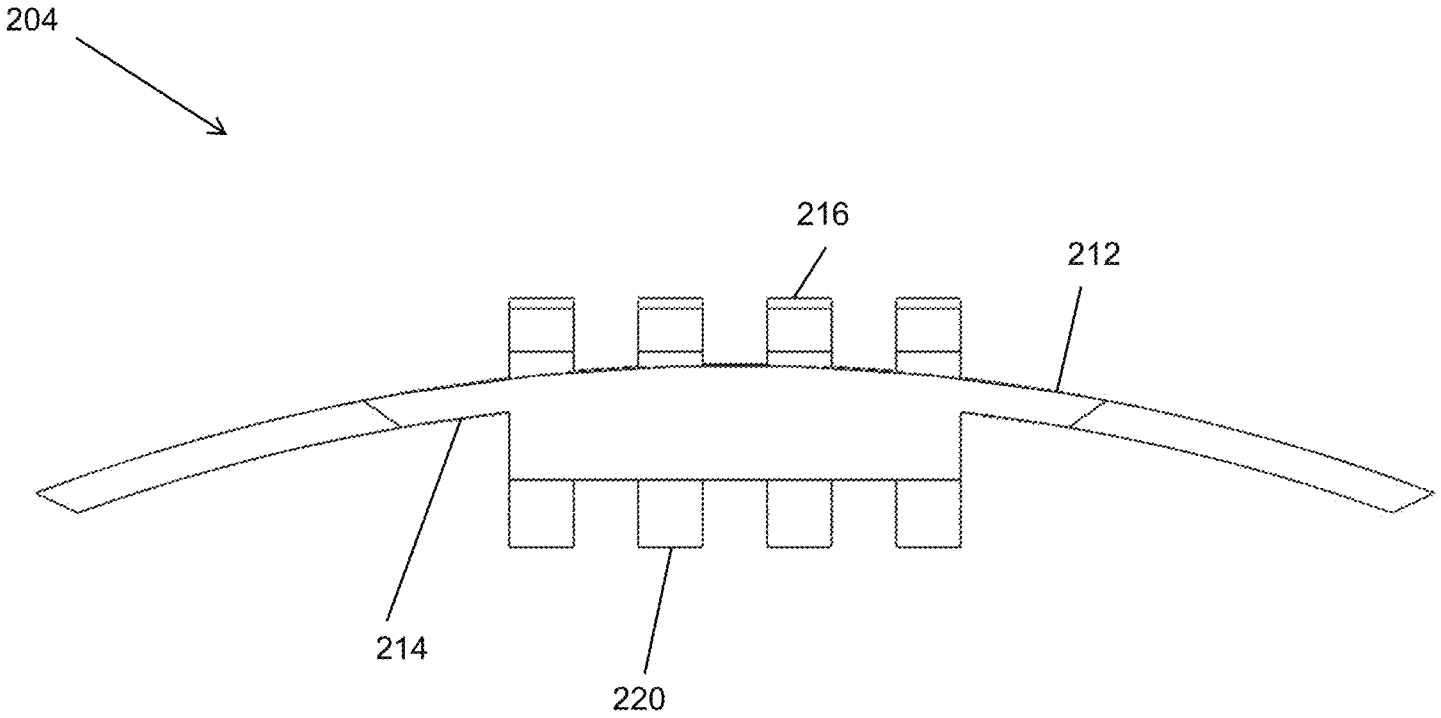
FIG. 3D is a front view of the example primary cell of FIG. 3A.
Figure 4A:
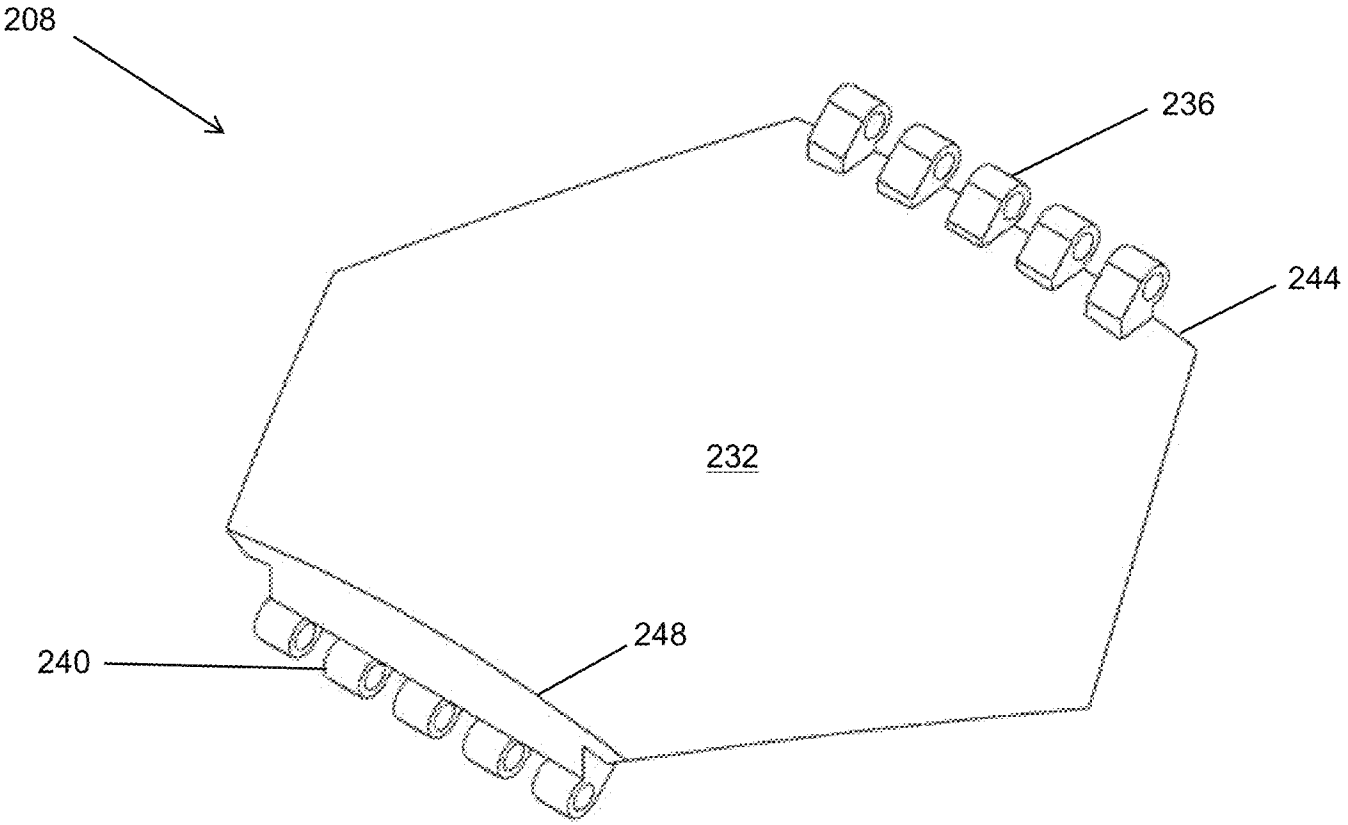
FIG. 4A is a perspective view of an example secondary cell of the collapsible assembly of FIG. 2.
Figure 4B:
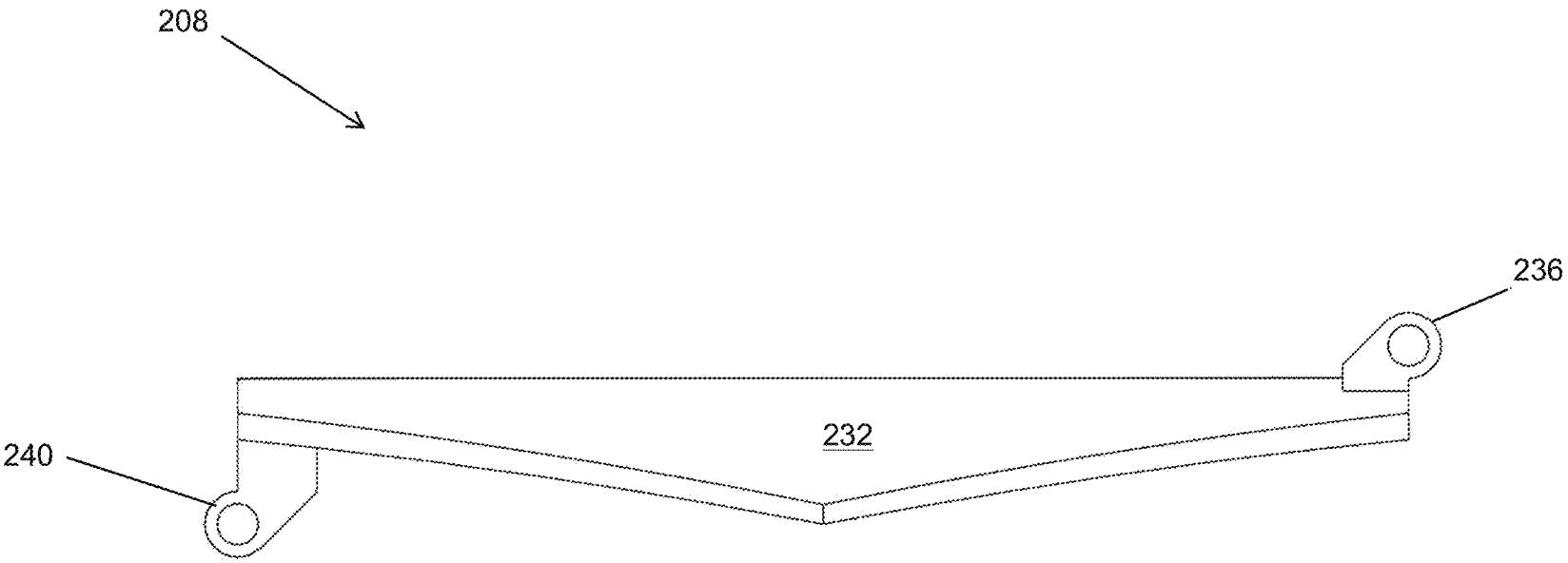
FIG. 4B is a side view of the example secondary cell of FIG. 4A.
Figure 4C:
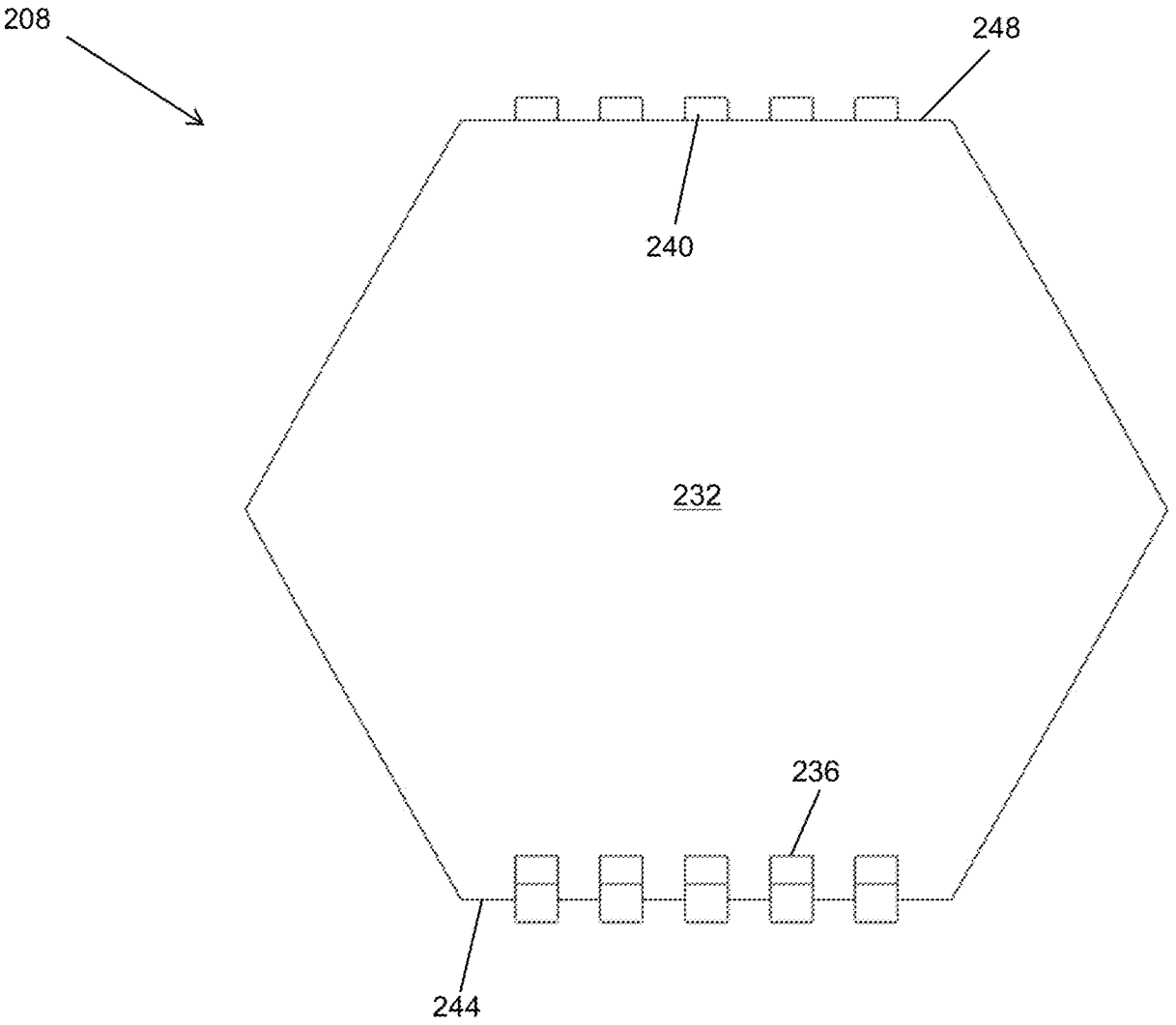
FIG. 4C is a top view of the example secondary cell of FIG. 4A.
Figure 4D:
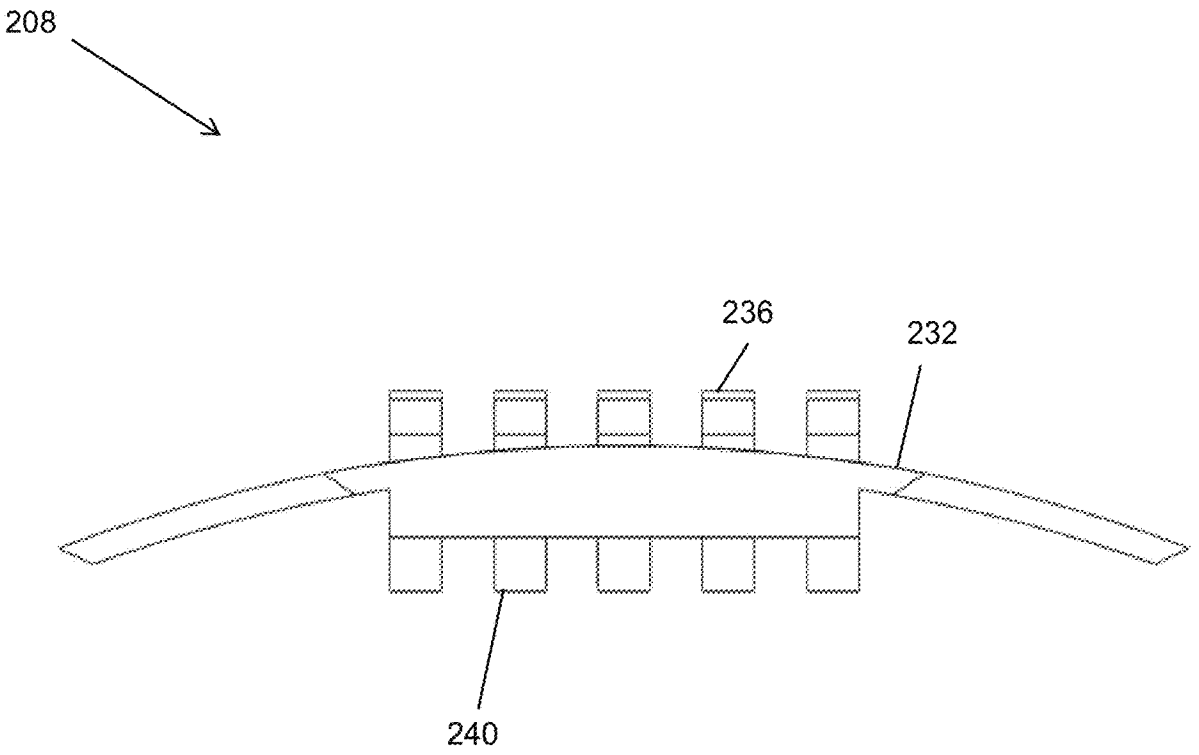
FIG. 4D is a front view of the example secondary cell of FIG. 4A.

As shown in the illustrated embodiments of FIGS. 2 to 4D, both the primary cell surface 212 and secondary cell surface 232 are curved (as shown in FIG. 3B for primary cell surface 212 and FIG. 4B for secondary cell surface 232). In various embodiments, the primary cell surface 212 and the secondary cell surface 232 are curved generally the same amount. The curvature of the primary 212 and secondary 232 cell surfaces can determine the overall configuration of the assembly 100 when collapsed. For example, in some cases, the primary 212 and secondary 232 cell surfaces are curved so that the assembly 100 has a cylindrical configuration when collapsed. In some other cases, the primary 212 and secondary 232 cell surfaces are curved more and, thereby providing an assembly 100 that has a spherical configuration when collapsed.

Referring now to FIGS. 2 to 4D, the first secondary cell hinge element 236 is complementary to the first primary cell hinge element 216. In the illustrated embodiment, first primary cell hinge element 216 includes four coupling elements and first secondary cell hinge element 236 includes five coupling elements. In other embodiments, different number of complementary coupling elements may be used. For example, first primary cell hinge element 216 may include three coupling elements and first secondary cell hinge element 236 may include four coupling elements. As another example, first primary cell hinge element 216 may include six coupling elements and first secondary cell hinge element 236 may include seven coupling elements. In a similar manner, second secondary cell hinge element 240 can be complementary to second primary cell hinge element 220.

First secondary cell hinge element 236 can be coupled to first primary cell hinge element 216 to provide a hinge connection 252. During change of collapsible assembly 100 between the extended configuration and the collapsed configuration, hinge connection 252 can move in a corresponding direction causing movement of primary cell surface 212 and secondary cell surface 232 as described in further detail herein below with reference to FIGS. 5A to 5G. To allow collapsibility of the assembly 100, the primary 204 and the secondary 208 cells are alternatingly arranged along the collapsibility axis so that the complementary hinge elements of adjacent cells are coupled to each other forming hinge connections. This causes adjacent hinge connections to rotate in opposite directions during collapsibility, thereby enabling the folding or collapsibility of the assembly 100 as discussed in detail below.

Figure 5A:
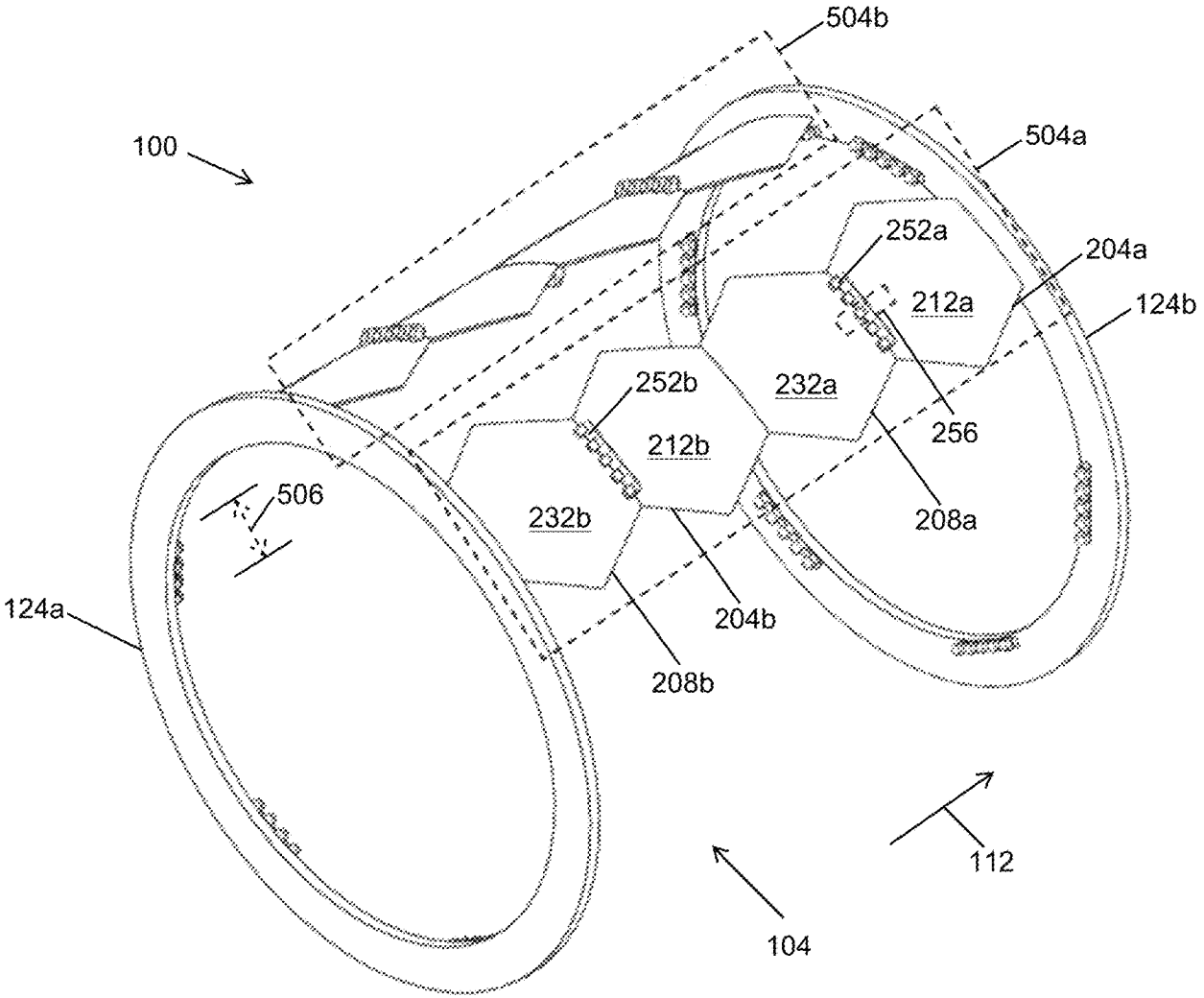
FIG. 5A is a perspective view of an example collapsible assembly in an extended configuration, in accordance with an embodiment.
Figure 5B:
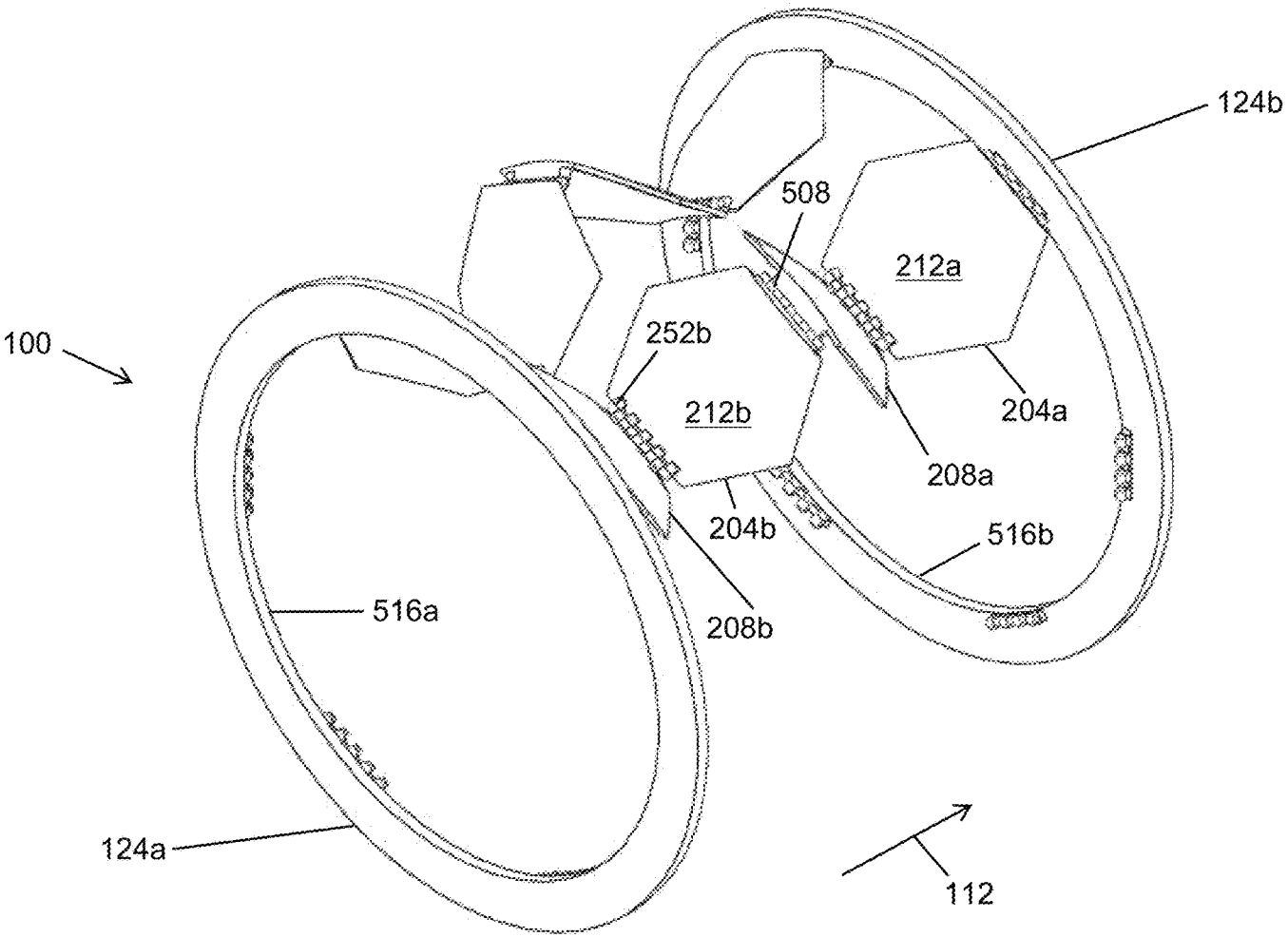
FIG. 5B is a perspective view of the example collapsible assembly of FIG. 5A in a partially collapsed configuration.
Figure 5C:
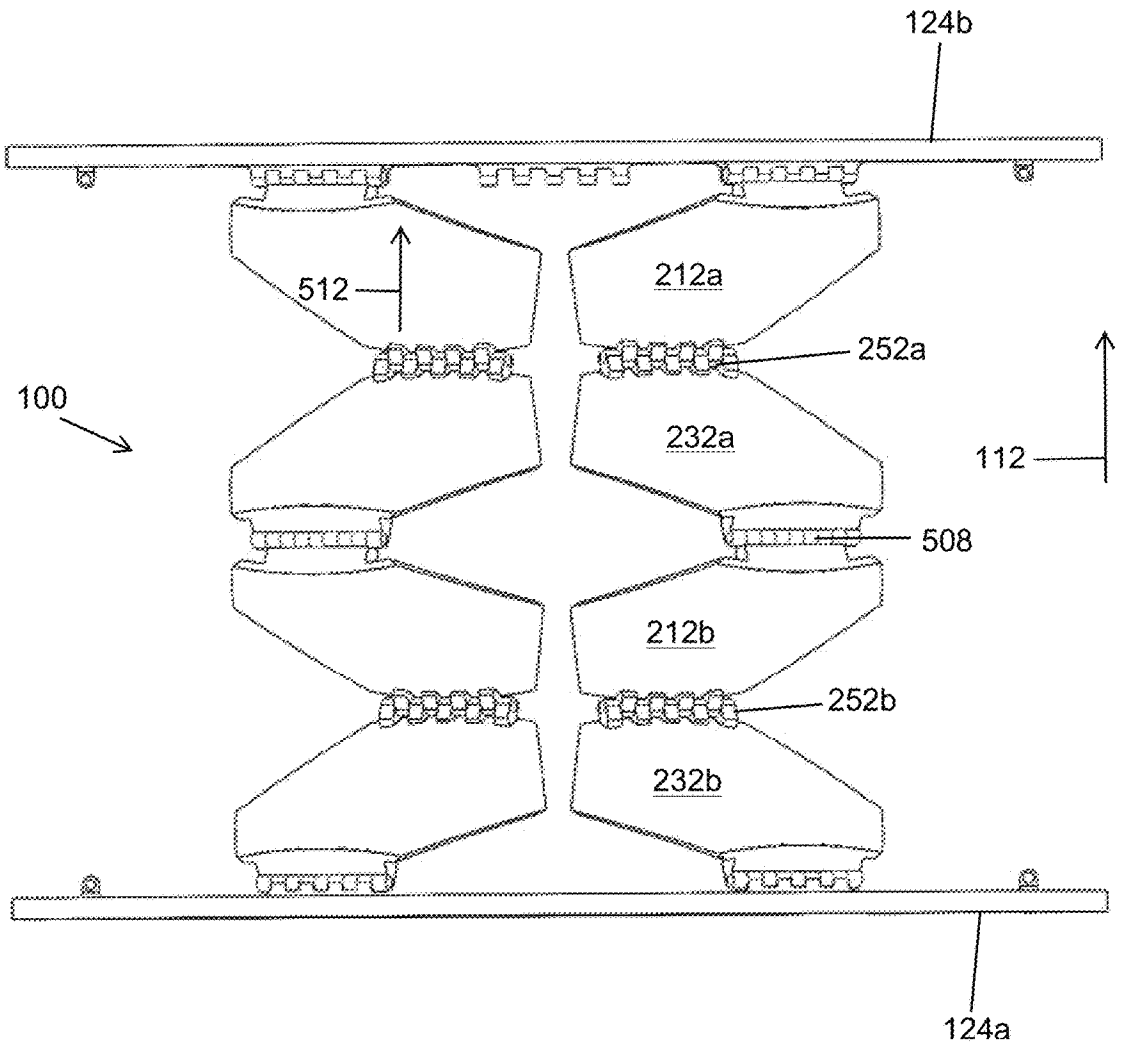
FIG. 5C is a top view of the example collapsible assembly of FIG. 5B.
Figure 5D:
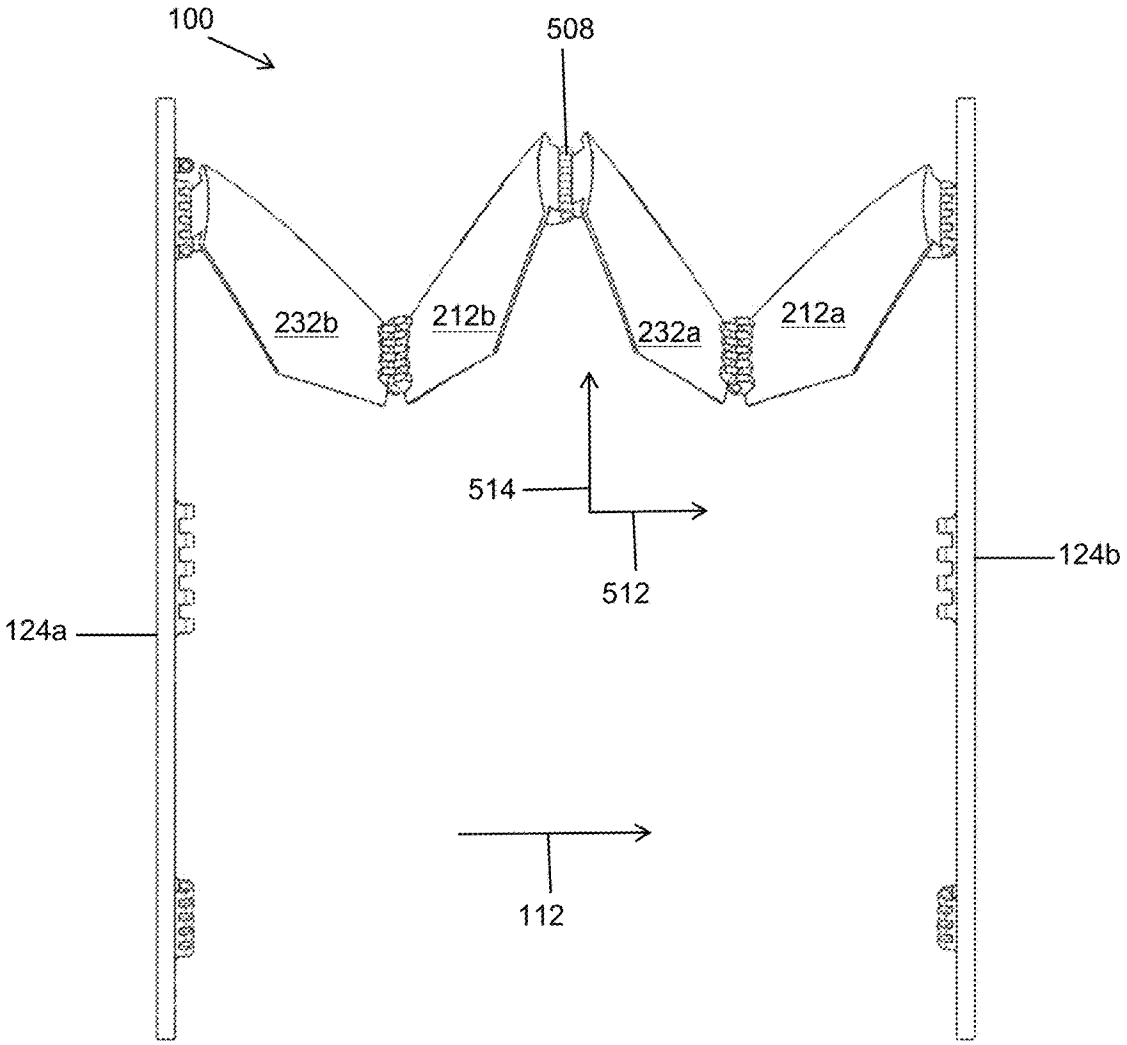
FIG. 5D is a side view of the example collapsible assembly of FIG. 5B.
Figure 5E:
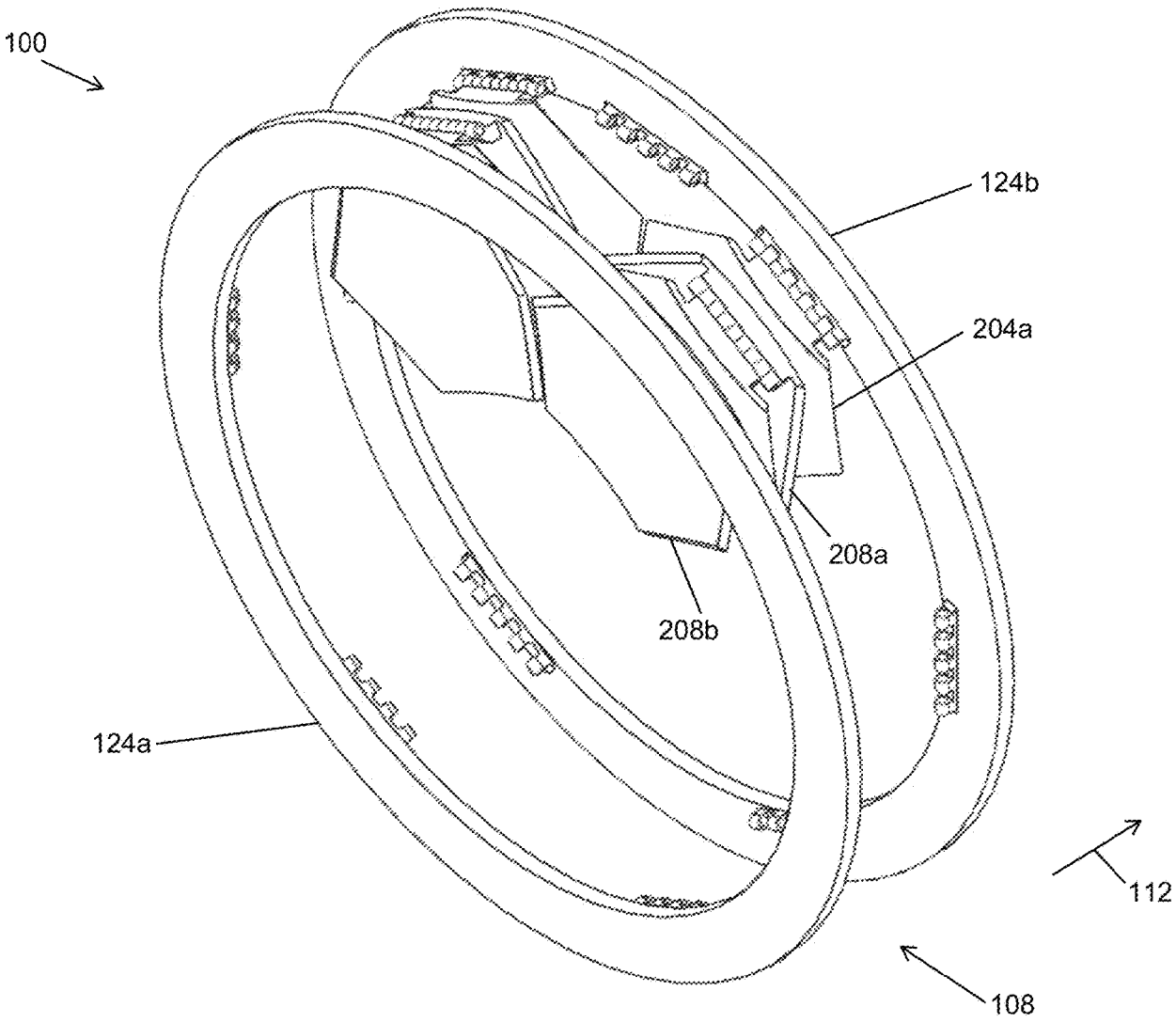
FIG. 5E is a perspective view of the example collapsible assembly of FIG. 5A in a fully collapsed configuration.
Figure 5F:
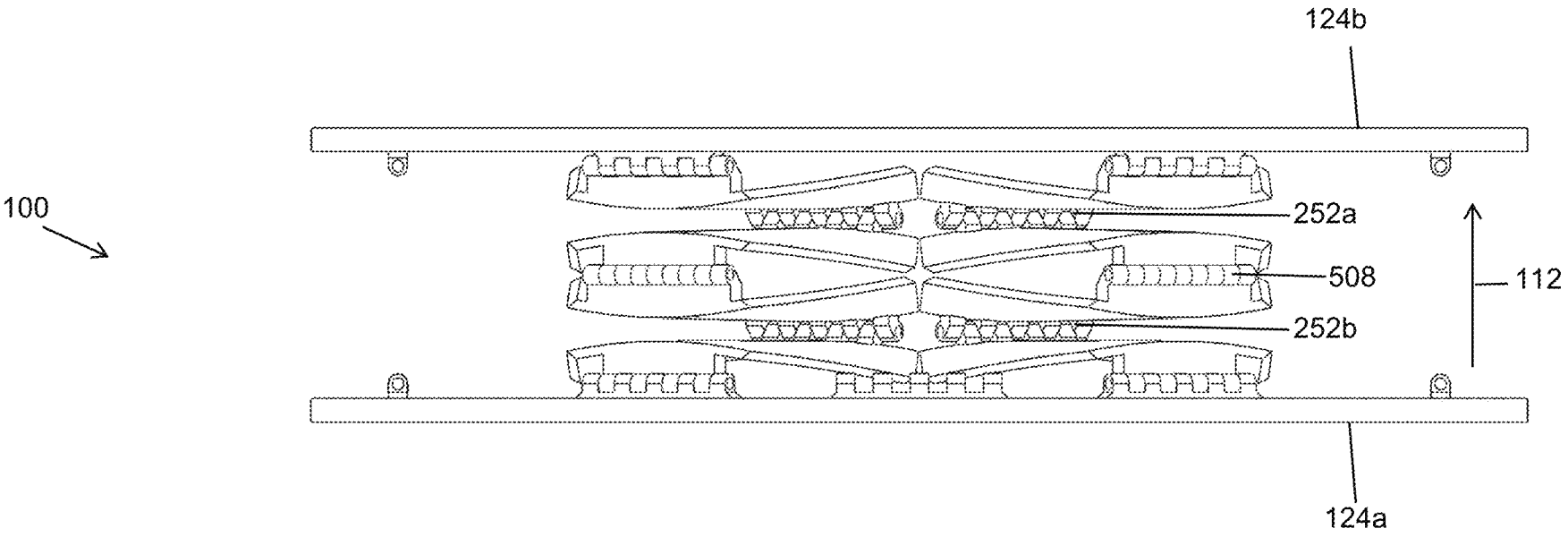
FIG. 5F is a top view of the example collapsible assembly of FIG. 5E.
Figure 5G:
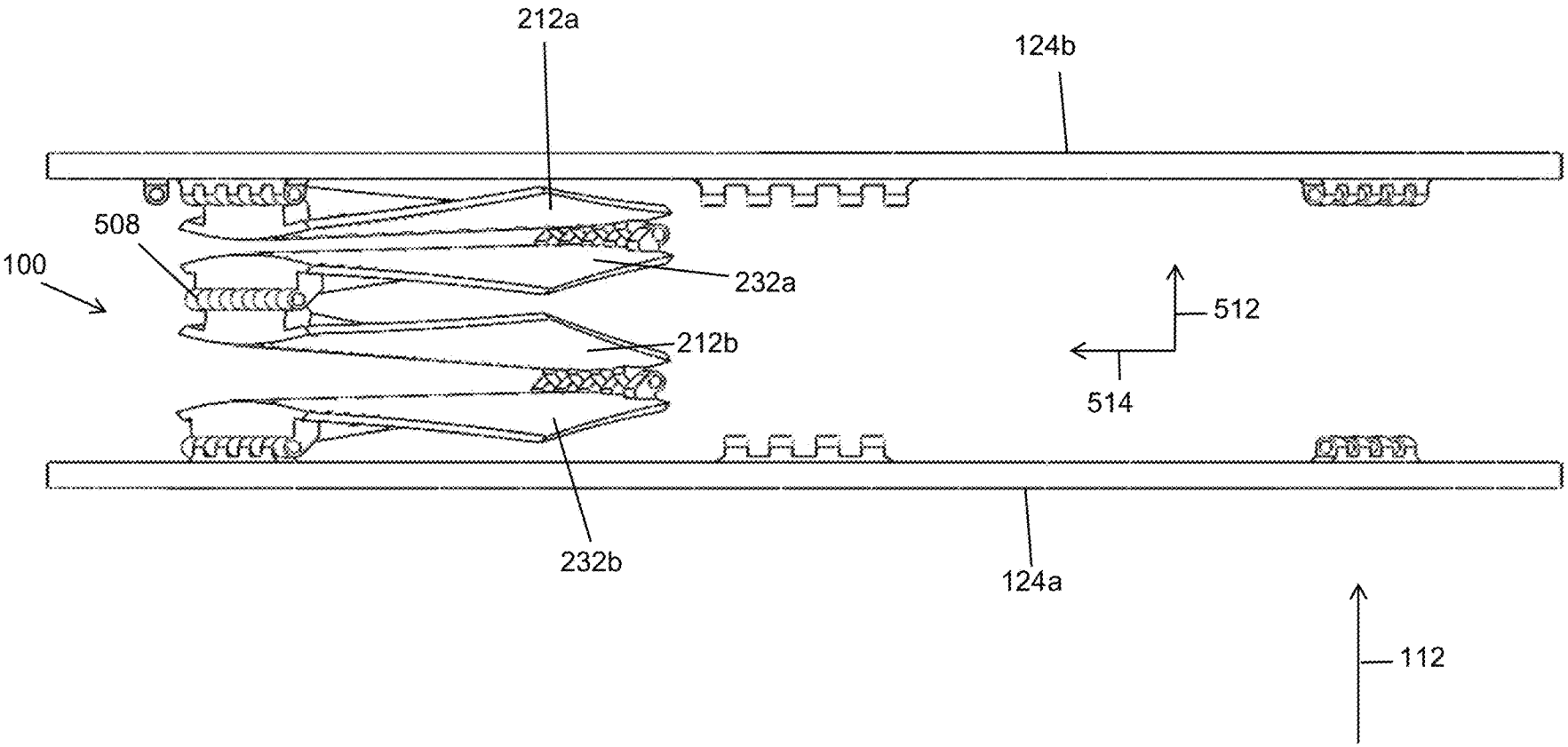
FIG. 5G is a side view of the example collapsible assembly of FIG. 5E.

Referring now to FIGS. 5A to 5G, shown therein are different views of collapsible assembly 100 changing from an extended configuration to a partially collapsed configuration and further to a fully collapsed configuration. FIG. 5A shows a perspective view of collapsible assembly 100 in extended configuration 104. FIGS. 5B-5D show a perspective view, a top view and a side view respectively of collapsible assembly 100 in the partially collapsed configuration. FIGS. 5E-5G show a perspective view, a top view and a side view respectively of collapsible assembly 100 in the fully collapsed configuration 108.

As shown in FIG. 5A, collapsible assembly 100 comprises two rows 504*a* and 504*b* of primary and secondary cells 204 and 208. Row 504*a* is parallel to row 504*b* and separated from row 504*b* by an intermediary distance 506.

In some embodiments, additional parallel rows 504 may be connected between end plates 124 and arranged around an inner circumference 516 of end plates 124 to form a cylindrical structure. Referring back to FIGS. 2 to 4D, primary cell surfaces 212 and secondary cell surfaces 232 may be curved (as shown in FIG. 3B for primary cell surface 212 and FIG. 4B for secondary cell surface 232) to match the curvature of the cylindrical structure. In some embodiments, while cell surfaces 212 and 232 are curved, the hinge elements 216, 220, 236 and 240 may be straight and not curved.

Referring back to FIGS. 5A to 5G, each row 504 includes multiple primary cells 204 and multiple secondary cells 208. As shown, row 504*a* includes a first primary cell 204*a* coupled to a first secondary cell 208*a*, which is coupled to a secondary primary cell 204*b*, which is coupled to a second secondary cell 208*b*. The first primary cell 204*a* is connected to the first secondary cell 208*a* when the first primary cell hinge element 216 is coupled to the complementary first secondary cell hinge element 236 forming a hinge connection 252*a*. Similarly, secondary primary cell 204*b* is connected to the second secondary cell 208*b* when the corresponding first primary cell hinge element 216 of the second primary cell 204*b* is coupled to the first secondary cell hinge element 236 of the second secondary cell 208*b* forming a hinge connection 252*b*. In addition, the first secondary cell 208*a* is connected to the adjacent second primary cell 204*b* when the second secondary cell hinge element 240 of the first secondary cell 208*a* is coupled to the second primary cell hinge element 220 of the second primary cell 204*b* forming a hinge connection 508 (shown in FIGS. 5B-5D). Similarly, various primary and secondary cells 204, 208 can be arranged alternatingly, along collapsibility axis 112, along rows connecting end plates 124*a* and 124*b*, such that adjacent cells have hinge elements that are complementary to each other.

As shown in FIGS. 5A-5G, the arrangement of hinge connections 252*a,b* and 508 on opposite sides of the cell surfaces causes the hinge connections 252*a,b* and 508 to move in opposite directions as collapsible assembly 100 changes from extended configuration 104 to collapsed configuration 108. This causes movement of primary cell surfaces 212 and secondary cell surfaces 232 from an axis 512 (that is generally parallel to collapsibility axis 112) to an axis 514 (that is generally perpendicular to collapsibility axis 112) to reduce the surface area of collapsible assembly 100.

In some embodiments, axis 512 can be within 0° to 5° of collapsibility axis 112. In other embodiments, axis 512 can be offset by a larger angle with respect to collapsibility axis 112. In some embodiments, axis 514 can be at an angle of 85° to 90° with respect to collapsibility axis 112. In other embodiments, axis 514 can be offset by an angle smaller than 85° with respect to collapsibility axis 112. Embodiments where axis 514 is generally at an angle of about 90° (±0.5°) with respect to collapsibility axis 112 may provide higher collapsibility efficiencies by providing larger reductions in collapsed length and/or surface area. When axis 514 is generally at an angle of about 90° (±0.5°) with respect to collapsibility axis 112, the length of collapsible assembly 100 in collapsed configuration 108 can correspond to a sum of the thicknesses of the cell surfaces. In some embodiments, this movement of hinge connections 252*a,b* and 508 may provide an accordion style movement of collapsible assembly 100.

In some embodiments, collapsible assembly 100 may include a joint lock (FIG. 5A) corresponding to each hinge connection 252 and 508. For example, FIG. 5A shows joint lock 256 corresponding to hinge connection 252*a*. Joint lock 256 can be of any suitable design of any suitable size that prevents relative movement between the cell surfaces coupled at the corresponding hinge connection. For example, joint lock 256 may prevent relative movement between primary cell surface 212*a* and secondary cell surface 232*a*. In some embodiments, joint lock 256 can include an electromechanical assembly with a mechanical locking element that is controlled by an electrical mechanism (e.g., a motor). Joint lock 256 may enable collapsible assembly 100 to remain in extended configuration in the presence of a collapsing force. For an example extraterrestrial habitat structure using collapsible assembly 100 in extended configuration, collapsible assembly 100 may be able to withstand gravitational and atmospheric forces exerted in space or on a surface of another planet (e.g. at the Martian surface) and remain in extended configuration by using a joint lock for each hinge connection 252*a,b* and 508. For the example collapsible assembly 100 shown in FIGS. 5A-5G comprising four primary cells and four secondary cells in rows 504*a* and 504*b*, a total of six joint locks corresponding to six hinge connections may be required. This can increase the cost and complexity of collapsible assembly 100. Additionally, the failure of any one of the six joint locks may prevent the entire collapsible assembly 100 from operating properly.

In some embodiments, control unit 128 may control operation of joint lock 256 to lock or unlock the hinge connections of collapsible assembly 100 before initiating change of collapsible assembly 100 between the extended configuration and the collapsed configuration. Control unit 128 may control the locking or unlocking operations of joint lock 256 by providing a corresponding lock or unlock control signal.

Figure 6:
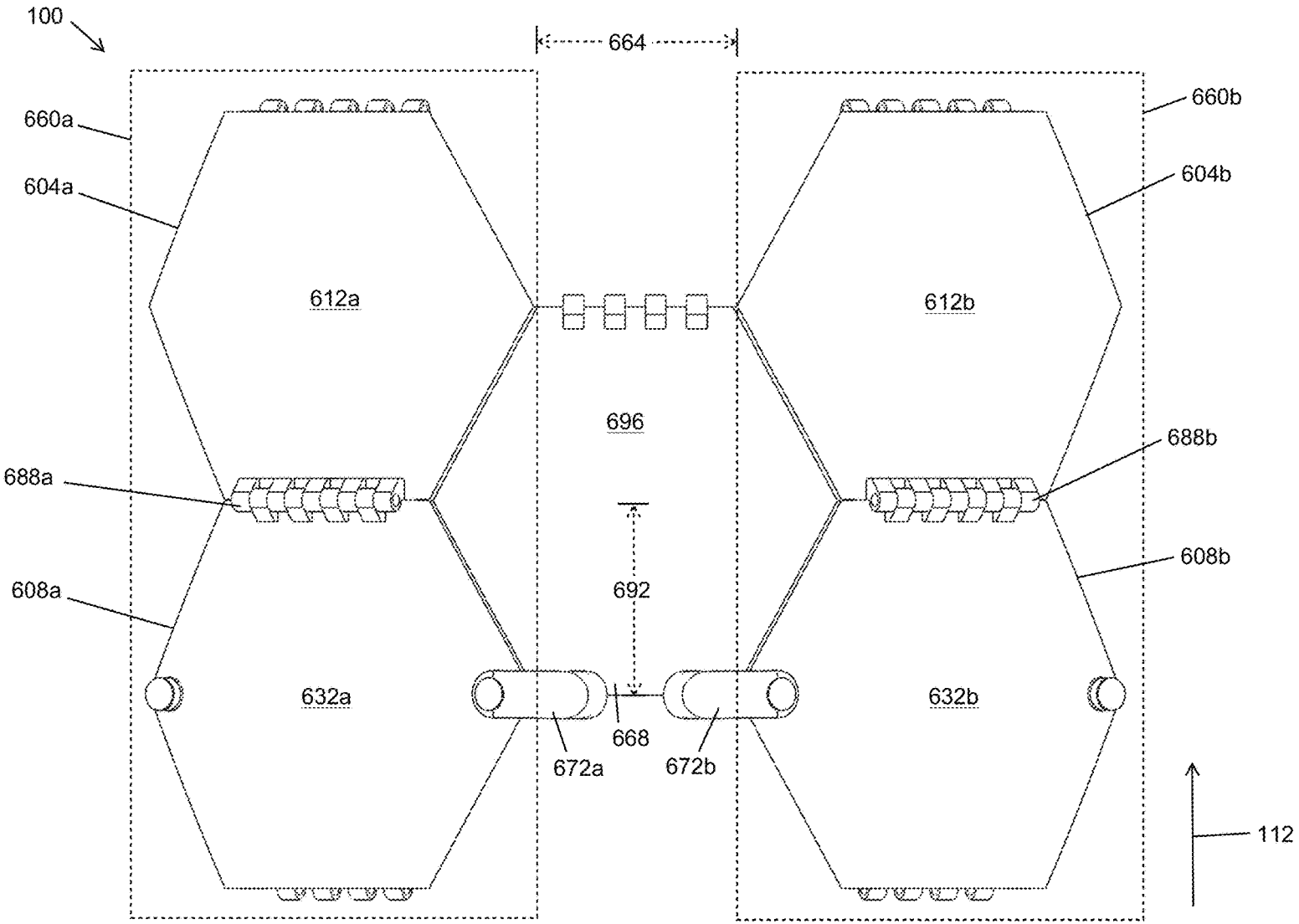
FIG. 6 is a perspective view of an example collapsible assembly in an extended configuration, in accordance with an embodiment.
Figure 7A:
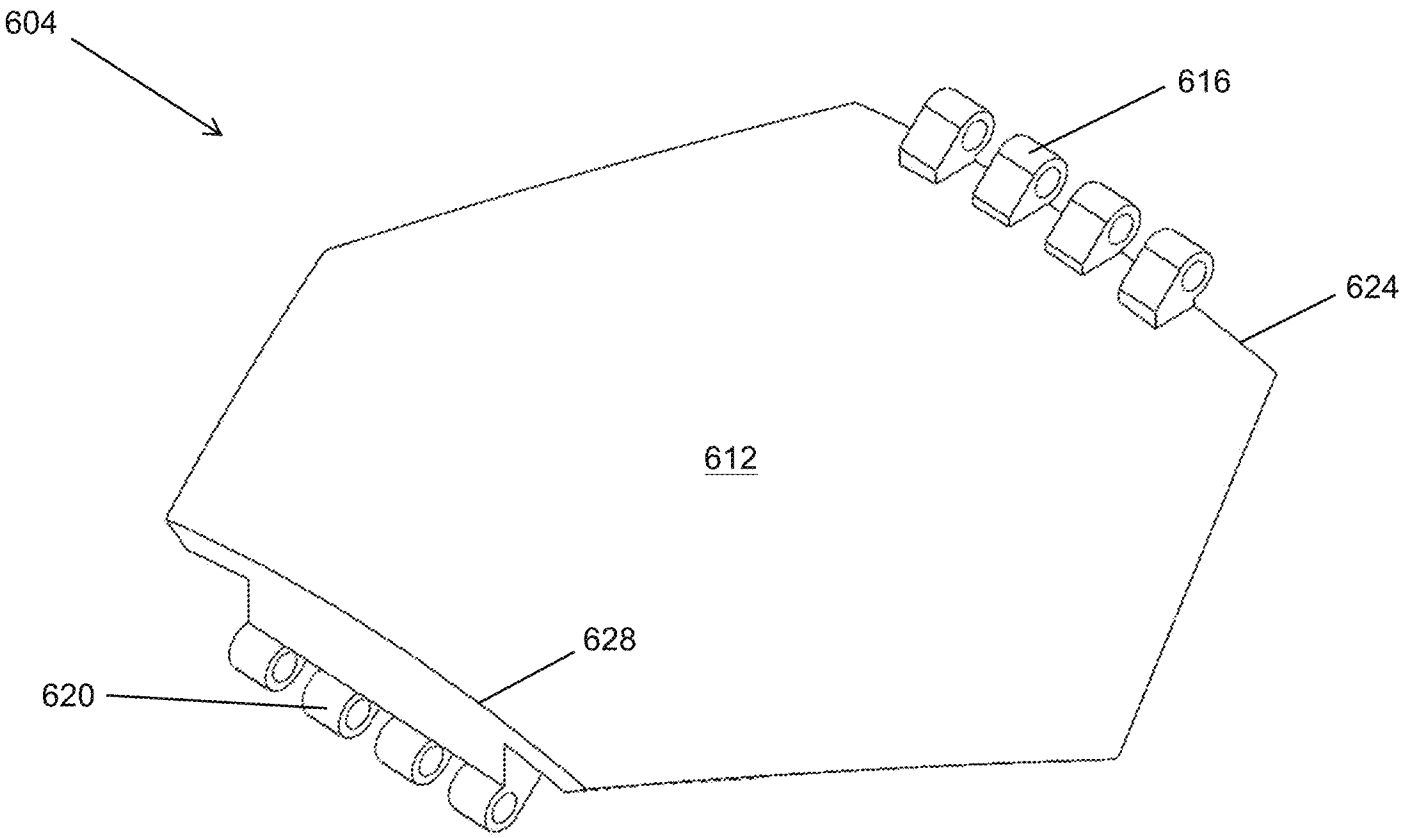
FIG. 7A is a perspective view of an example primary cell of the collapsible assembly of FIG. 6.
Figure 7B:
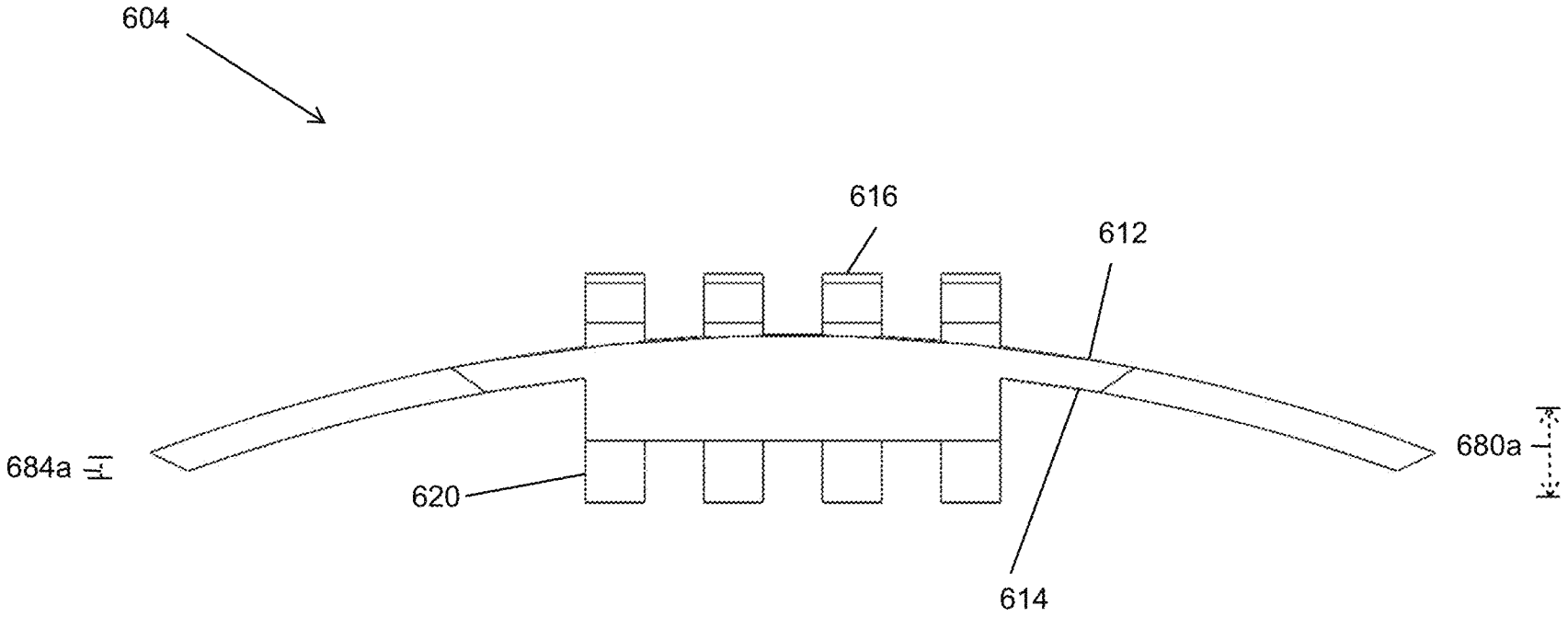
FIG. 7B is a front view of the example primary cell of FIG. 7A.
Figure 7C:
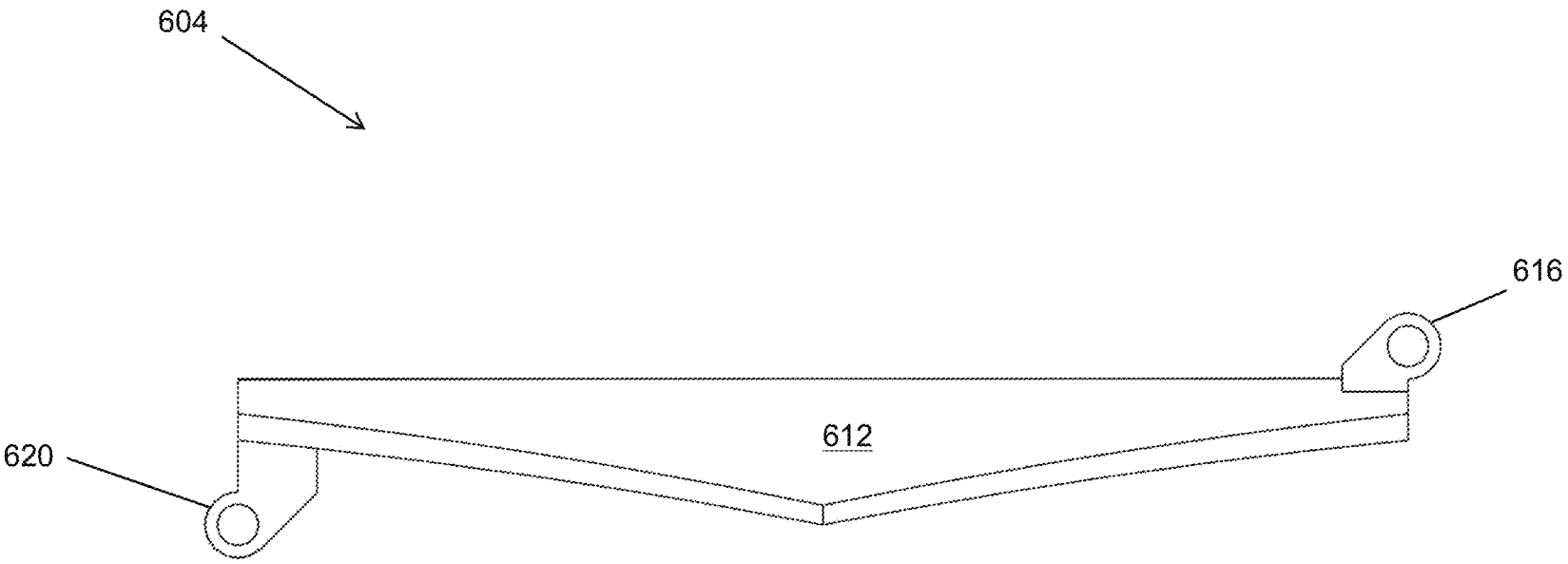
FIG. 7C is a side view of the example primary cell of FIG. 7A.
Figure 7D:
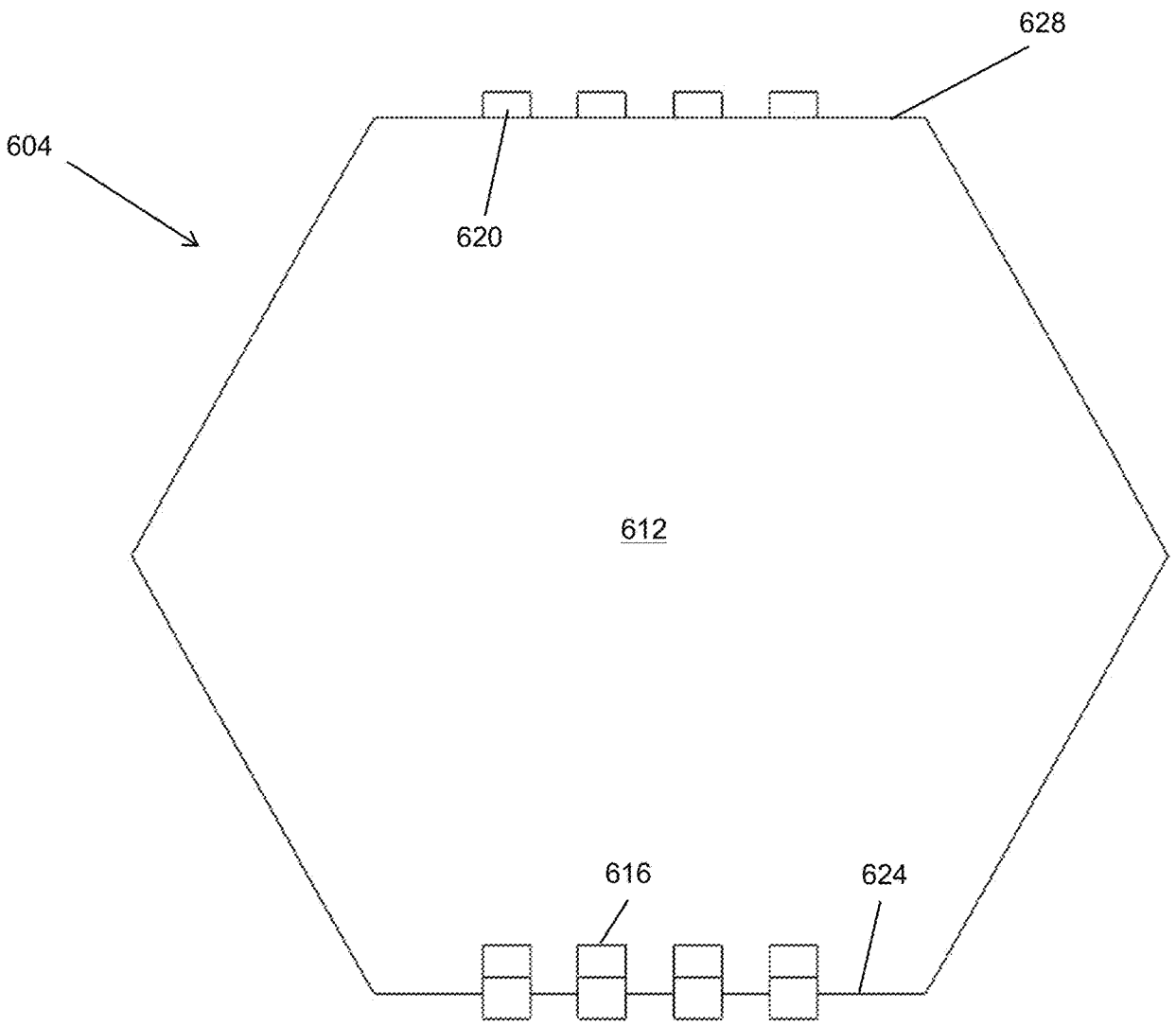
FIG. 7D is a top view of the example primary cell of FIG. 7A.
Figure 8A:
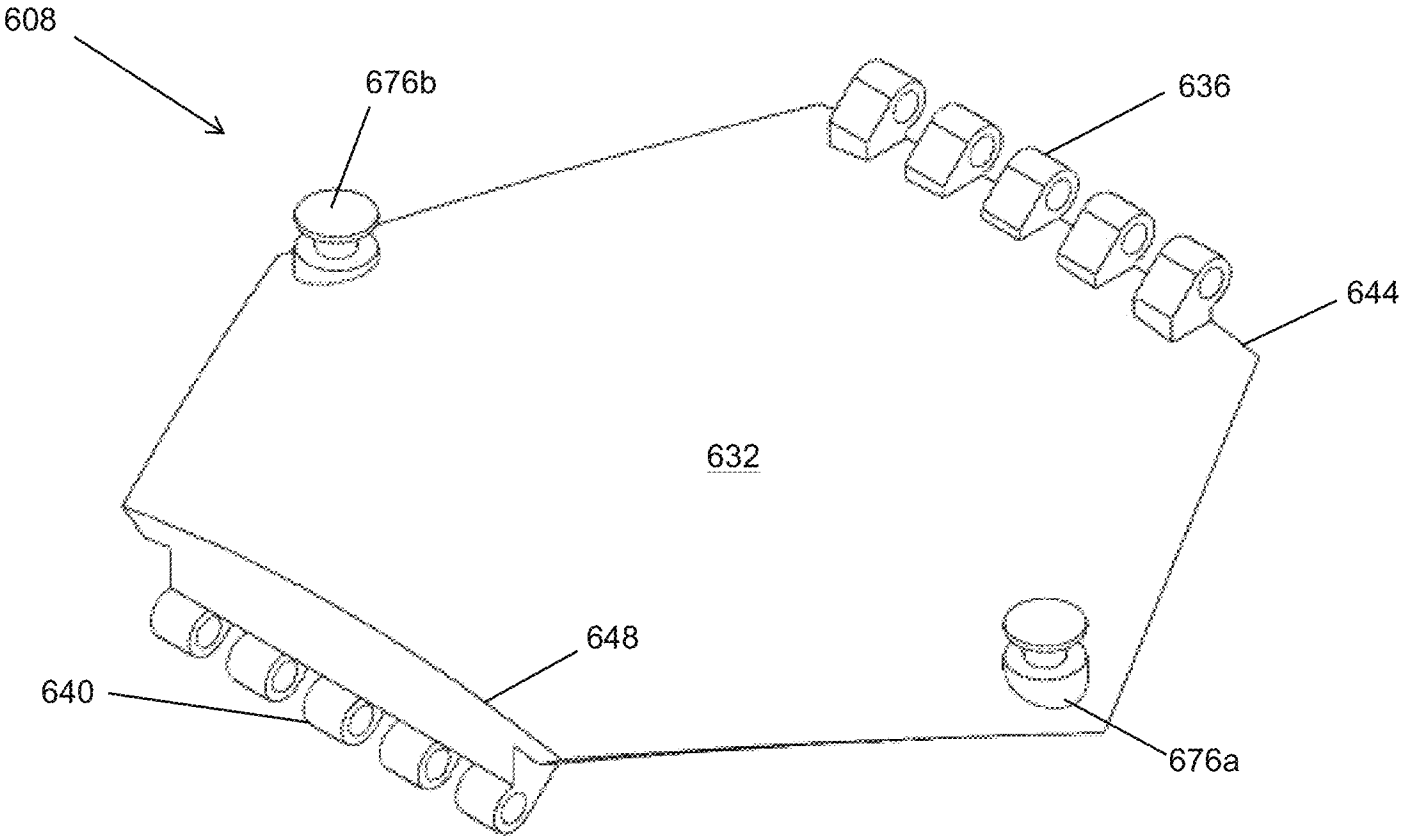
FIG. 8A is a perspective view of an example secondary cell of the collapsible assembly of FIG. 6.
Figure 8B:
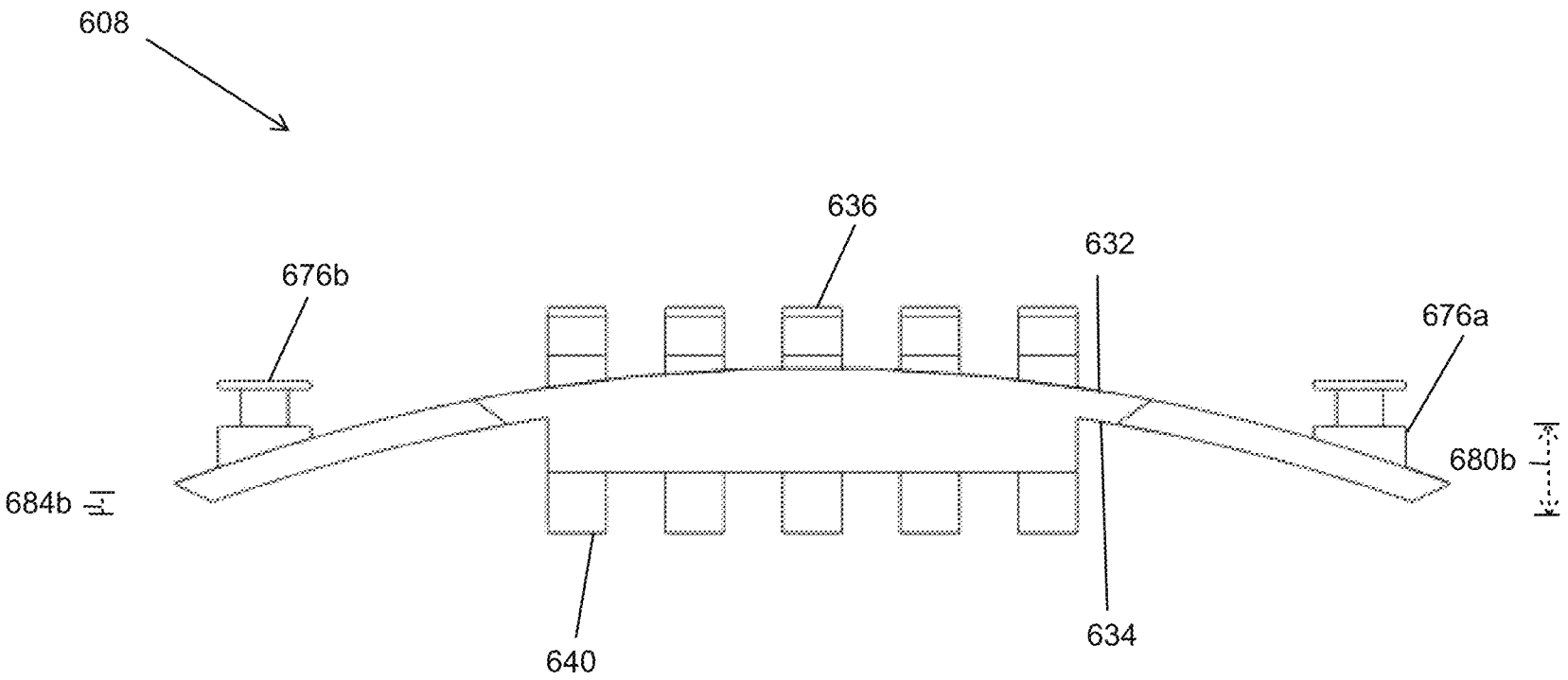
FIG. 8B is a front view of the example secondary cell of FIG. 8A.
Figure 8C:
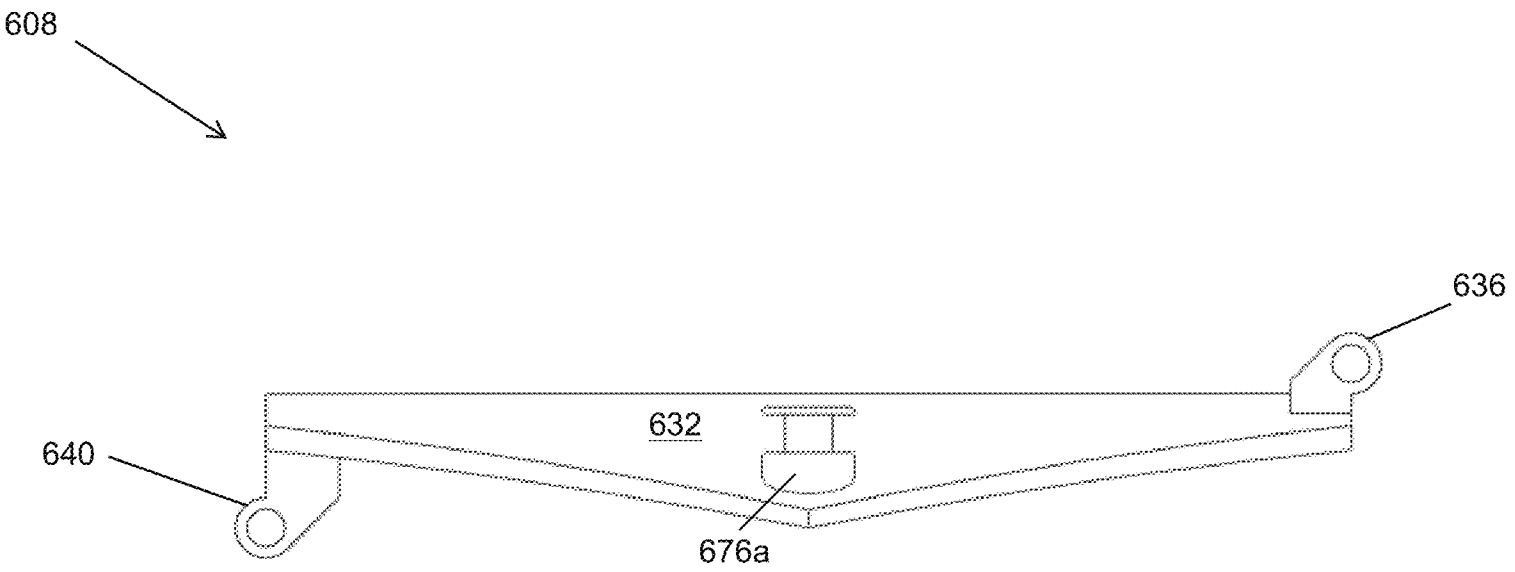
FIG. 8C is a side view of the example secondary cell of FIG. 8A.
Figure 8D:
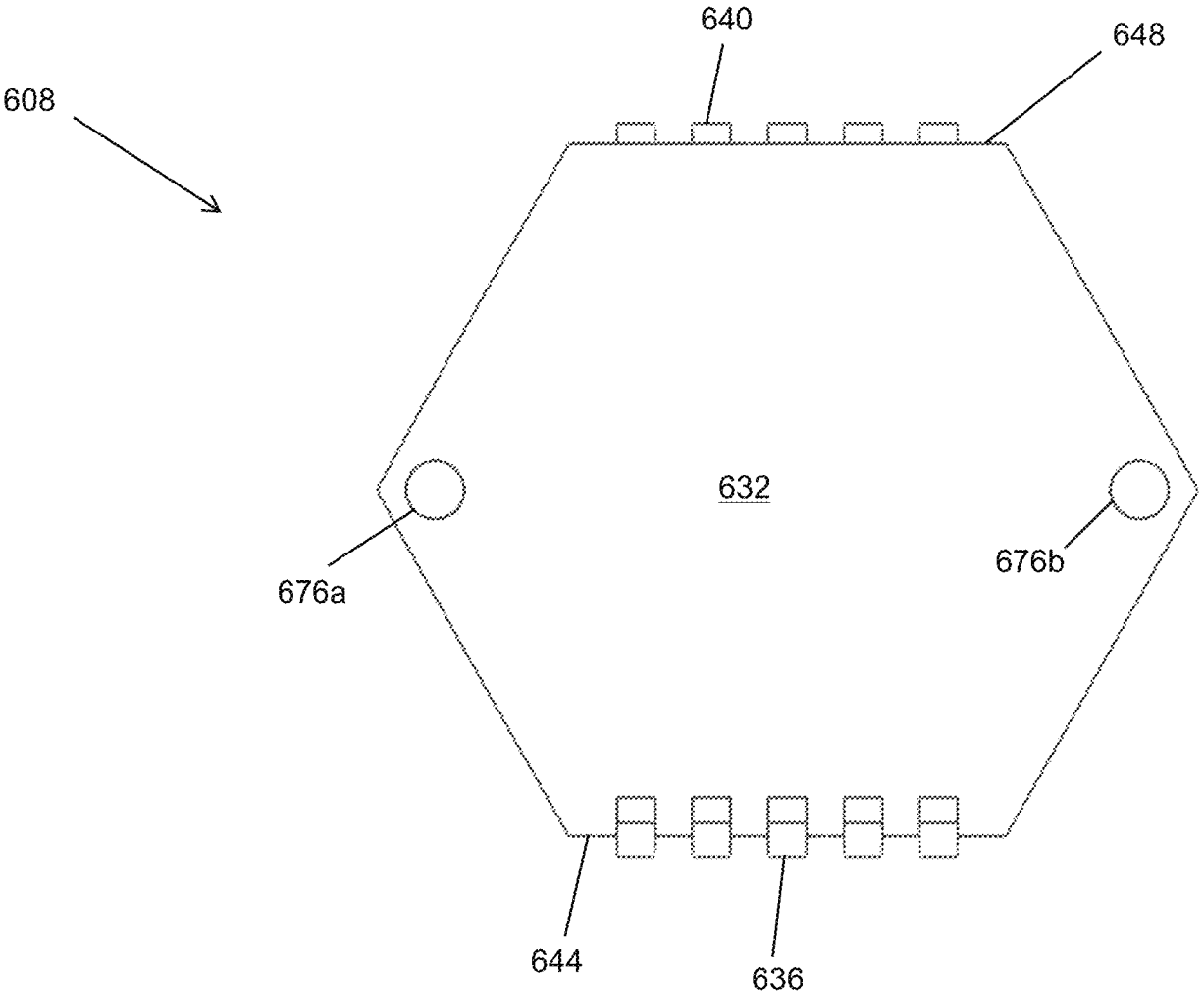
FIG. 8D is a top view of the example secondary cell of FIG. 8A.
Figure 9A:
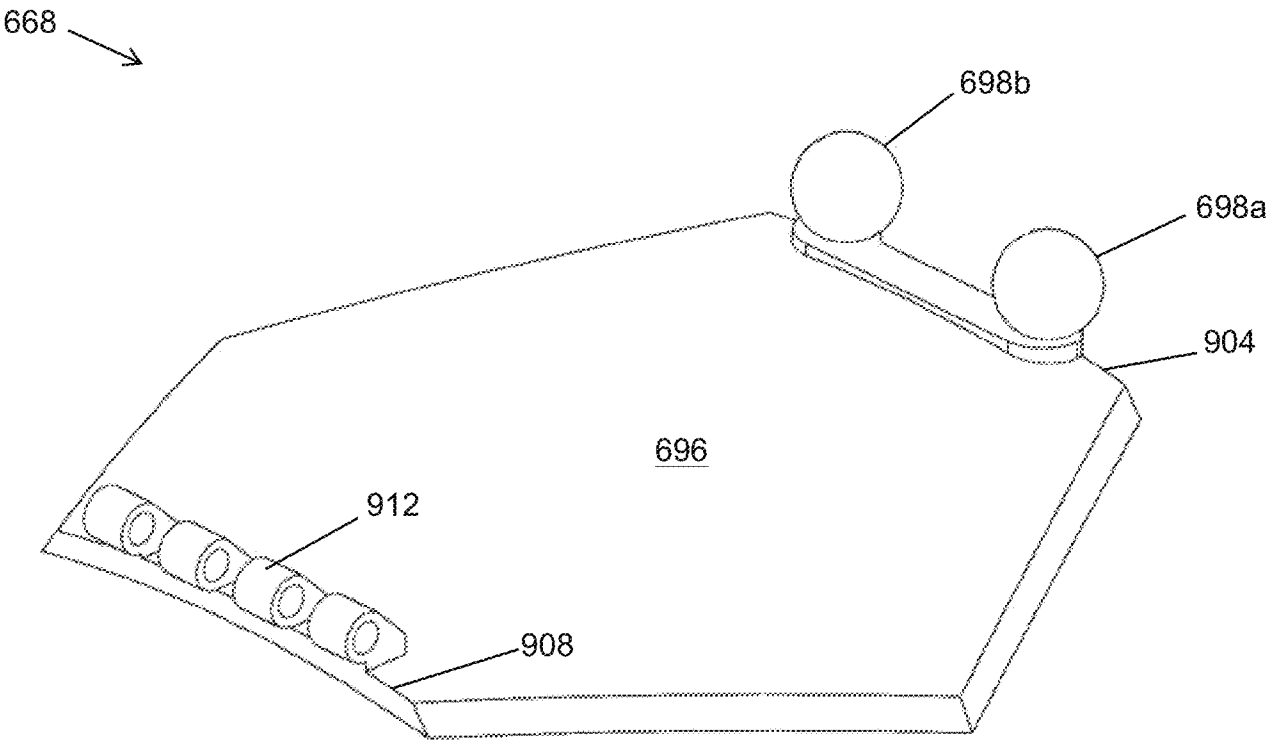
FIG. 9A is a perspective view of an example intermediary cell of the collapsible assembly of FIG. 6.
Figure 9B:
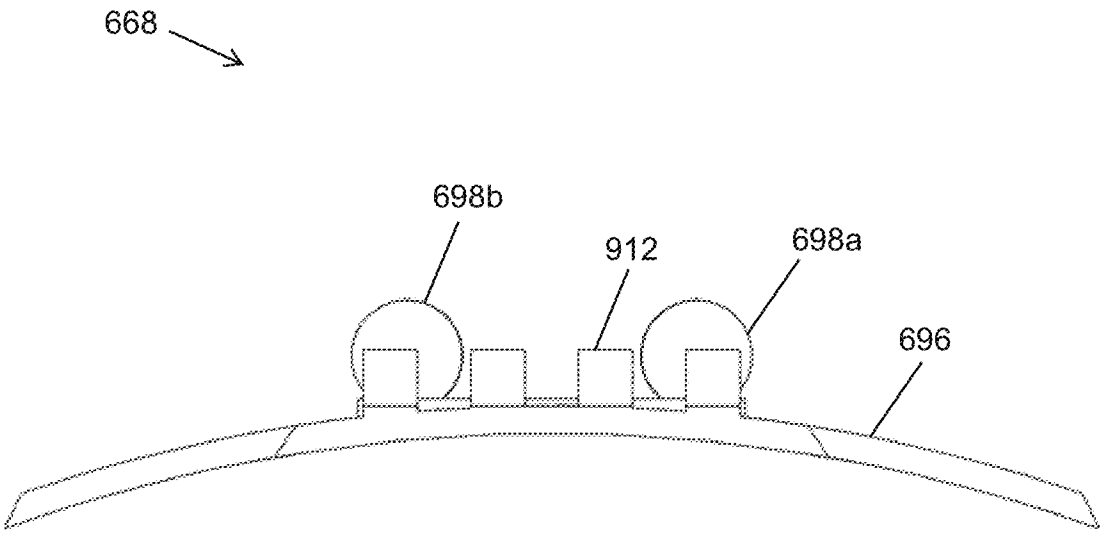
FIG. 9B is a front view of the example intermediary cell of FIG. 9A.
Figure 9C:
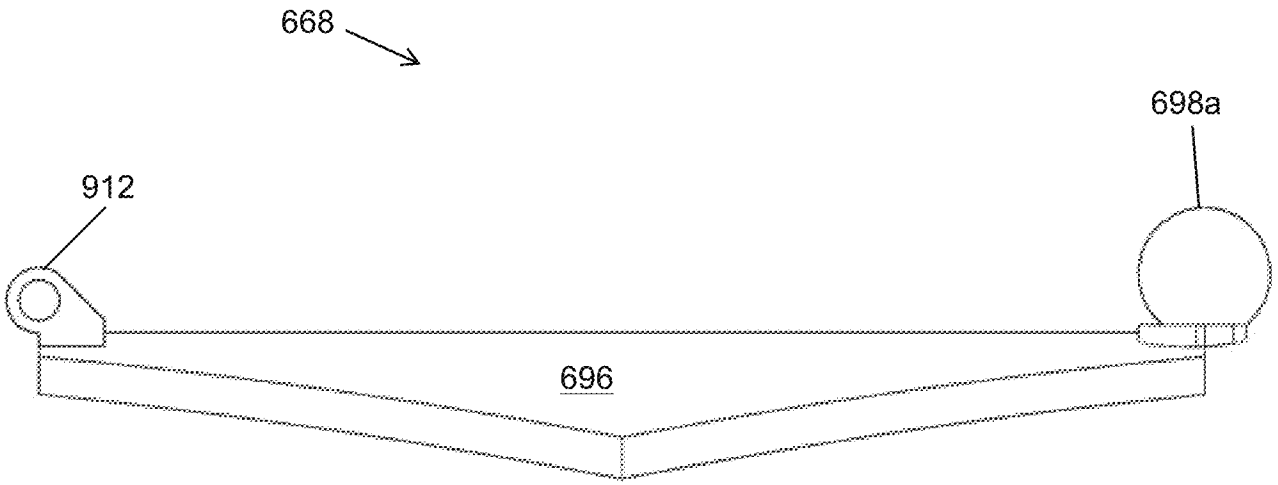
FIG. 9C is a side view of the example intermediary cell of FIG. 9A.
Figure 9D:
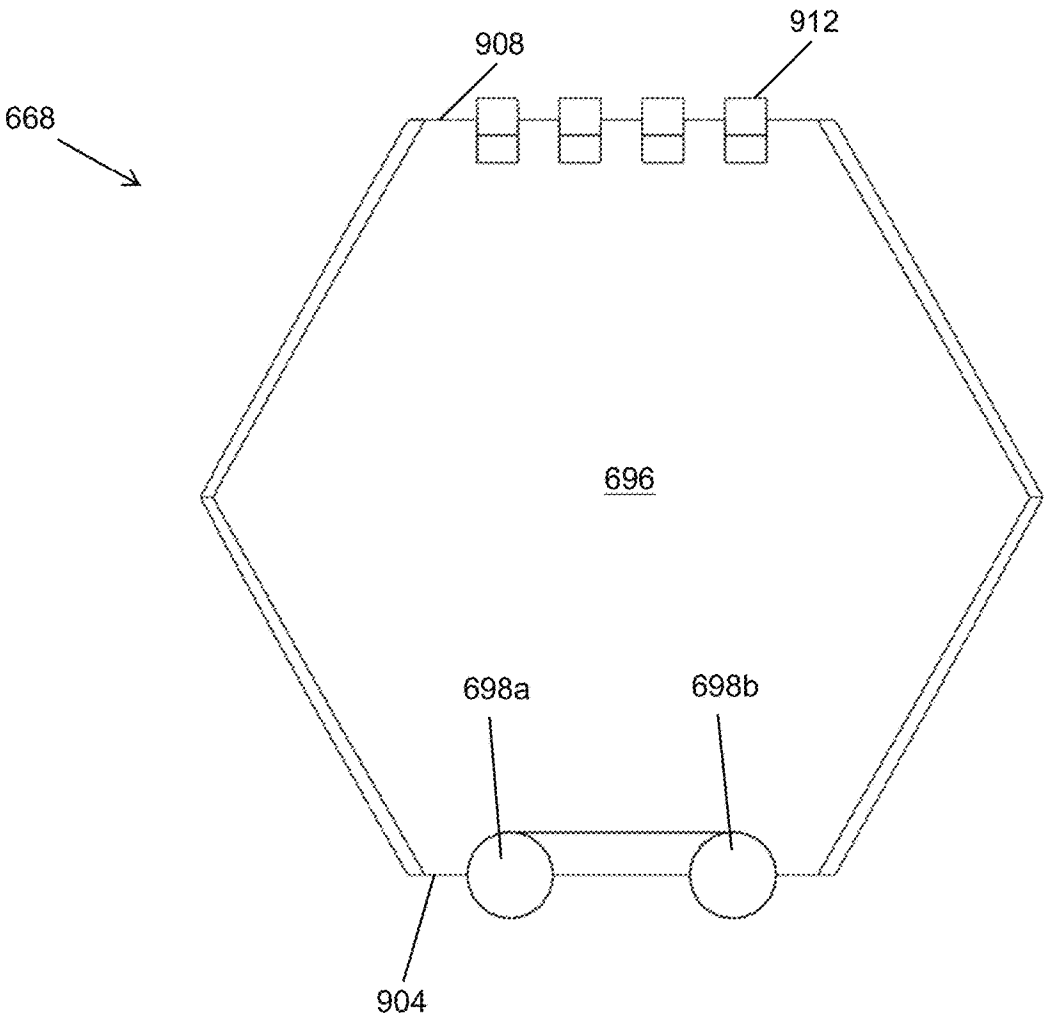
FIG. 9D is a top view of the example intermediary cell of FIG. 9A.
Figure 9E:
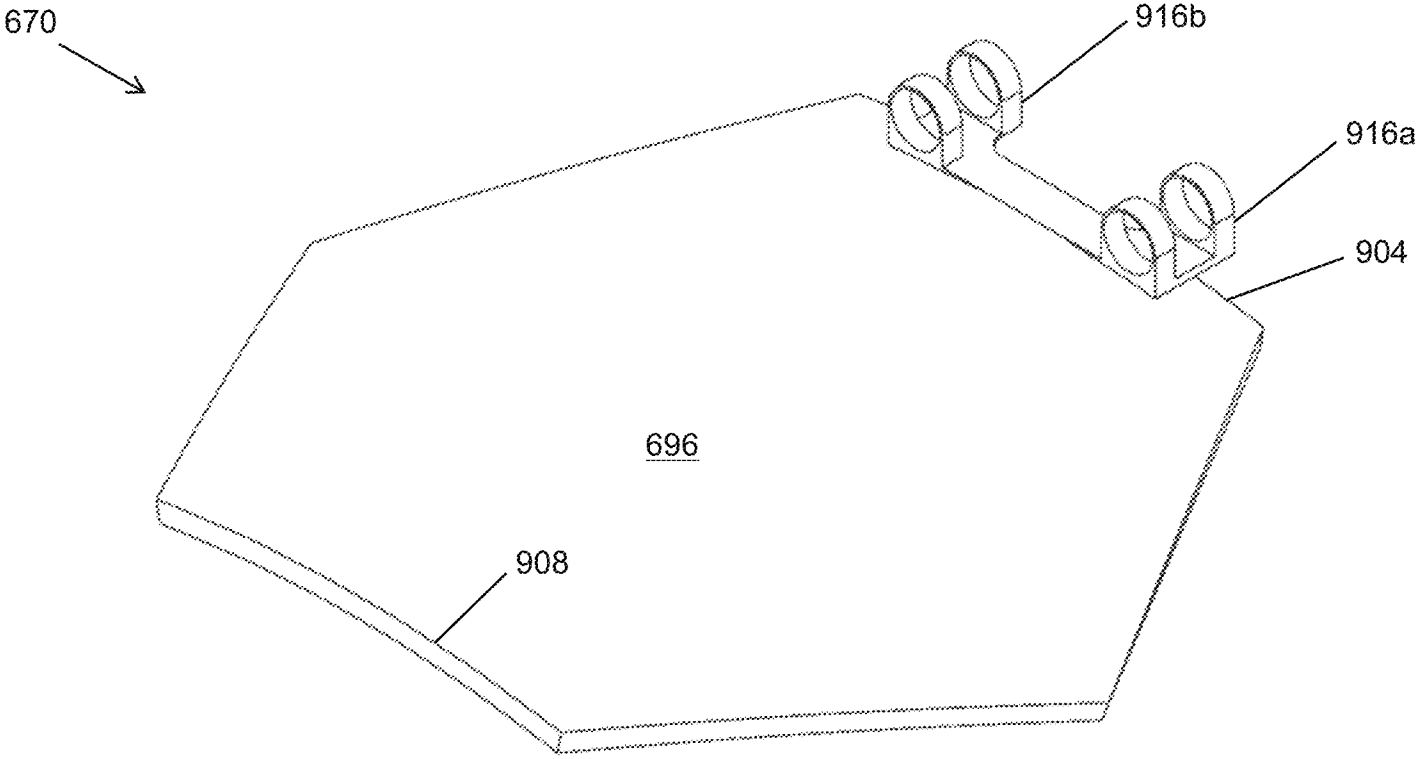
FIG. 9E is a perspective view of an another example intermediary cell of the collapsible assembly of FIG. 6.
Figure 9F:
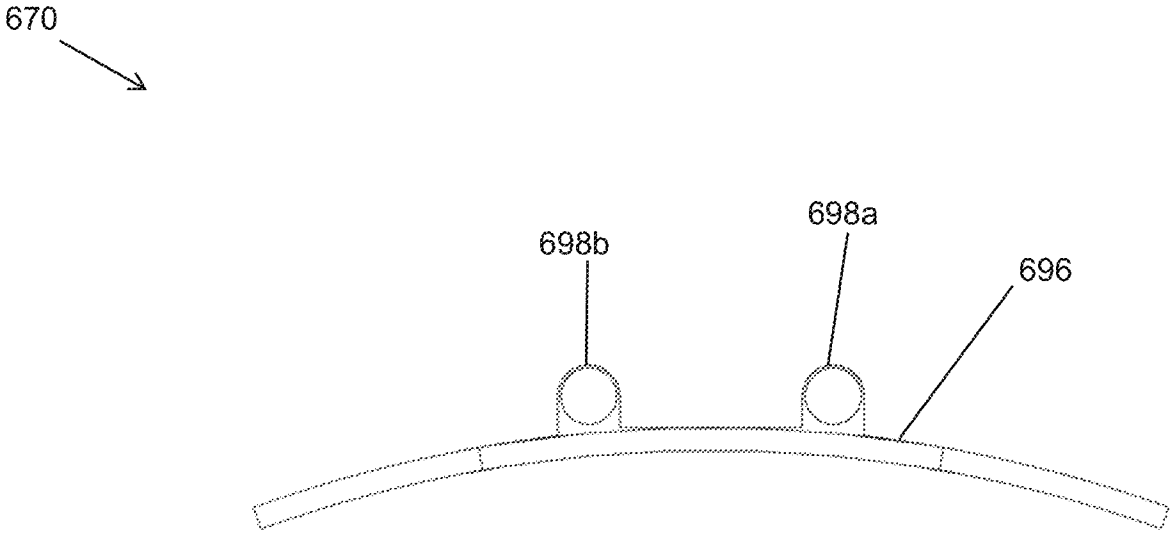
FIG. 9F is a front view of the example intermediary cell of FIG. 9E.
Figure 9G:
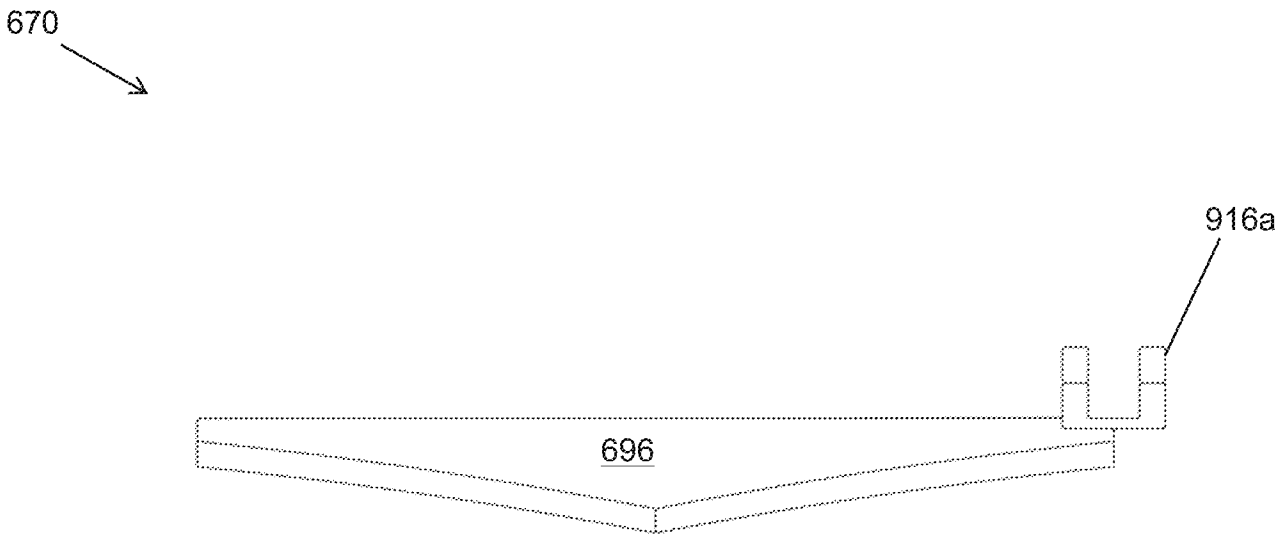
FIG. 9G is a side view of the example intermediary cell of FIG. 9E.
Figure 9H:
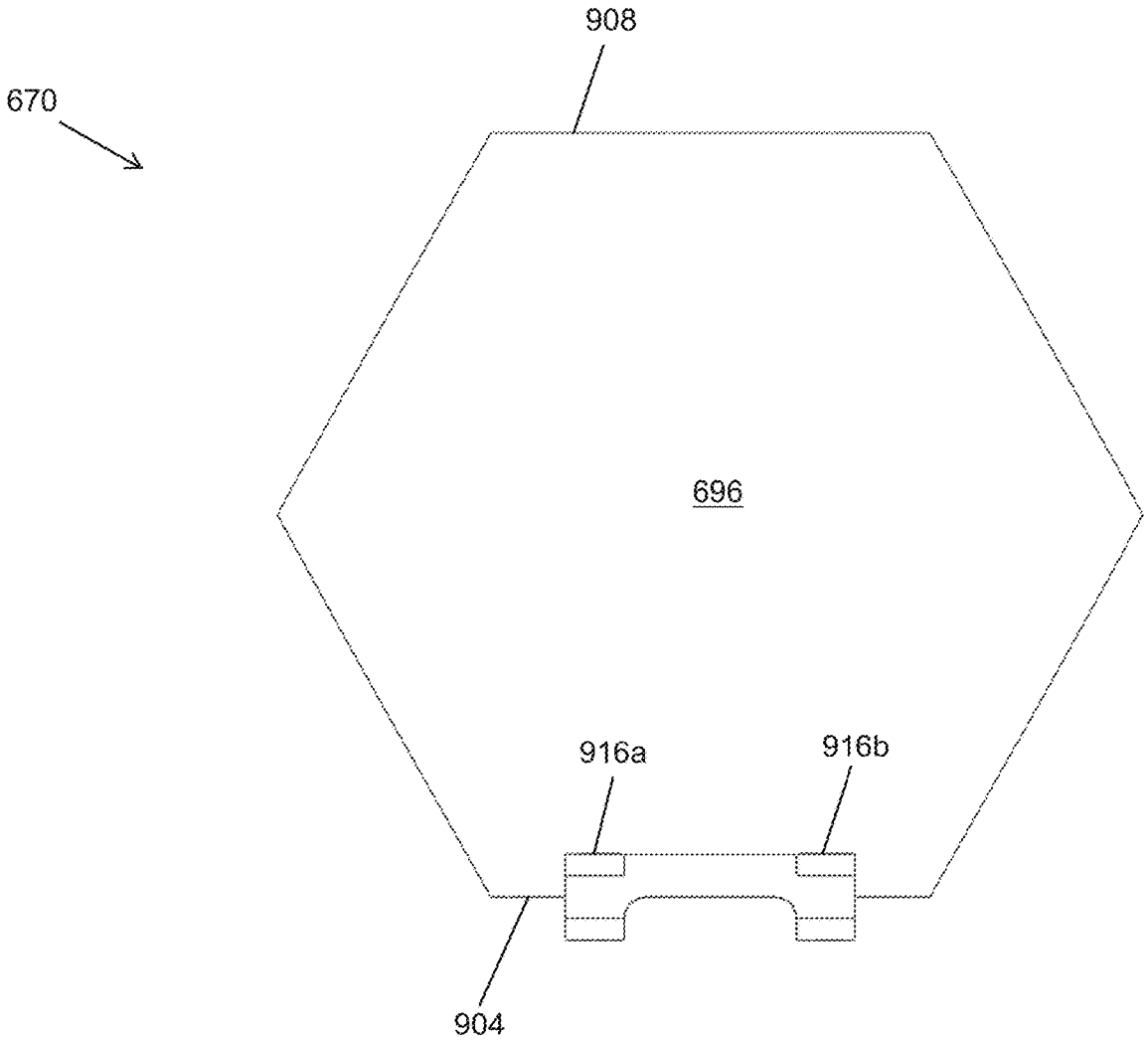
FIG. 9H is a top view of the example intermediary cell of FIG. 9E.

Referring now to FIG. 6, shown therein is a perspective view of another example embodiment of collapsible assembly 100 in an extended configuration. Collapsible assembly 100 can be configured to change, along collapsibility axis 112, between the extended configuration and a collapsed configuration (not shown in FIG. 6).

Collapsible assembly 100 comprises two symmetrical peripheral unit assemblies 660*a* and 660*b*, an intermediary cell 668, and two coupling elements 672*a* and 672*b*. As shown, the intermediary cell 668 is positioned within the peripheral unit assemblies 660*a* and 660*b*.

As illustrated, the peripheral unit assemblies 660*a* and 660*b* are arranged in parallel rows along collapsibility axis 112 and separated from each other by an intermediary distance 664. Intermediary cell 668 may occupy at least a portion of space corresponding to intermediary distance 664. Each peripheral unit assembly 660 comprises a primary cell 604 and a secondary cell 608. The cells 604 and 608 may be made of any material suitable to operate as a rigid structure and provide sufficient mechanical strength based on the usage of collapsible assembly 100. In some embodiments, cells 604 and 608 may be made of metallic materials (e.g., steel, aluminum) or polymer materials (e.g., polyethylene terephthalate glycol (PETG), polyetherimide). In other embodiments, cells 604 and 608 may be made of other materials.

Even though in the illustrated embodiment of FIG. 6, each peripheral unit assembly is shown to have one primary cell 604 and one secondary cell 608, any number of primary and secondary cells 604 and 608 can be included based on the distance between the end plates 124*a* and 124*b* and the amount of coverage desired. In instances where multiple primary and secondary cells 604 and 608 are included in each peripheral unit assembly, the primary and secondary cells 604, 608 are arranged alternatively (i.e. a primary cell followed by a secondary cell, which is followed by a primary cell and then a secondary cell, etc.) such that the complementary hinge elements of the cells 604, 608 can be coupled to each other to form a hinge connection. FIGS. 10A-11F as discussed below illustrate such embodiments.

Referring now to FIGS. 7A to 7D, shown therein are a perspective view, a front view, a side view, and a top view respectively of primary cell 604. Primary cell 604 is analogous to primary cell 204 of FIG. 3A, and comprises a primary cell surface 612, a first primary cell hinge element 616 and a second primary cell hinge element 620.

In the illustrated embodiment, primary cell surface 612 is hexagonal in shape. In some embodiments, primary cell surface 612 can be other shapes, for example, square or rectangle. Primary cell surface 612 can include a first primary cell edge 624 and an opposing primary cell edge 628 that are opposing edges of primary cell surface 612. First primary cell hinge element 616 can be coupled to primary cell surface 612 along first primary cell edge 624. Second primary cell hinge element 620 can be coupled to an opposite side 614 of primary cell surface 612 along opposing primary cell edge 628.

Primary cell 604 may have any cell thickness 684*a* suitable for the application or structure that collapsible assembly 100 may be used in. For example, thickness 684*a* may be the smallest thickness that can withstand the pressure difference between the two sides of the structure that collapsible assembly 100 is used for. In some embodiments, collapsible assembly 100 may be used to form a cylindrical structure as described herein below with reference to FIGS. 11A to 11F. Primary cell 604 may have a curvature thickness 680*a* that matches the curvature of the cylindrical structure. In some embodiments, while primary cell surface 612 may be curved, the first primary cell hinge element 616 and second primary cell hinge element 620 may be straight and not curved.

Referring now to FIGS. 8A to 8D, shown therein are a perspective view, a front view, a side view, and a top view respectively of secondary cell 608. Secondary cell 608 comprises a secondary cell surface 632, a first secondary cell hinge element 636, a second secondary cell hinge element 640, and two secondary cell connection elements 676*a* and 676*b*. Accordingly, secondary cell 608 is generally analogous to secondary cell 208 of FIG. 4A, with additionally including secondary cell connection elements 676*a, b*.

In the illustrated embodiment, secondary cell surface 632 is hexagonal in shape. In some embodiments, secondary cell surface 632 can be other shapes, for example, square or rectangle. Secondary cell surface 632 can include a first secondary cell edge 644 and an opposing secondary cell edge 648 that are opposing edges of secondary cell surface 632. First secondary cell hinge element 636 can be coupled to secondary cell surface 632 along first secondary cell edge 644. Second secondary cell hinge element 640 can be coupled to an opposite side 634 of secondary cell surface 632 along opposing secondary cell edge 648. The secondary cell connections elements 676 can be of any suitable design to couple with an end of coupling element 672 as described in further detail herein below with reference to FIGS. 14 and 15.

Secondary cell 608 may have any cell thickness 684*b* suitable for the application or structure that collapsible assembly 100 may be used in. For example, thickness 684*b* may be the smallest thickness that can withstand the pressure difference between the two sides of the structure that collapsible assembly 100 is used for. In some embodiments, collapsible assembly 100 may be used to form a cylindrical structure as described herein below with reference to FIGS. 11A to 11F. Secondary cell 608 may have a curvature thickness 680*b* that matches the curvature of the cylindrical structure. In some embodiments, while secondary cell surface 632 may be curved, the first secondary cell hinge element 636 and second secondary cell hinge element 640 may be straight and not curved.

Referring now to FIGS. 6 to 8D, in each peripheral unit assembly, the first secondary cell hinge element 636 is complementary to first primary cell hinge element 616. In the illustrated embodiment, first primary cell hinge element 616 includes four coupling elements and first secondary cell hinge element 636 includes five coupling elements. In other embodiments, different number of complementary coupling elements may be used. For example, first primary cell hinge element 616 may include three coupling elements and first secondary cell hinge element 636 may include four coupling elements. As another example, first primary cell hinge element 616 may include six coupling elements and first secondary cell hinge element 636 may include seven coupling elements. In a similar manner, second secondary cell hinge element 640 can be complementary to second primary cell hinge element 620.

As shown, the first secondary cell hinge element 636 is coupled to first primary cell hinge element 616 to provide a hinge connection 688*a,b*. During change of collapsible assembly 100 between the extended configuration and the collapsed configuration, hinge connections 688*a,b* can move in a corresponding direction causing movement of the corresponding primary cell surfaces 612 and secondary cell surfaces 632 from a first axis generally parallel to the collapsibility axis to a second axis generally perpendicular to the collapsibility axis, as described in further detail herein below with reference to FIGS. 10A to 10C.

In each peripheral unit assembly, the secondary cell connection elements 676*a,b* is coupled to secondary cell surface 632 at a location offset from and between first secondary cell hinge element 636 and second secondary cell hinge element 640. In some cases, the secondary cell connection elements 676*a,b* may be equidistant from the first secondary cell hinge element 636 and second secondary cell hinge element 640. In some other cases, the secondary cell connection element 676*a,b* may be closer to one of the first secondary cell hinge element 636 and second secondary cell hinge element 640.

For the example shown in FIG. 6, the secondary cell connection elements are offset from hinge connections 688 (formed by coupling of secondary cell hinge elements 636, 640 with corresponding primary cell hinge elements 616, 620) by an offset distance 692 along collapsibility axis 112.

Referring now to FIGS. 9A to 9D, shown therein are a perspective view, a front view, a side view, and a top view respectively of intermediary cell 668. Intermediary cell 668 comprises an intermediary cell surface 696 and two intermediary cell connection elements 698*a* and 698*b*.

In the illustrated embodiment, intermediary cell surface 696 is hexagonal in shape. In some embodiments, intermediary cell surface 696 can be other shapes, for example, square or rectangle. Intermediary cell surface 696 can include a first intermediary cell edge 904 and an opposing intermediary cell edge 908 that are opposing edges of intermediary cell surface 696.

As shown in FIG. 6, in an extended configuration of collapsible assembly 100, intermediary cell surface 696 may be provided within peripheral unit assemblies 660 such that intermediary cell surface 696 extends between at least a portion of side edges of cells 604*a*, 604*b*, 608*a*, and 608*b*. Intermediary cell surface 696 may be offset from surfaces 612*a*, 612*b*, 632*a* and 632*b* in a direction normal to the surfaces. The offset between intermediary cell surface 696 and surfaces 612*a*, 612*b*, 632*a* and 632*b* can be of any suitable magnitude that enables folding of collapsible assembly as described in greater detail herein with reference to FIGS. 10A to 10C.

When collapsible assembly 100 changes from extended configuration 104 to collapsed configuration 108 the area between adjacent peripheral unit assemblies 660 (corresponding to intermediary distance 664) reduces and may vanish in some embodiments (depending on the specific geometry of collapsible assembly 100). Accordingly, any intermediary cell would be required to have a variable geometry resulting in increased design complexity of the collapsible assembly. In the described embodiments, the offset of intermediary cell surface 696 from surfaces 612*a*, 612*b*, 632*a* and 632*b* enables the use of a rigid intermediary cell that is not required to have a variable geometry. When collapsible assembly 100 changes from extended configuration 104 to collapsed configuration 108, the intermediary cells 668 can fold in a plane offset from the folding plane of primary cells 604 and secondary cells 608. This may enable a double-accordion style movement of collapsible assembly 100 between extended configuration 104 and collapsed configuration 108.

Referring back to FIGS. 9A to 9D, in some embodiments, intermediary cell 668 may also include an intermediary cell hinge element 912. Intermediary cell hinge element 912 may be coupled to intermediary cell surface 696 along second intermediary cell edge 908. In other embodiments, intermediary cell 668 may not include intermediary cell hinge element 912.

Intermediary cell connection elements 698*a* and 698*b* may be coupled to intermediary cell surface 696 along first intermediary cell edge 904. The intermediary cell connection elements 698*a* and 698*b* can be of any suitable design for coupling with an end of coupling element 672 as described in further detail herein below with reference to FIGS. 14 and 15. In extended configuration 104 of collapsible assembly 100, each intermediary cell connection element 698 can be proximate to a secondary cell connection element 676 of a corresponding secondary cell 608. For example, as shown, intermediary cell connection element 698*a* is proximate to secondary cell connection element 676*a* of the first secondary cell 608*a*; and coupling element 672*a* is connected between intermediary cell connection element 698*a* and secondary cell connection element 676*a*. Similarly, intermediary cell connection element 698*b* is proximate to secondary cell connection element 676*b* of the second secondary cell 608*b*; and coupling element 672*b* is connected between intermediary cell connection element 698*b* and secondary cell connection element 676*b*.

Referring now to FIGS. 9E to 9H, shown therein are a perspective view, a front view, a side view, and a top view respectively of another embodiment of an intermediary cell 670 that may be included in peripheral unit assembly 660. Intermediary cell 670 may be similar to intermediary cell 668 in all respects except the intermediary cell connection elements 916 of intermediary cell 670 may be differently designed compared with intermediary cell connection elements 698 of intermediary cell 668. Intermediary cell connection elements 916 may be suitable for coupling with a coupling element differently designed from coupling element 672 as described in further detail herein below with reference to FIGS. 14 and 15.

Referring now to FIGS. 6 to 9H, coupling element 672 can have any design suitable for providing a connection between intermediary cell connection element 698 and secondary cell connection element 676. Two examples of suitable designs for coupling element 672 are described in further detail herein below with reference to FIGS. 14 and 15.

Figure 10A:
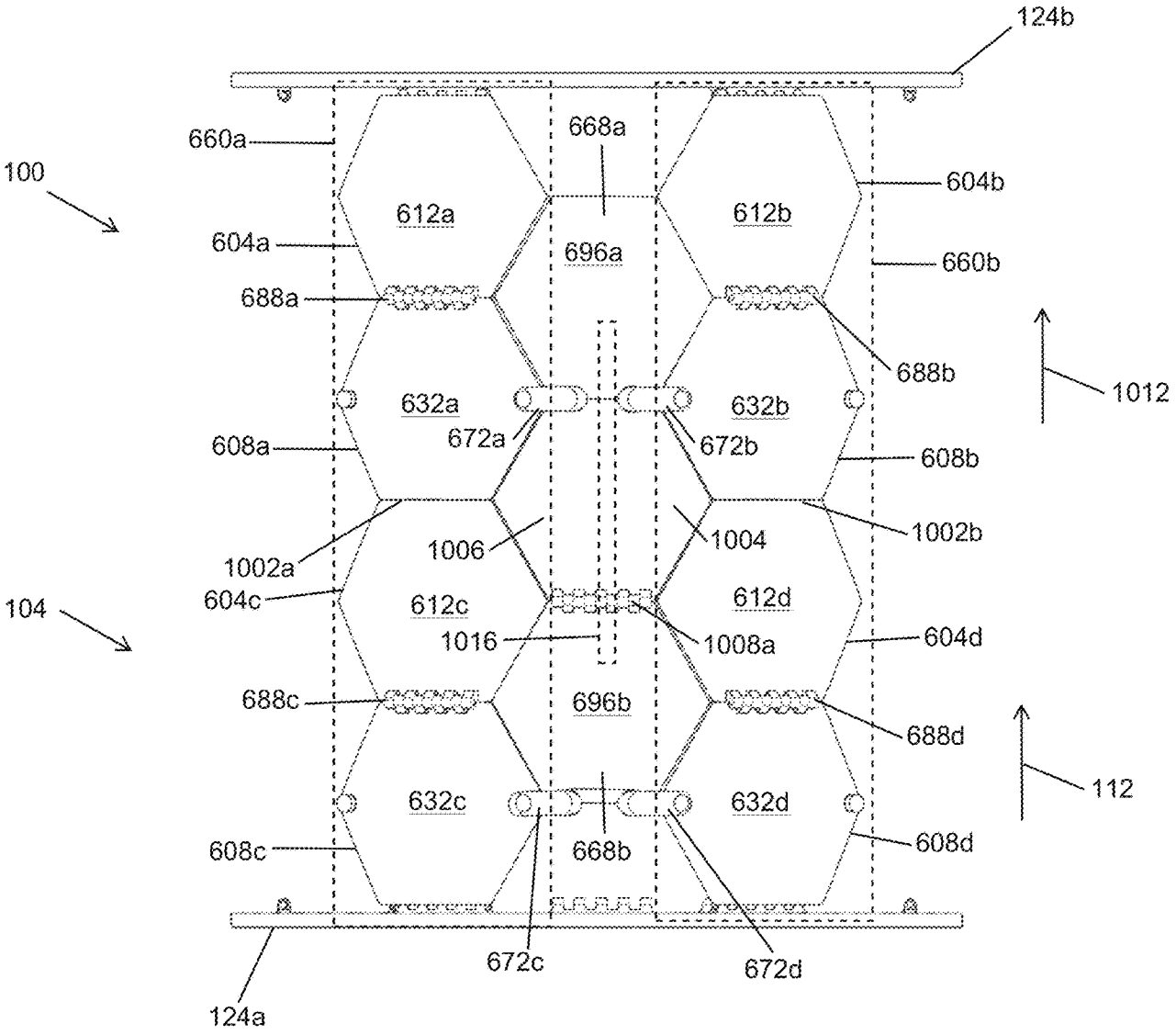
FIG. 10A is a top view of an example collapsible assembly in an extended configuration, in accordance with an embodiment.
Figure 10B:
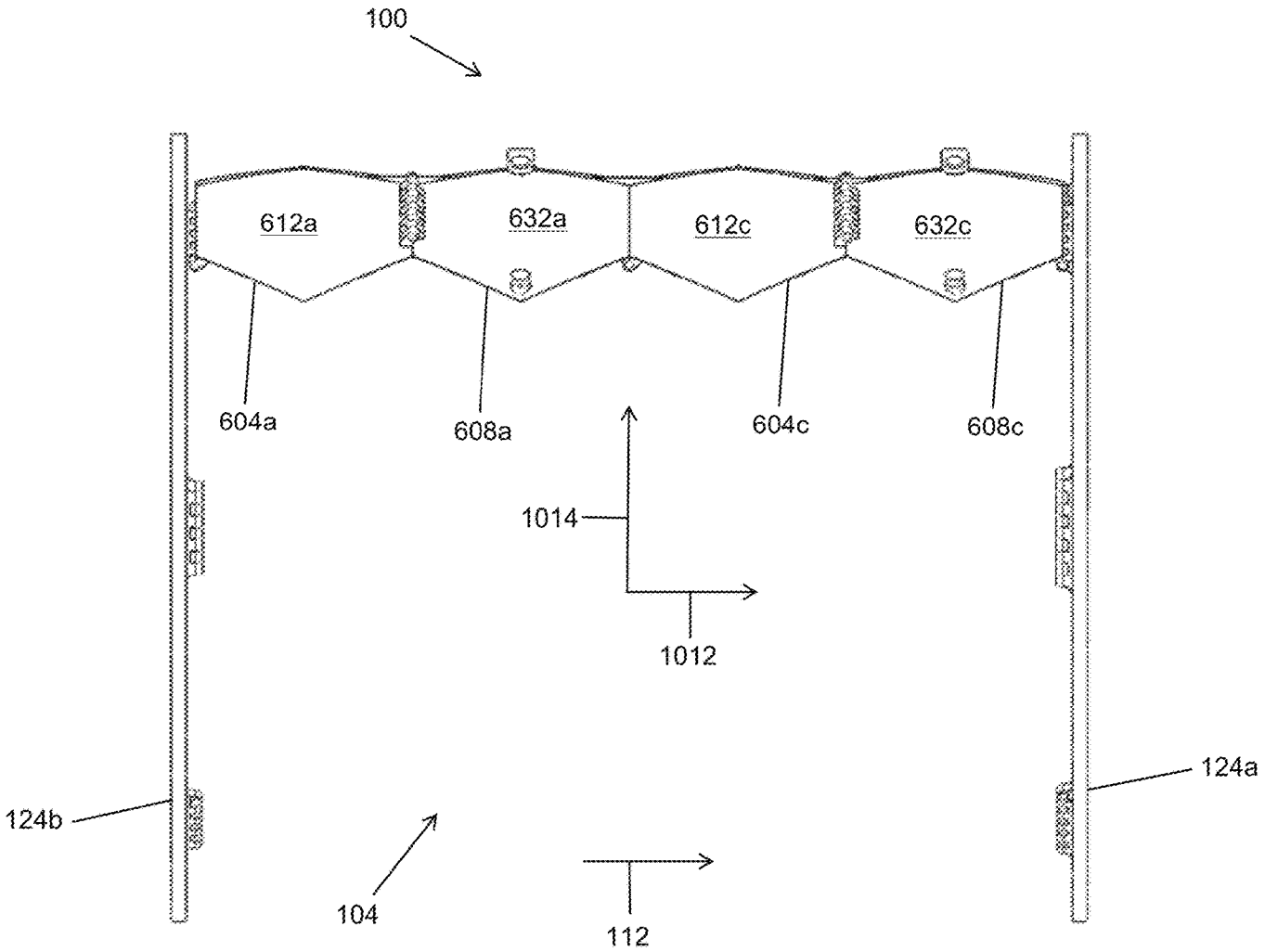
FIG. 10B is a side view of the example collapsible assembly of FIG. 10A.
Figure 10C:
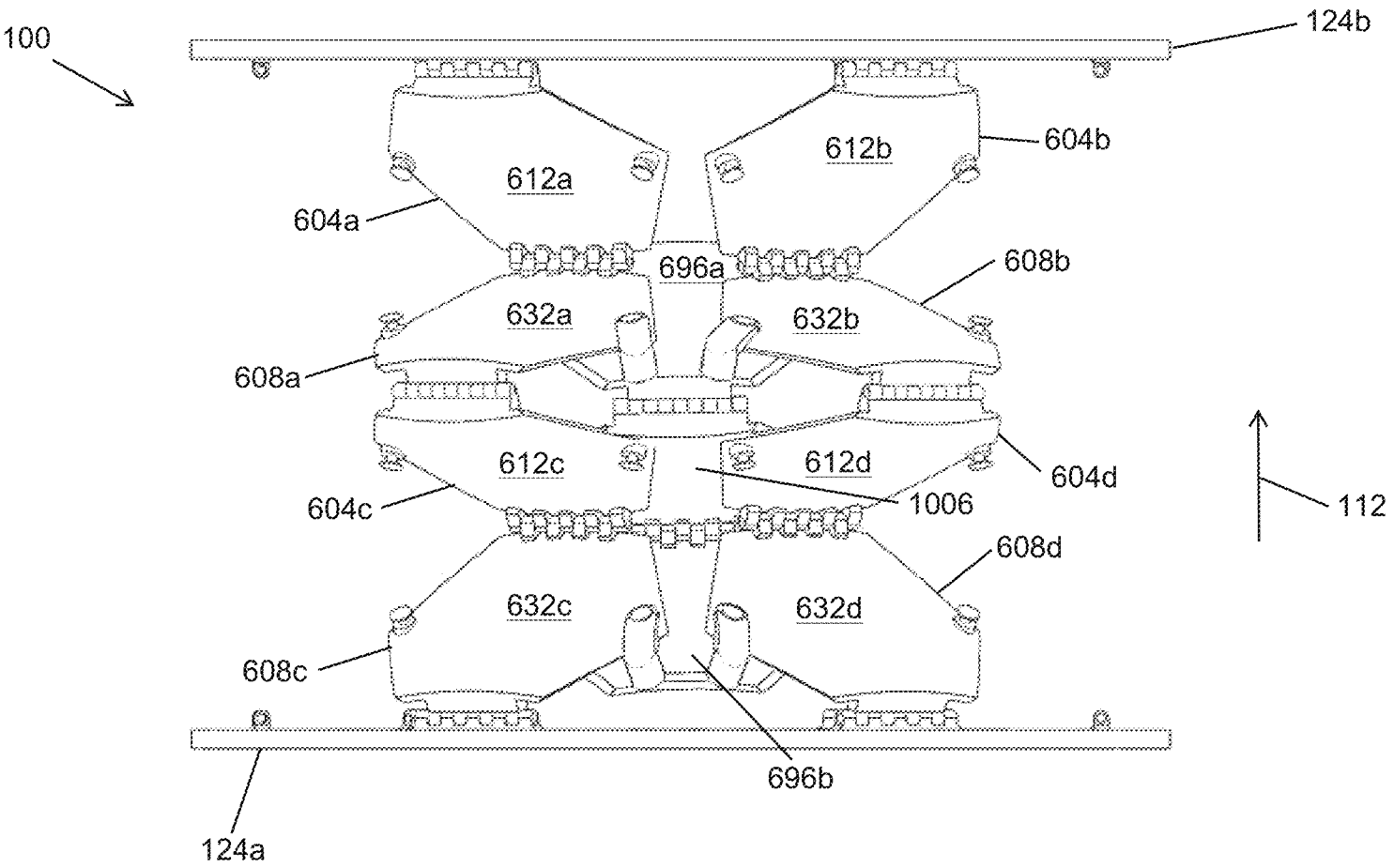
FIG. 10C is a top view of the example collapsible assembly of FIG. 10A in a partially collapsed configuration.
Figure 10D:
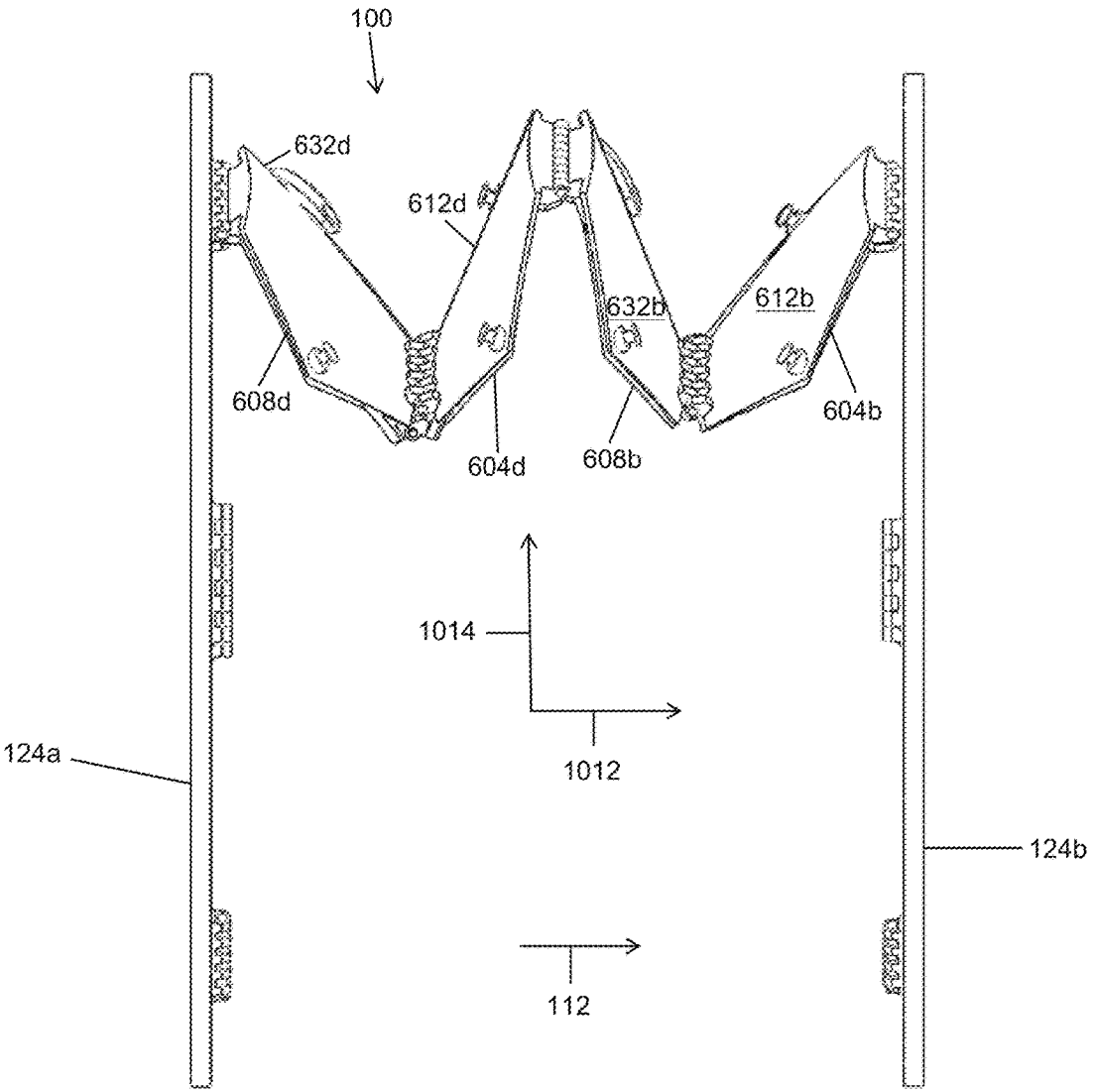
FIG. 10D is a side view of the example collapsible assembly of FIG. 10C.
Figure 10E:
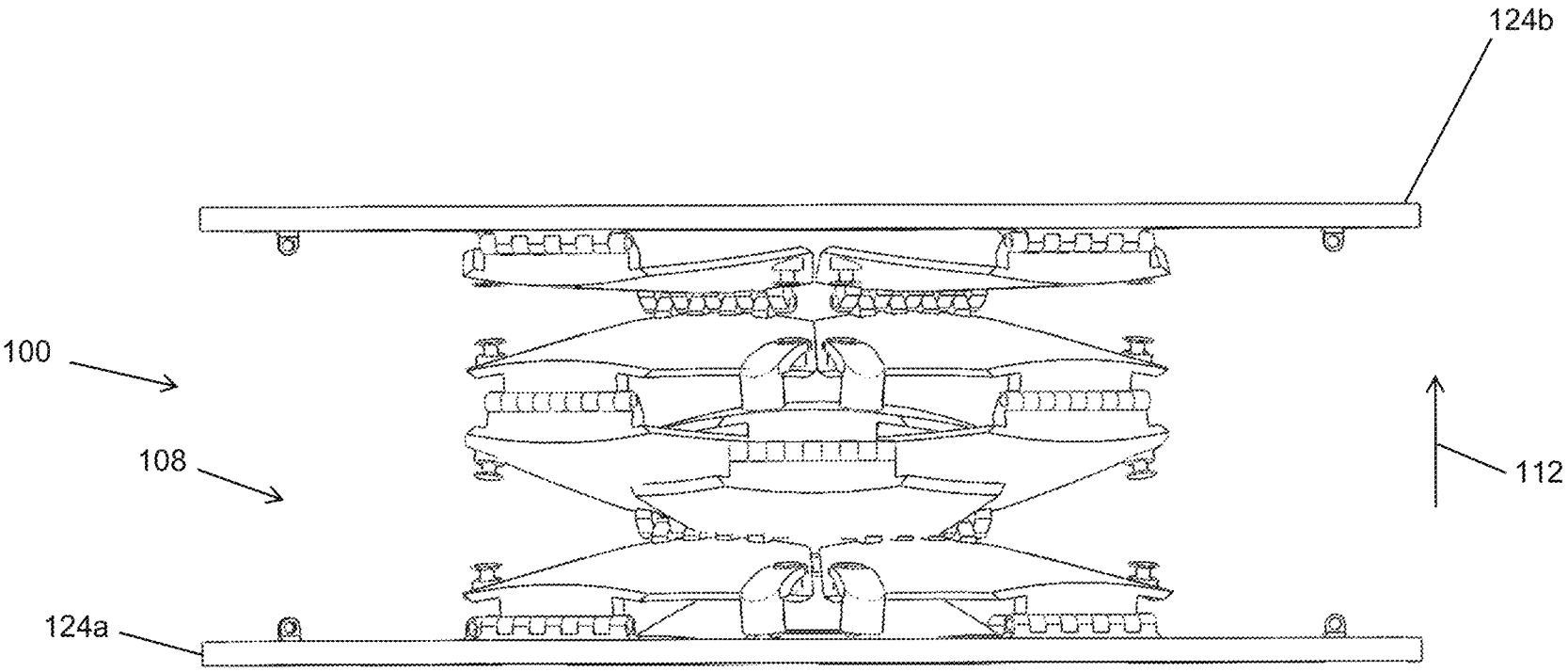
FIG. 10E is a top view of the example collapsible assembly of FIG. 10A in a fully collapsed configuration.
Figure 10F:
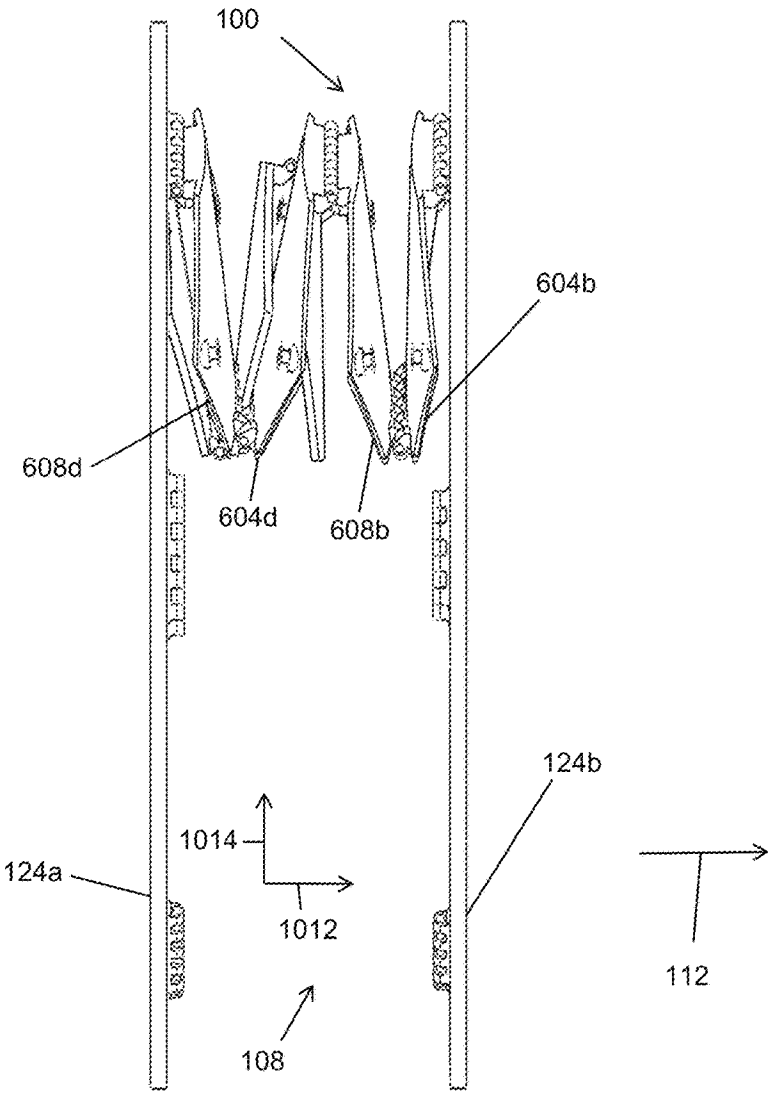
FIG. 10F is a side view of the example collapsible assembly of FIG. 10E.

Referring now to FIGS. 10A to 10F, shown therein are different views of collapsible assembly 100 changing from an extended configuration to a partially collapsed configuration and further to a fully collapsed configuration. FIGS. 10A and 10B show a top view and a side view respectively of collapsible assembly 100 in extended configuration 104. FIGS. 10C and 10D show a top view and a side view respectively of collapsible assembly 100 in a partially collapsed configuration. FIGS. 10E and 10F show a top view and a side view respectively of collapsible assembly 100 in the fully collapsed configuration 108.

As shown in FIG. 10A, collapsible assembly 100 comprises two symmetrical peripheral unit assemblies 660*a* and 660*b*, two intermediary cells 668*a* and 668*b*, and four coupling elements 672*a*-672*d*. Peripheral unit assembly 660*a* includes primary cells 604*a* and 604*c*, and secondary cells 608*a* and 608*c*. Peripheral unit assembly 660*b* includes primary cells 604*b* and 604*d*, and secondary cells 608*b* and 608*d*.

As described herein above with reference to FIG. 6, in each peripheral assembly unit, the first secondary cell hinge elements of secondary cells 608 are coupled to the first primary cell hinge elements of adjacent primary cells 604 to provide hinge connections 688*a,b,c,d*. In a similar manner, the second secondary cell hinge elements of secondary cells 608 are coupled to adjacent second primary cell hinge elements of primary cells 604 to provide hinge connections 1002*a* and 1002*b*.

As illustrated, coupling element 672*a* is connected between the intermediary cell connection element of intermediary cell 668*a* and the secondary cell connection element of secondary cell 608*a*. Coupling element 672*b* is connected between the intermediary cell connection element of intermediary cell 668*a* and the secondary cell connection element of secondary cell 608*b*. Coupling element 672*c* is connected between the intermediary cell connection element of intermediary cell 668*b* and the secondary cell connection element of secondary cell 608*c*. Coupling element 672*d* is connected between the intermediary cell connection element of intermediary cell 668*b* and the secondary cell connection element of secondary cell 608*d*.

As shown, the assembly 100 has adjacent hinge connections forming on opposite side of the primary and the secondary cell surfaces, facilitating the movement of the hinge connections in opposite directions during collapsibility. For example, in peripheral unit assembly 660*a*, the hinge connection 688*a* is followed by 1002*a*, which is followed by 688*c*, where hinge connections 688*a* and 688*c* are formed on top of the corresponding primary and secondary surfaces and hinge connection 1002*a* is formed on the bottom of the corresponding primary and secondary surfaces (e.g. surfaces 632*a* and 612*c*). Similarly, in peripheral unit assembly 660*b*, the hinge connection 688*b* is followed by 1002*b*, which is followed by 688*b*, where hinge connections 688*b* and 688*d* are formed on top of the corresponding primary and secondary surfaces and hinge connection 1002*b* is formed on the bottom of the corresponding primary and secondary surfaces (e.g. surfaces 632*b* and 612*d*). This configuration of adjacent hinge elements being on opposite side of the cell surfaces allows the hinge element to move in opposite directions as collapsible assembly 100 changes from extended configuration 104 to collapsed configuration 108. This causes movement of primary cell surfaces 612*a,b,c,d* and secondary cell surfaces 632*a,b,c,d* from an axis 1012 (that is generally parallel to collapsibility axis 112) to an axis 1014 (that is generally perpendicular to collapsibility axis 112) to reduce the surface area of collapsible assembly 100.

The collapsing movement of primary cell surfaces 612*a,b,c,d* and secondary cell surfaces 632*a,b,c,d* causes a reduction in the intermediary distance 664 resulting in a reduction in the intermediary space between the primary and the secondary cells. However, the rigidity of coupling elements 672*a*-672*d* may prevent compression of coupling elements 672*a*-672*d* and prevent the collapsing movement of the primary cell surfaces 612*a*-612*d* and the secondary cell surfaces 632*a*-632*d* until the intermediary cells 668*a,b* are displaced along axis 1012 and axis 1014. The change of collapsible assembly 100 from the extended configuration to the collapsed configuration may force pairs of coupling elements to move in opposing directions causing movement of the corresponding intermediary cell surface from axis 1012 to axis 1014 and enabling the proximate secondary cells to fold above the intermediary cell. For example, the change of collapsible assembly 100 from the extended configuration to the collapsed configuration may force coupling elements 672*a* and 672*b* to move in opposing directions causing movement of the corresponding intermediary cell surface 696*a* from first axis 1012 to second axis 1014 and enabling the proximate secondary cells 608*a* and 608*b* to fold above intermediary cell 668*a*.

In some embodiments, axis 1012 can be within 0° to 5° of collapsibility axis 112. In other embodiments, axis 1012 can be offset by a larger angle with respect to collapsibility axis 112. In some embodiments, axis 1014 can be at an angle of 85° to 90° with respect to collapsibility axis 112. In other embodiments, axis 1014 can be offset by an angle smaller than 85° with respect to collapsibility axis 112. Embodiments where axis 1014 is generally at an angle of 90° (±0.5°) with respect to collapsibility axis 112 may provide higher collapsibility efficiencies by providing larger reductions in collapsed length and/or surface area. When axis 1014 is generally at an angle of 90° (±0.5°) with respect to collapsibility axis 112, the length of collapsible assembly 100 in collapsed configuration 108 can correspond to a sum of the thicknesses of the cell surfaces. In some embodiments, the above-described movement of hinge connections 688*a*-688*d* and 1002*a*-1002*b* may provide an accordion style movement of collapsible assembly 100.

In some embodiments, collapsible assembly 100 may include an additional intermediary cell 1004. Additional intermediary cell 1004 may be connected along collapsibility axis 112 between intermediary cells 668*a* and 668*b*. In some embodiments, other additional intermediary cells may be connected between intermediary cells 668 of neighboring collapsible assemblies 100.

Additional intermediary cell 1004 may be identical to intermediary cell 668. In some embodiments, additional intermediary cell 1004 may be identical to intermediary cell 668 except additional intermediary cell 1004 may not include intermediary cell connection elements 698*a* and 698*b*. As shown in FIG. 10A, the intermediary cell hinge element of additional intermediary cell 1004 may be coupled with the intermediary cell hinge element of adjacent intermediary cell 668*b* to provide hinge connection 1008*a*. In some embodiments, additional intermediary cell 1004 may not be coupled to intermediary cell 668*a*. In other embodiments, additional intermediary cell 1004 may be coupled to intermediary cell 668*a*. For example, additional intermediary cell 1004 may include an additional intermediary cell hinge element along an opposing intermediary cell edge to couple with a complementary intermediary cell hinge element of intermediary cell 668*a*.

In some embodiments, collapsible assembly 100 may include a joint lock 1016 (FIG. 10A) corresponding to each intermediary cell hinge connection 1008. For example, FIG. 10A shows joint lock 1016 corresponding to intermediary cell hinge connection 1008*a*. Joint lock 1016 can be of any suitable size and design that prevents relative movement between the intermediary cell surfaces coupled at the corresponding intermediary cell hinge connection. For example, joint lock 1016 may prevent relative movement between the intermediary cell surfaces 1006 and 696*b*. Joint lock 1016 may provide locking operation for movement between multiple pairs of intermediary surfaces. For example, in embodiments where additional intermediary cell 1004 is coupled to intermediary cell 668*a*, joint lock 1016 may be extended to also provide locking operation for movement between the intermediary cell surfaces 1006 and 696*a*.

The intermediary cell hinge connections 1008 can be misaligned along collapsibility axis 112 with respect to hinge connections 688. Accordingly, the coupling between intermediary cells and corresponding proximate secondary cells can prevent relative movement of the secondary cell surfaces 632 with respect to the primary cell surfaces 612.

This can enable locking operation of the entire collapsible assembly 100 using a single joint lock 1016 compared with the six joint locks used for the embodiment of collapsible assembly 100 shown in FIGS. 5A-5G.

In some embodiments, joint lock 1016 can include an electromechanical assembly with a mechanical locking element that is controlled by an electrical mechanism (e.g., a motor). Joint lock 1016 may enable collapsible assembly 100 to remain in extended configuration in the presence of a collapsing force. For an example extraterrestrial habitat structure using collapsible assembly 100 in extended configuration, collapsible assembly 100 may be able to withstand gravitational and atmospheric forces exerted in space or at a surface of another planet (e.g. Martian surface) and remain in extended configuration using joint lock 1016.

Figure 10G:
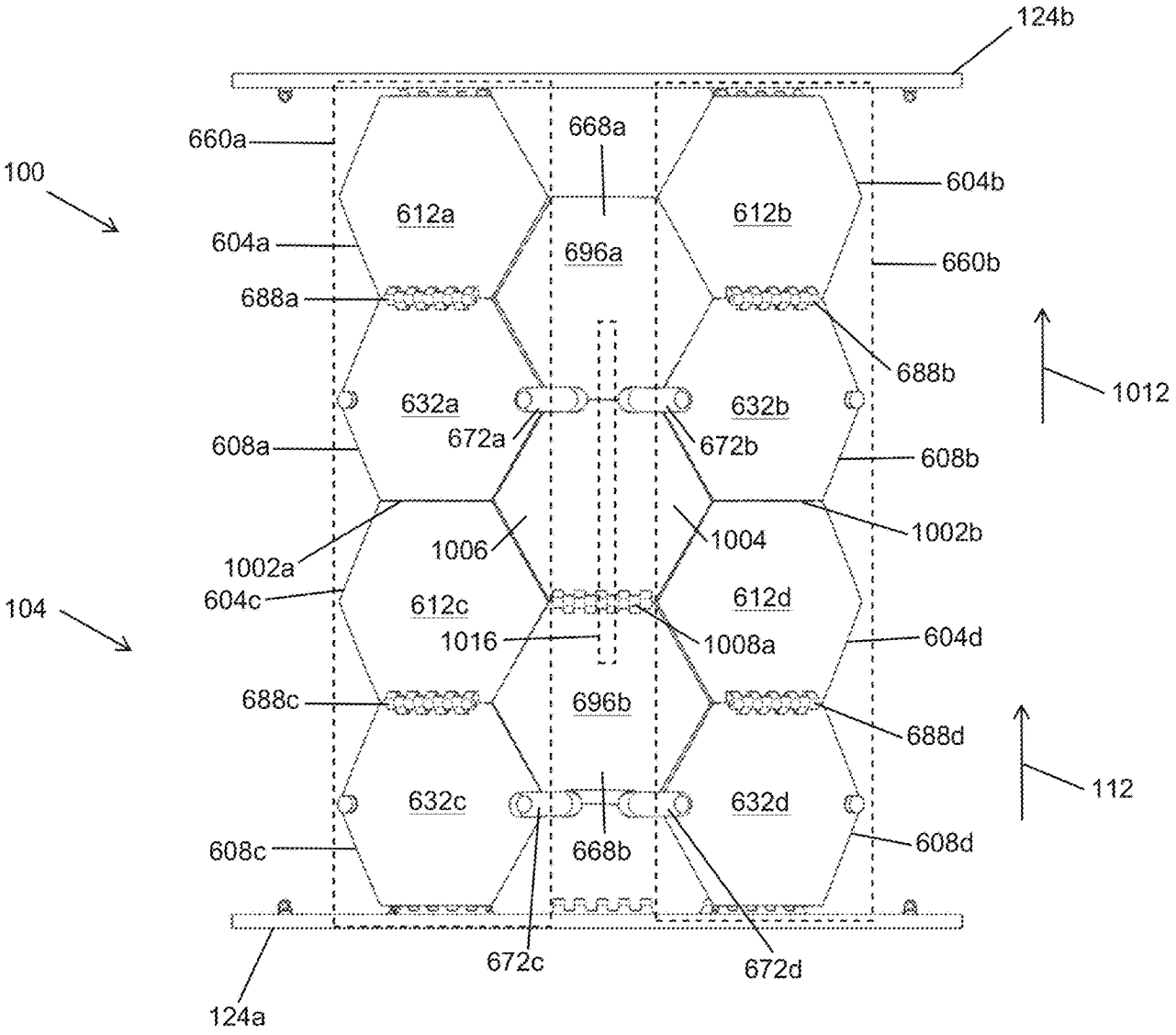
FIG. 10G is a perspective view of another example collapsible assembly in an extended configuration, in accordance with an embodiment.

Reference is next made to FIG. 10G, which illustrates a top view of a collapsible assembly 100' in extended configuration 104. Collapsible assembly 100' is analogous to collapsible assembly 100 of FIG. 10A, with the exception that the primary cells 612*a*-612*d* also contain connection elements. In this embodiment, in order to minimize the total number of interchangeable, detachable components, both the primary 612*a*-612*d* and the secondary 632*a*-632*d* cells are shown to include connection elements. The connections elements of the primary cells 612*a*-612*d* in the illustrated embodiment are not required for the collapsibility operation.

Figure 11A:
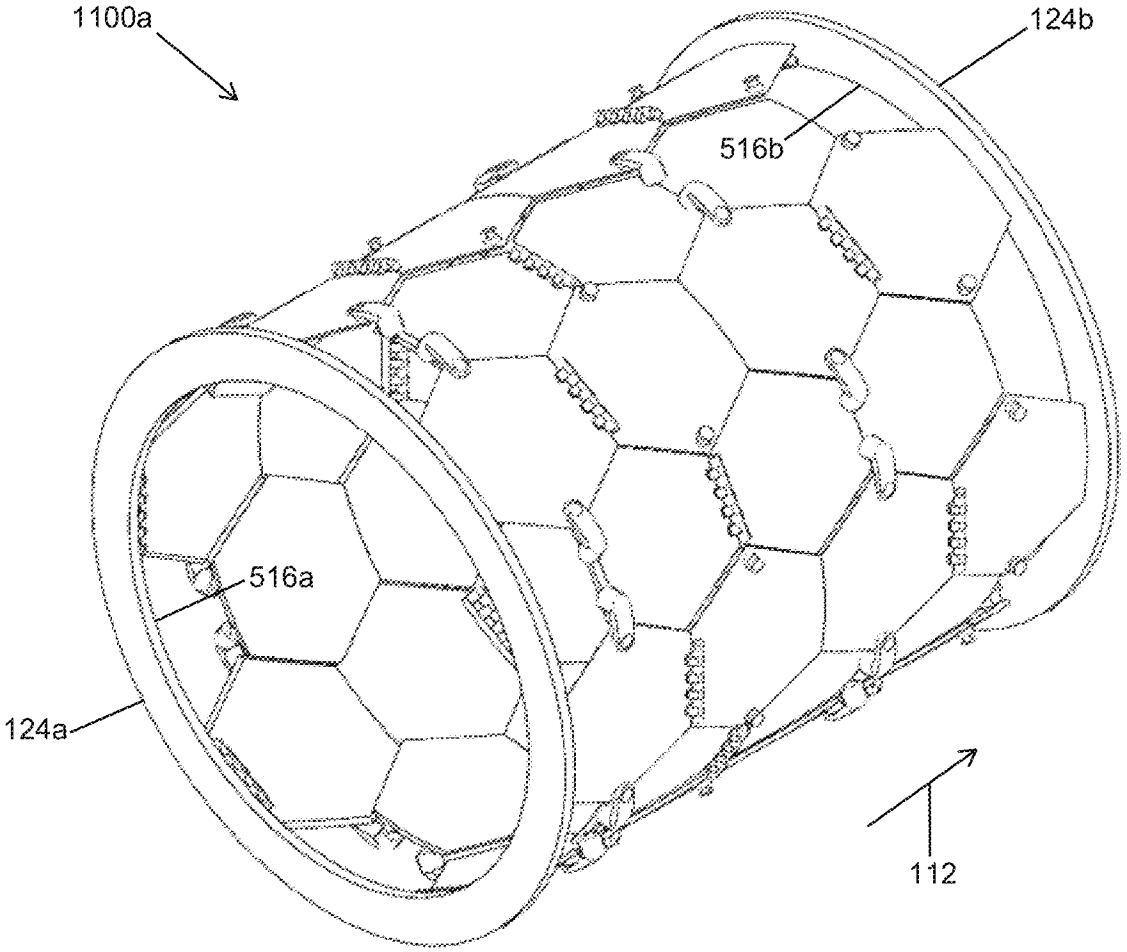
FIG. 11A is a perspective view of an example cylindrical structure comprising multiple instances of the example collapsible assembly of FIG. 10A.
Figure 11B:
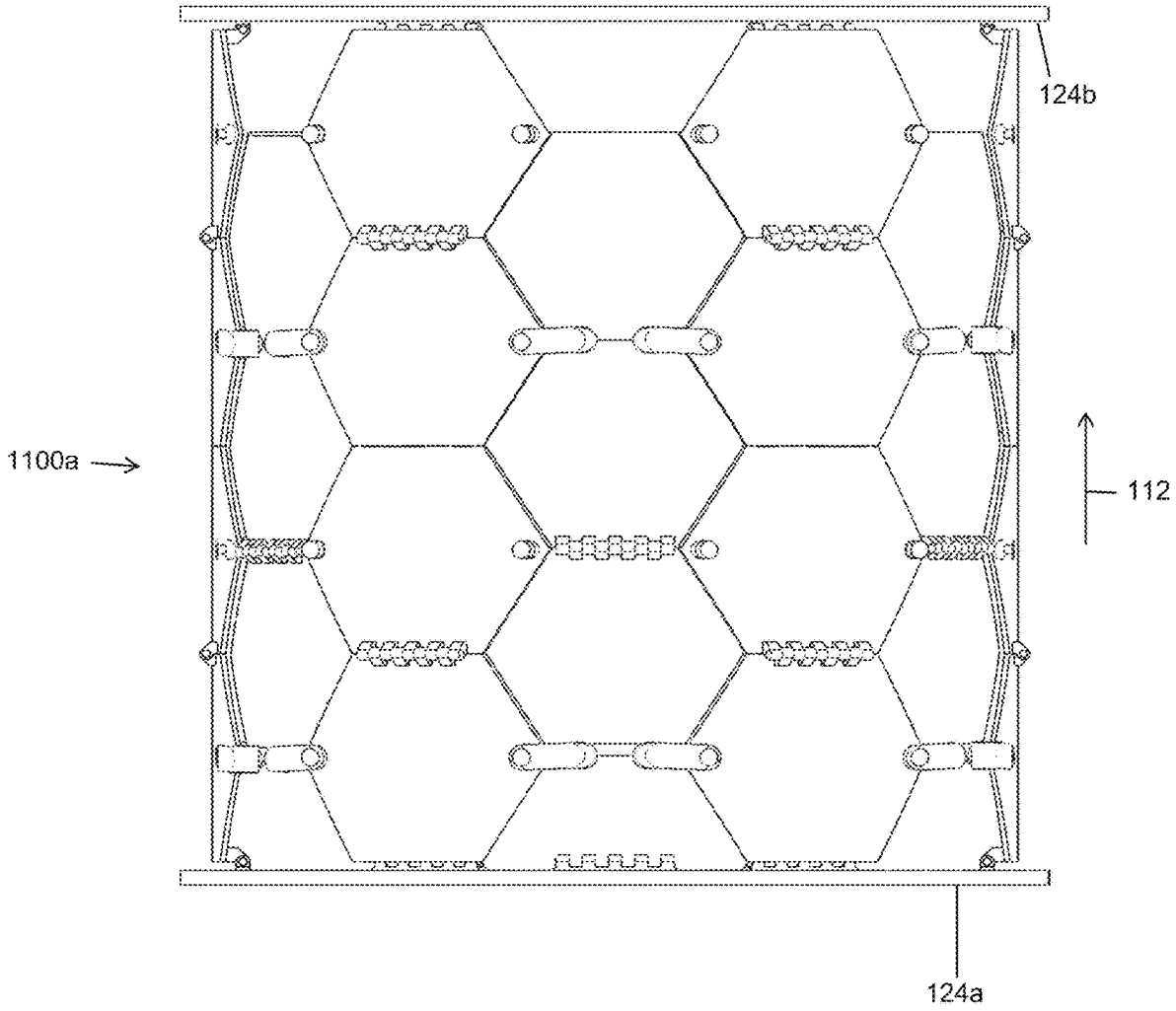
FIG. 11B is a top view of the example cylindrical structure of FIG. 11A.
Figure 11C:
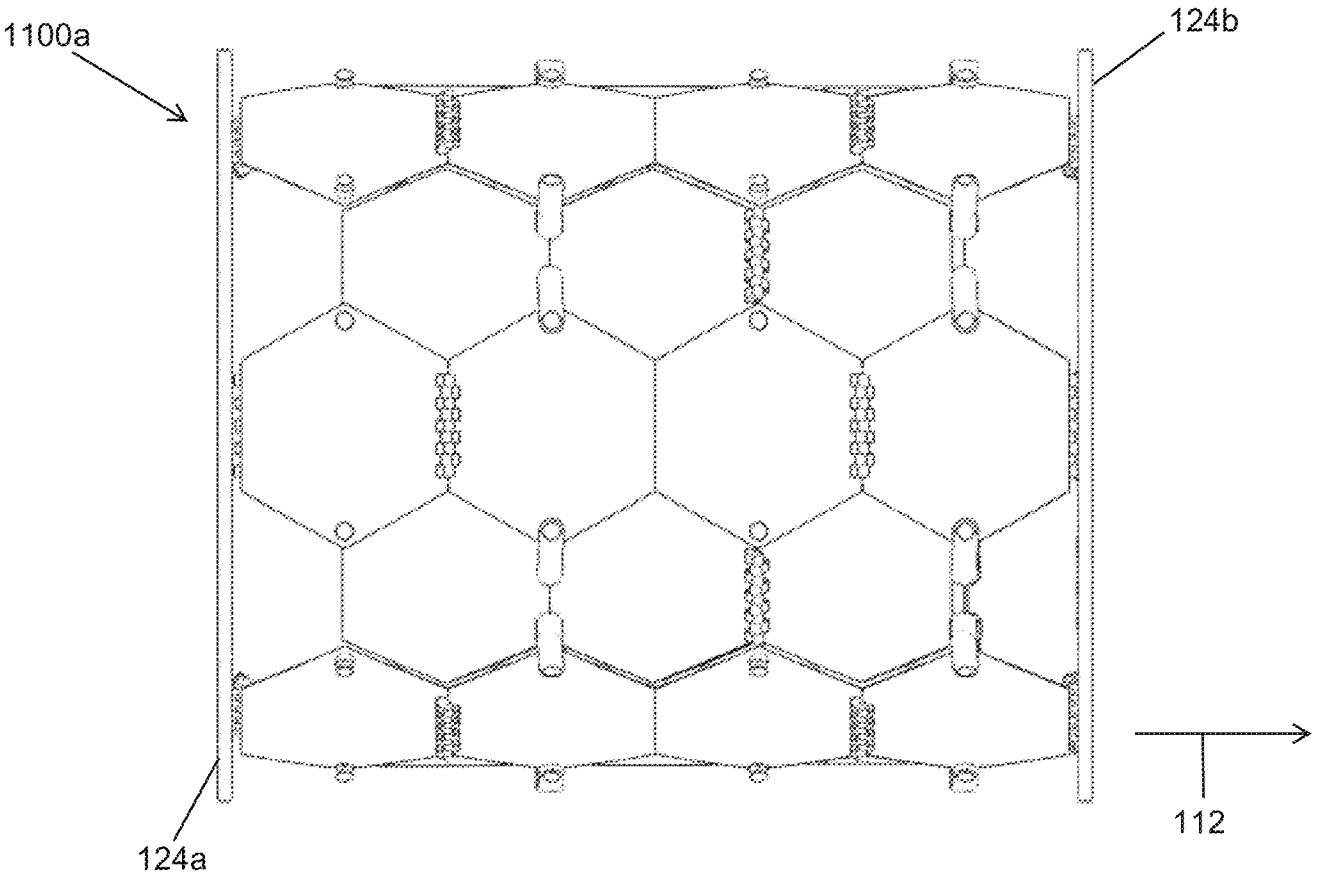
FIG. 11C is a side view of the example cylindrical structure of FIG. 11A.
Figure 11D:
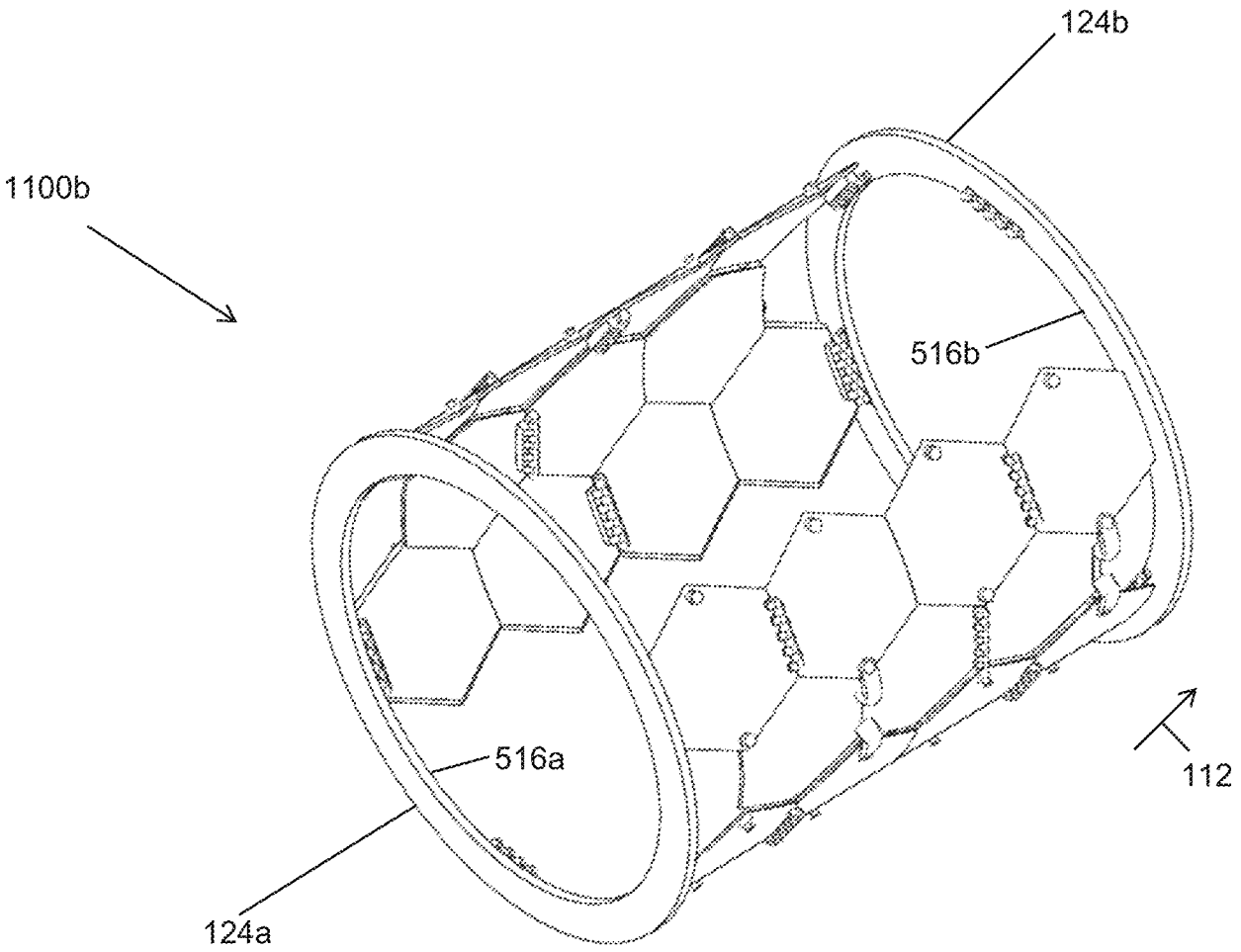
FIG. 11D is a perspective view of an example cylindrical structure comprising multiple instances of the example collapsible assembly of FIG. 10A.
Figure 11E:
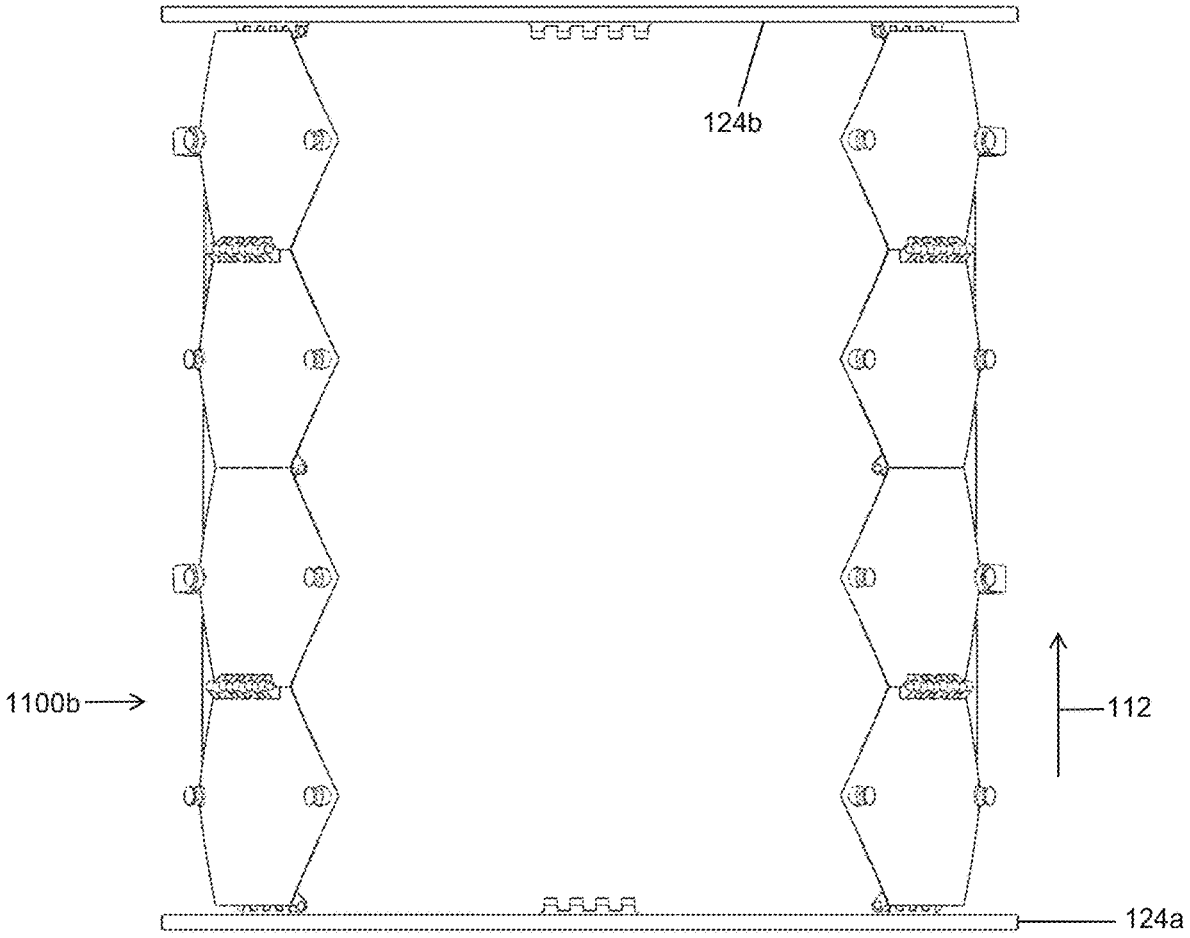
FIG. 11E is a top view of the example cylindrical structure of FIG. 11D.
Figure 11F:
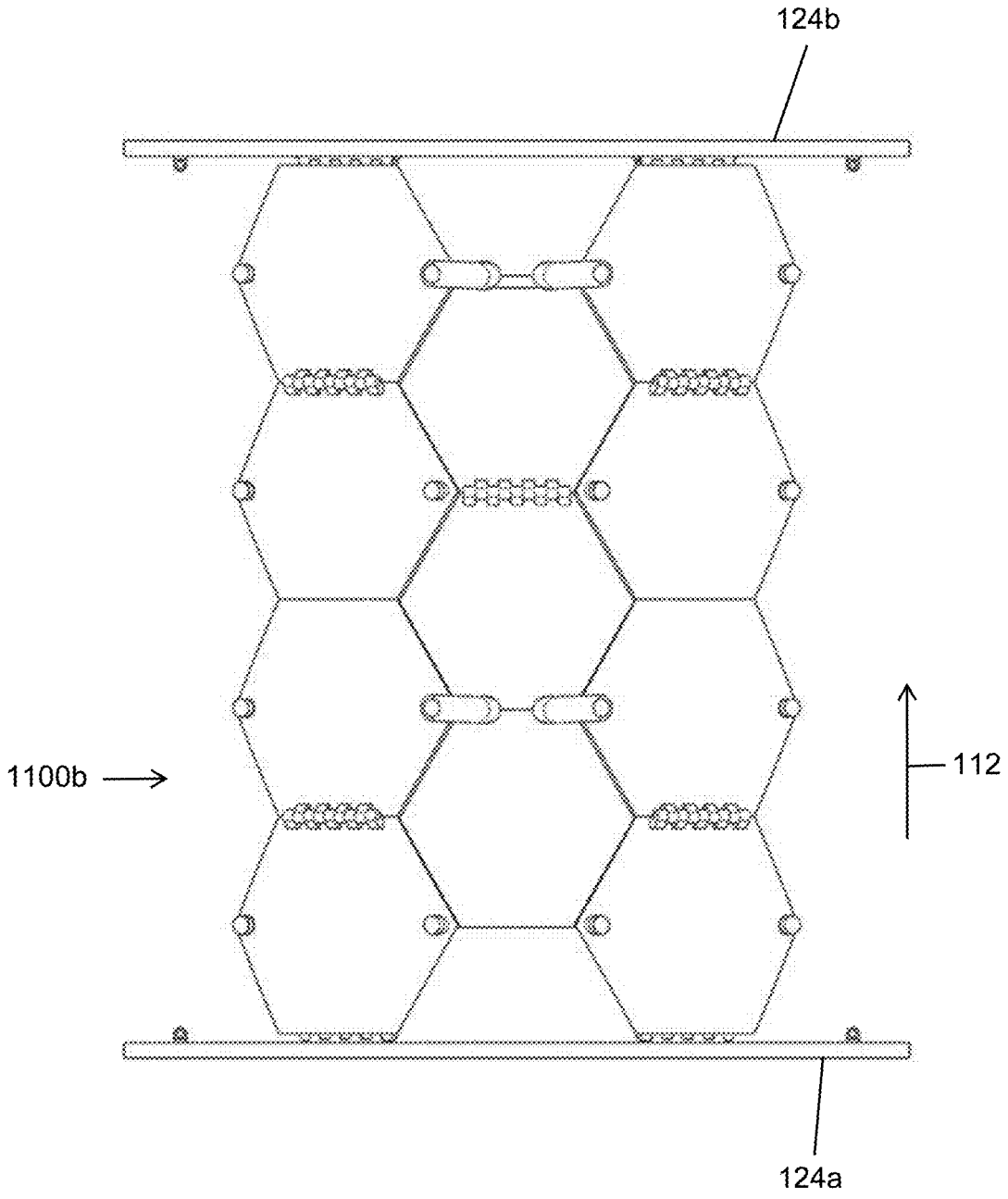
FIG. 11F is a side view of the example cylindrical structure of FIG. 11D.

Referring now to FIGS. 11A to 11F, shown therein is cylindrical structure 1100 comprising multiple instances of the collapsible assembly 100 of FIG. 10. FIGS. 11A to 11C show a perspective view, a top view and a side view respectively of full cylindrical structure 1100*a*. FIGS. 11D to 11F show a perspective view, a top view and a side view respectively of a partial cylindrical structure 1100*b*.

The multiple instances may be arranged in multiple parallel rows (parallel to collapsibility axis 112) around an inner circumference 516 of end plates 124 and to form a cylindrical structure 1100. Cylindrical structure 1100 may include multiple parallel and alternating rows of intermediary cells and primary/secondary cells. Referring back to FIGS. 7 to 9, primary cell surfaces 612, secondary cell surfaces 632 and intermediary cell surfaces 696 may be curved to match the curvature of the cylindrical structure. In some embodiments, while cell surfaces 612, 632 and 696 are curved, the hinge elements 616, 620, 636, 640, 912 and 914 may be straight and not curved.

In some embodiments, cylindrical structure 1100 may be used as a cylindrical endoskeleton. An outer layer, e.g., a fabric layer may be attached to the cylindrical endoskeleton. Full cylindrical structure 1100*a* may provide greater mechanical strength and support as a cylindrical endoskeleton compared with partial cylindrical structure 1100*b*. However, partial cylindrical structure 1100*b* may provide lower complexity and cost compared with full cylindrical structure 1100*a*.

In some embodiments, primary cell 204, secondary cell 208, primary cell 604, secondary cell 608, intermediary cell 668, intermediary cell 670, and/or additional intermediary cell 1004 may comprise detachable components. Some of the detachable components may be interchangeable among the different types of cells. This may enable ease of repair and/or replacement when only a component of a cell develops a problem. Collapsible cell assemblies may often be used in applications where transportation and/or storage space is limited. The detachability of components may enable reduced number of components that need to be stocked for repair and/or replacement of the cells.

Figure 11G:
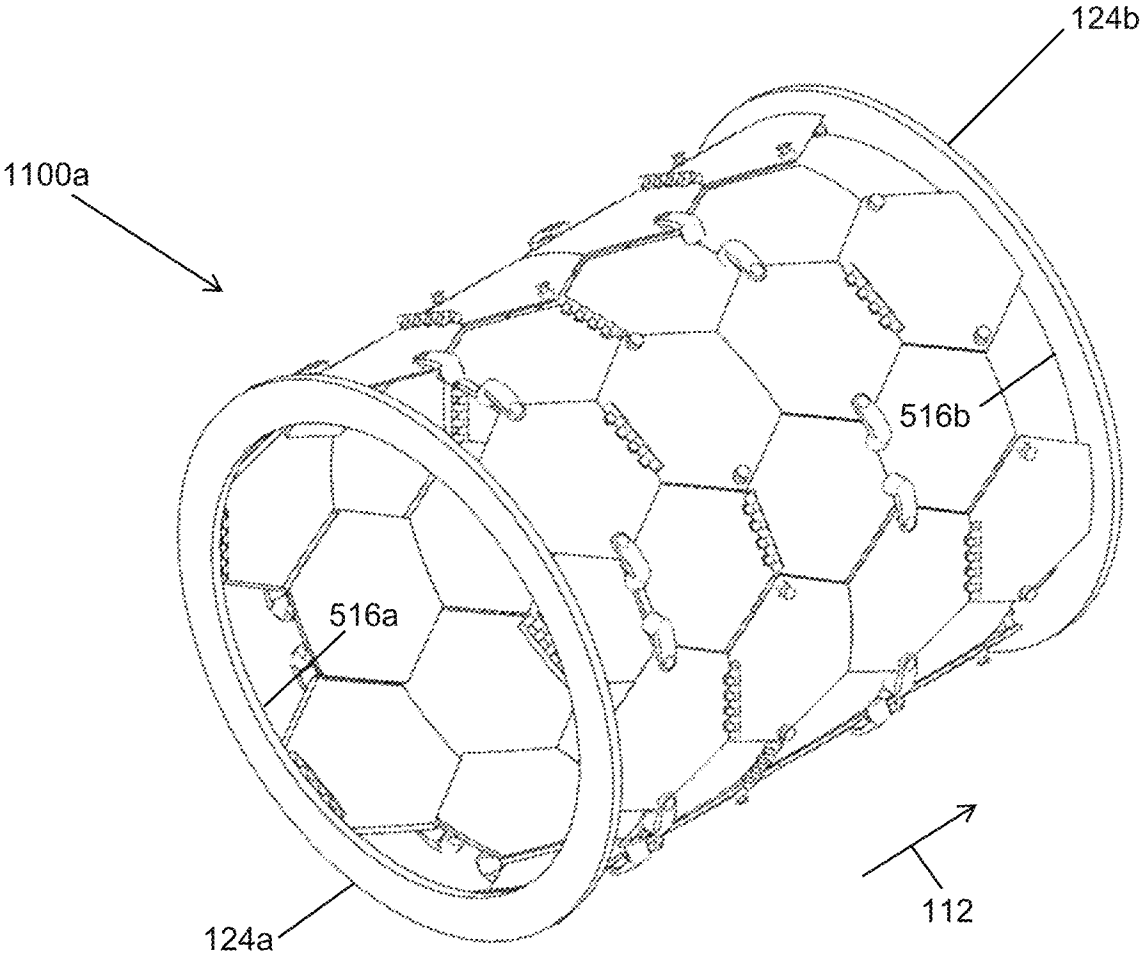
FIG. 11G is a perspective view of another example cylindrical structure comprising multiple instances of the example collapsible assembly of FIG. 10A.

Reference is next made to FIG. 11G, which illustrates a cylindrical structure 1100*a*' comprising multiple instances of the collapsible assembly 100' of FIG. 10G. Cylindrical structure 1100*a*' is analogous to the cylindrical structure 1100*a* of FIG. 11A, with the exception that the primary cells 612*a*-612*d* also contain connection elements, similar to primary cells of FIG. 10G.

Figure 12A:
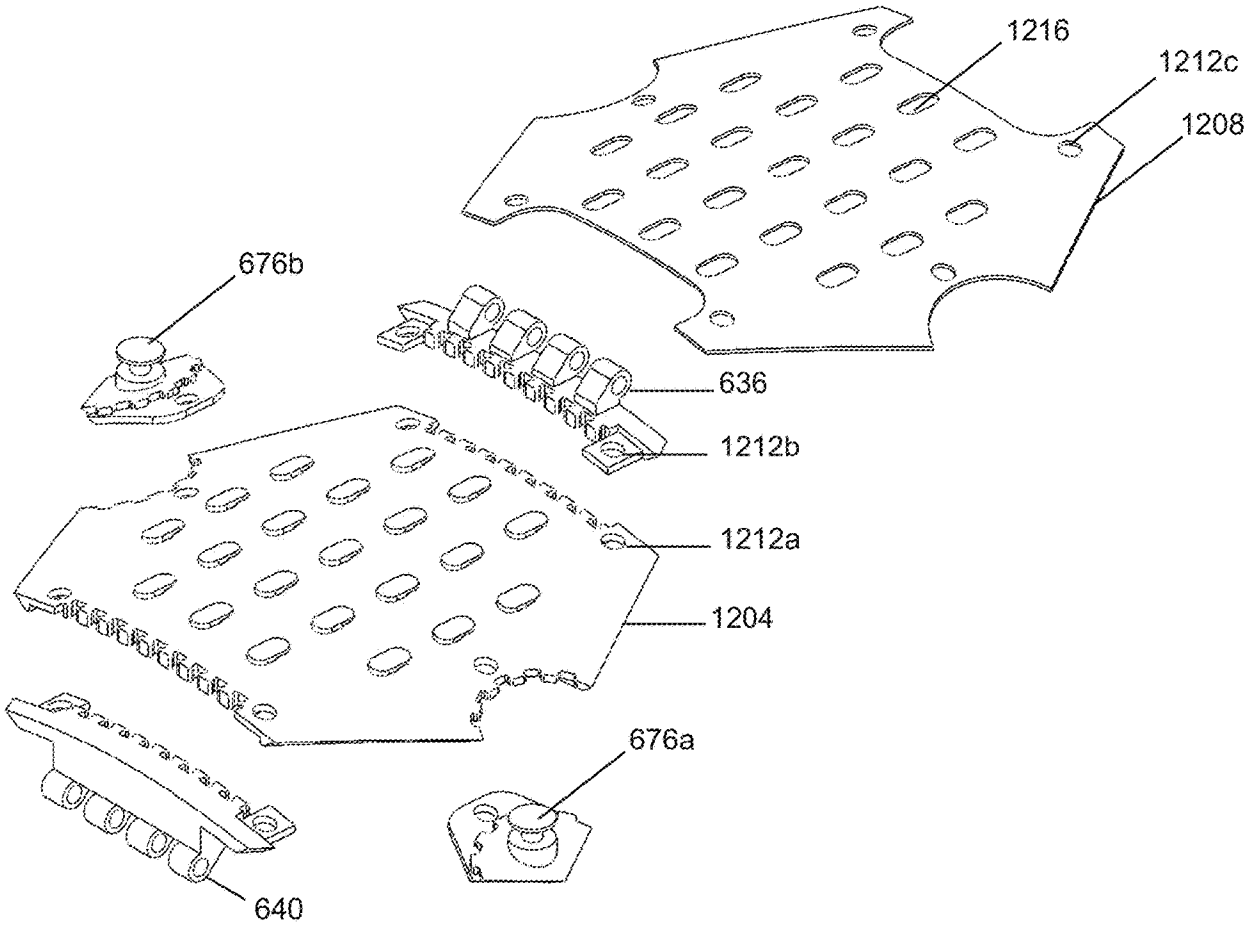
FIG. 12A is a perspective view of the detachable components of an example secondary cell, in accordance with an embodiment.
Figure 12B:
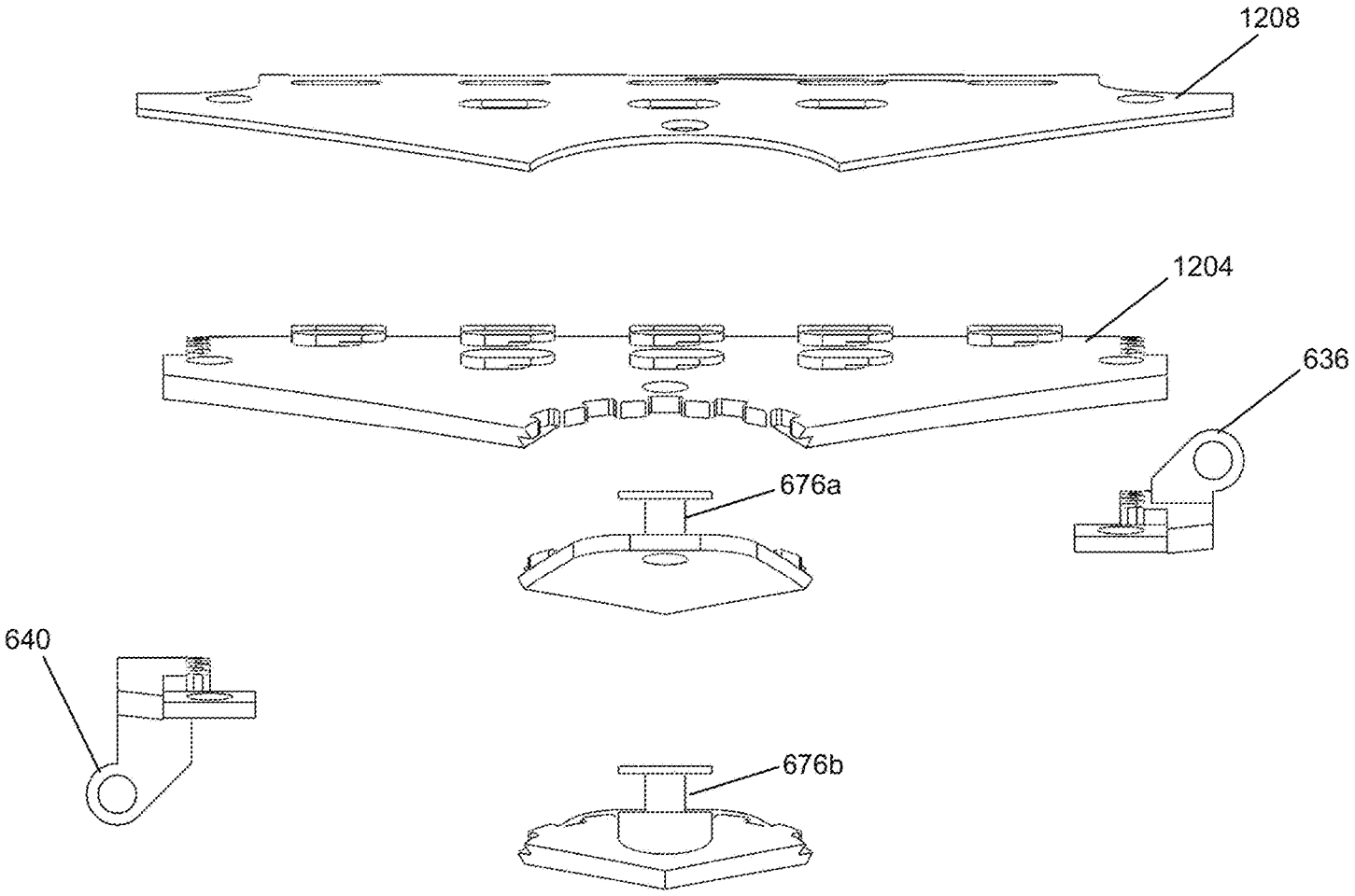
FIG. 12B is a side view of the detachable components of FIG. 12A.
Figure 12C:
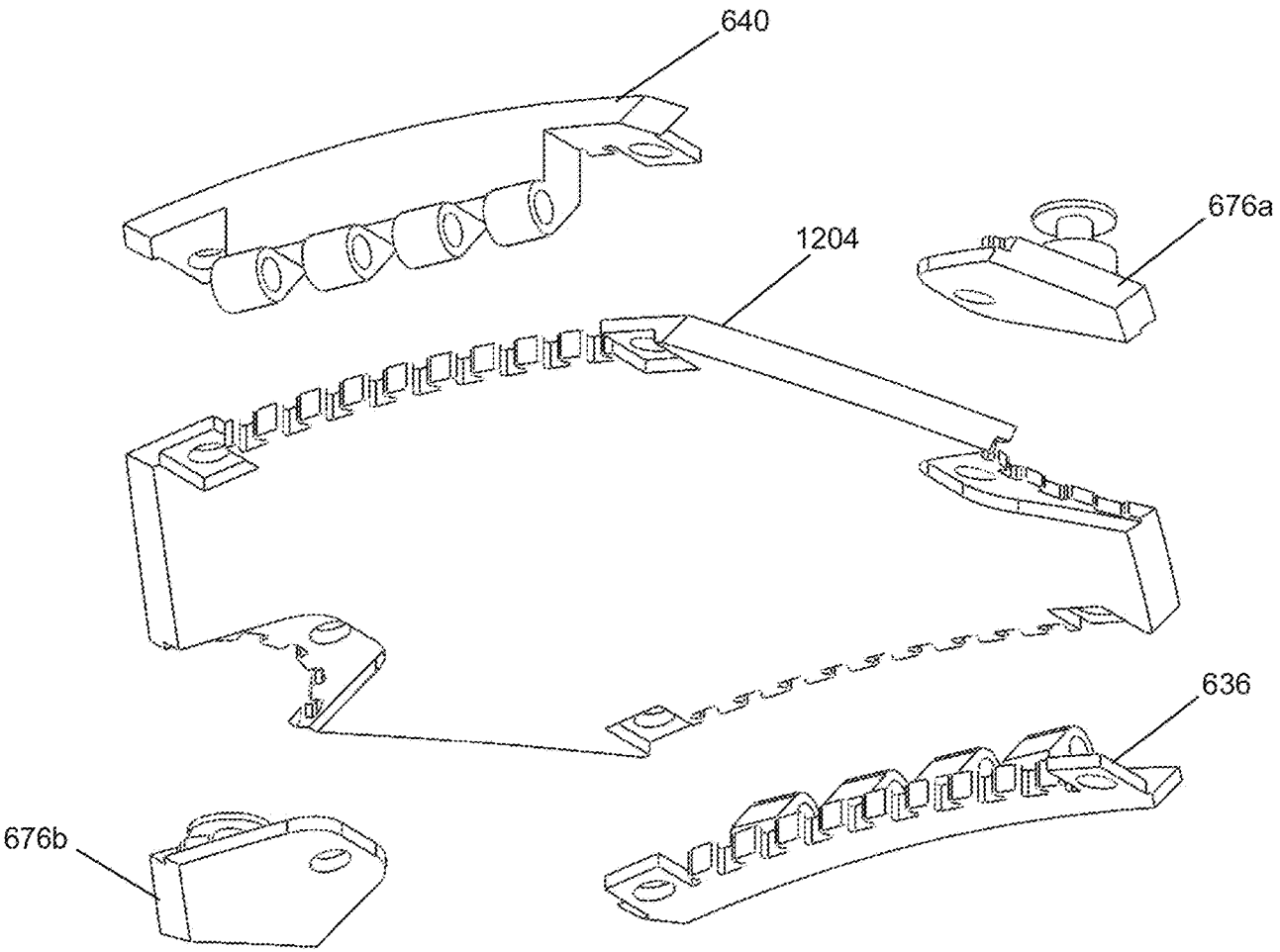
FIG. 12C is a bottom perspective view of the detachable components of FIG. 12A.

Referring now to FIGS. 12A to 12D, shown therein are detachable components that can be assembled to form an example secondary cell 608. FIGS. 12A to 12C shows a perspective view, a side view and a bottom perspective view respectively of detachable components that can be assembled to form an example secondary cell 608. The detachable components may include cell base 1204, first secondary cell hinge element 636, second secondary cell hinge element 640, and secondary cell connection elements 676*a* and 676*b*. Optionally, the detachable components may include fabric plate 1208.

In some embodiments, the same cell base 1204 may be used for primary cell 204, secondary cell 208, primary cell 604, intermediary cell 668, intermediary cell 670, and/or additional intermediary cell 1004. Each of the detachable components may include multiple bolt holes 1212 that can be used for coupling the detachable components together using bolts.

In some embodiments, such as embodiments of FIGS. 10G and 11G, where the primary cells also contain connection elements, the base plate may be manufactured to include the cell base 1204 along with the connection elements 676*a* and 676*b*. This either pre-assembled or single-piece manufacturing of modified base plate with the cell base and connection elements may have the advantage of simplifying and expediting the manufacturing as well as assembly process because this eliminates the need to manufacture different types of base plates for different types of cells. This may also has the advantage of reducing the number of detachable components, thereby simplifying the assembly process.

Fabric plate 1208 can be of any suitable material and design that connects cell base 1204 to an outer fabric layer. The outer fabric layer may be attached to fabric plate 1208 (e.g., glued or sewn). Fabric plate 1208 can enable rapid and reversible attachment/detachment of an outer fabric layer with a collapsible assembly used as an endoskeleton. The outer fabric layer can be attached without compromising the structural integrity of the collapsible assembly.

As described herein above with reference to primary and secondary cell surfaces, fabric plate 1208 may also be curved to match the curvature of a cylindrical structure. Fabric plate 1208 may include a regular pattern of notches 1216 oriented parallel to the collapsibility axis.

Figure 12D:
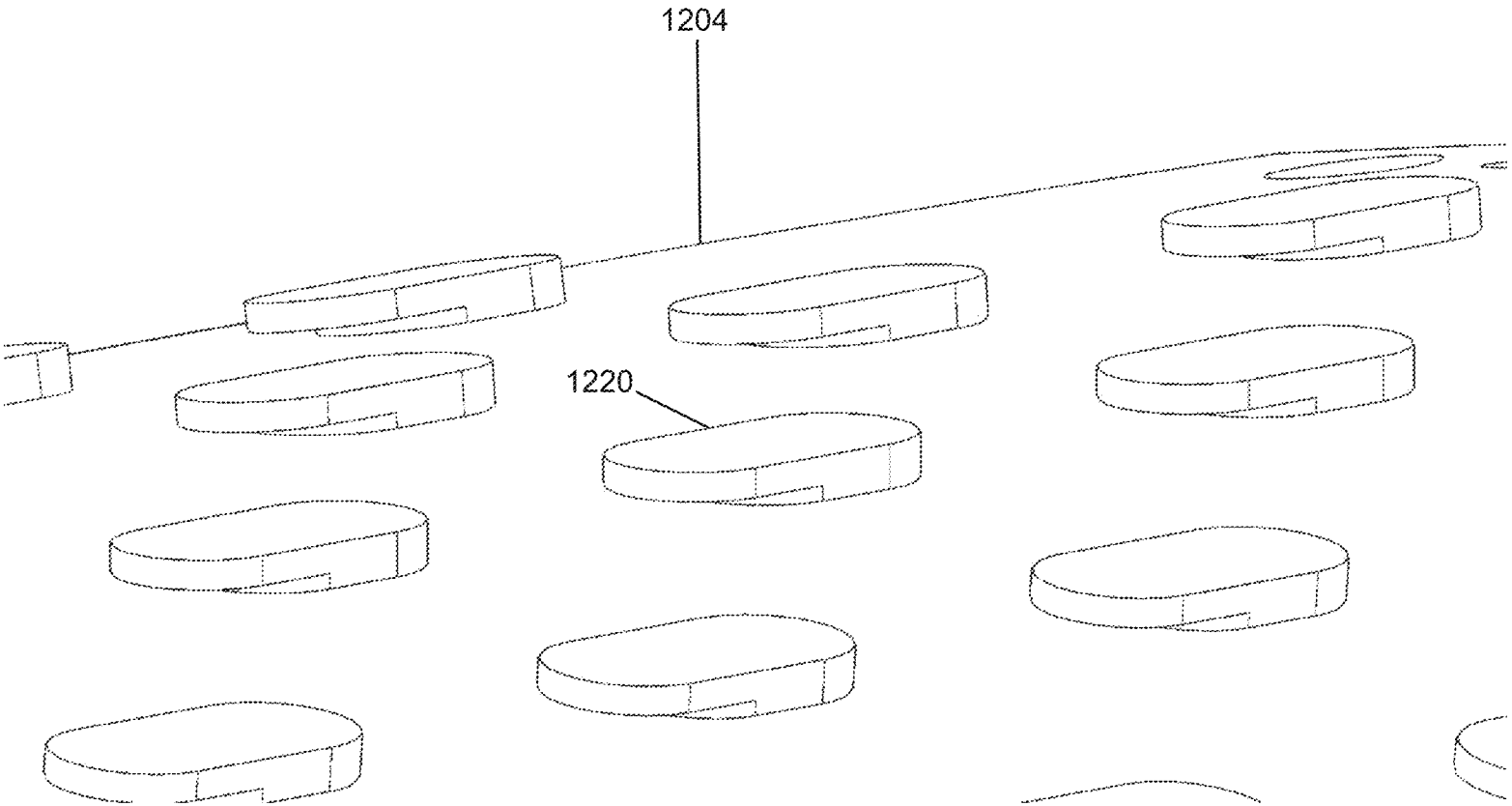
FIG. 12D is a zoomed-in perspective view of an example base plate of FIG. 12A.

Referring now to FIG. 12D, shown therein is a zoomed-in perspective view of cell base 1204. Cell base 1204 may include multiple extrusions 1220 on its outer surface. Each extrusion 1220 may be shaped with a notch that matches the thickness of fabric plate 1208 to allow fabric plate 1208 to slide into the undercut of extrusion 1220. Extrusions 1220 of cell base 1204 may latch on to notches 1216 of fabric plate 1208 coupling cell base 1204 and fabric plate 1208 together.

In some embodiments, the number of notches 1216 is equal to the number of extrusions 1220. Larger number of extrusions/notches can enable pressure acting on the collapsible assembly to be more evenly distributed. The size of each extrusion/notch may be inversely proportional to the number of extrusions/notches.

Figure 12E:
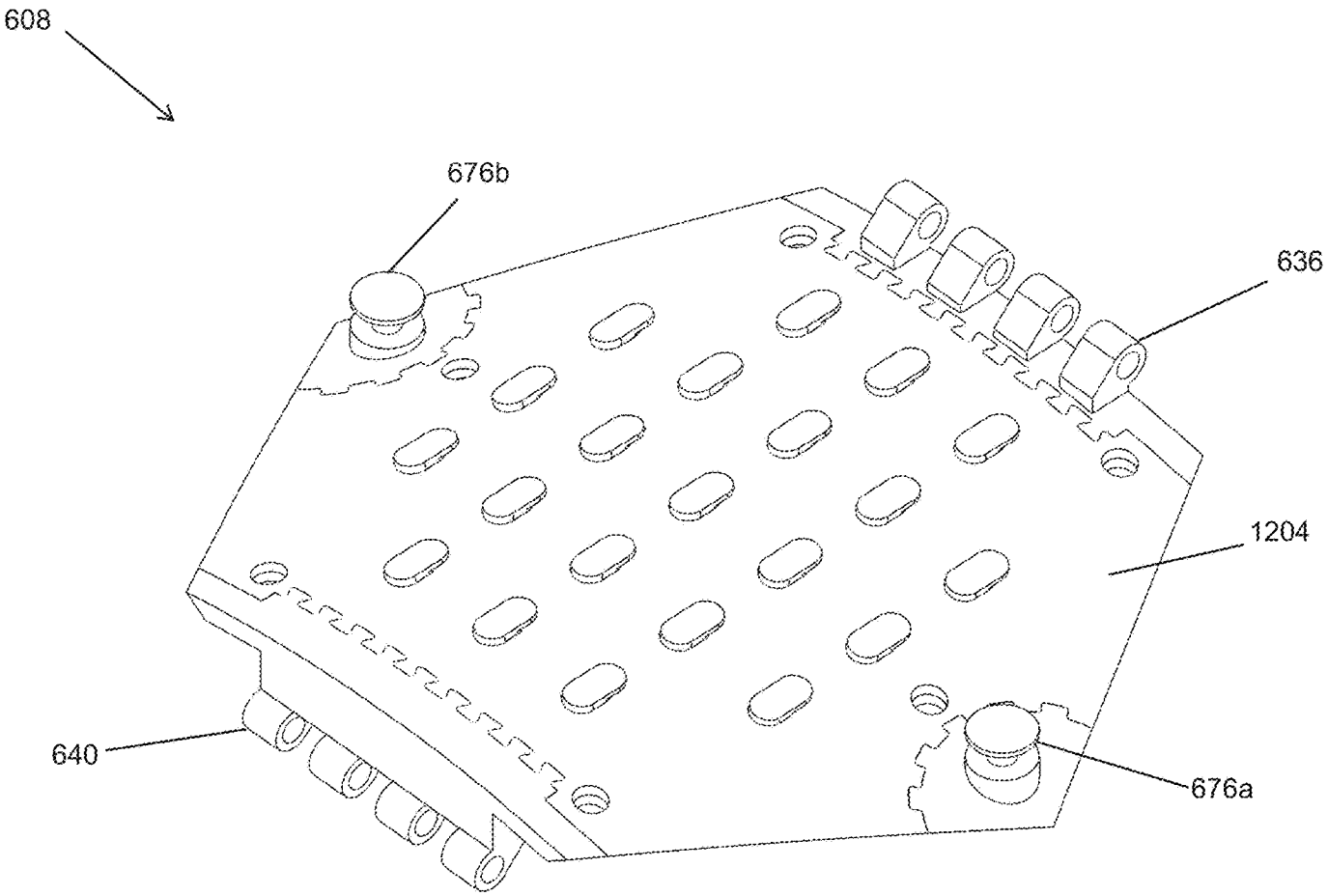
FIG. 12E is a perspective view of an example secondary cell assembled using the detachable components of FIG. 12A.
Figure 12F:
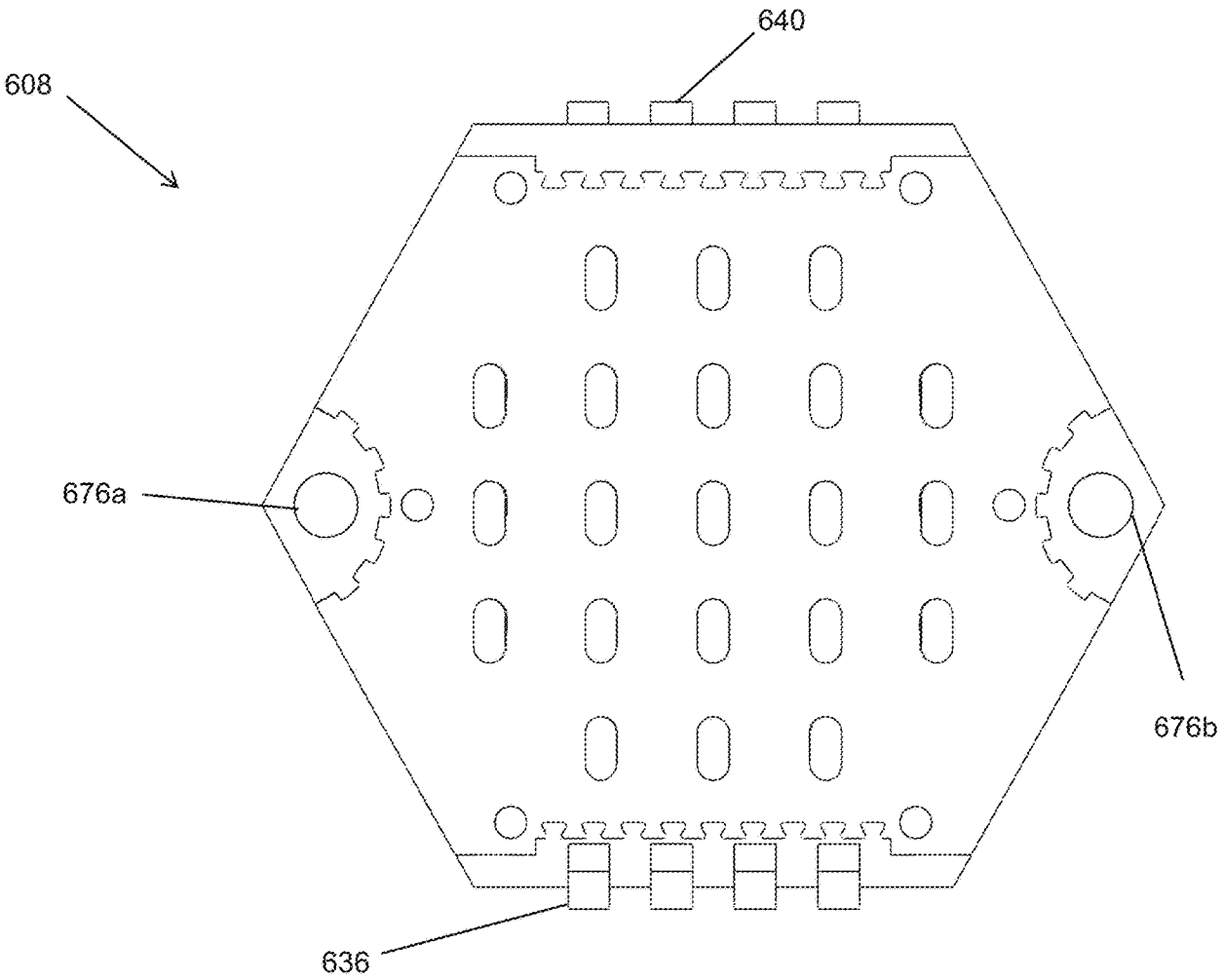
FIG. 12F is a top view of the assembled example secondary cell of FIG. 12E.

Referring now to FIGS. 12E and 12F, shown therein are a perspective view and a top view respectively of secondary cell 608 assembled using the detachable components shown in FIGS. 12A to 12C. Secondary cell 608 may include cell base 1204, first secondary cell hinge element 636, second secondary cell hinge element 640, and secondary cell connection elements 676*a* and 676*b*.

Figure 12G:
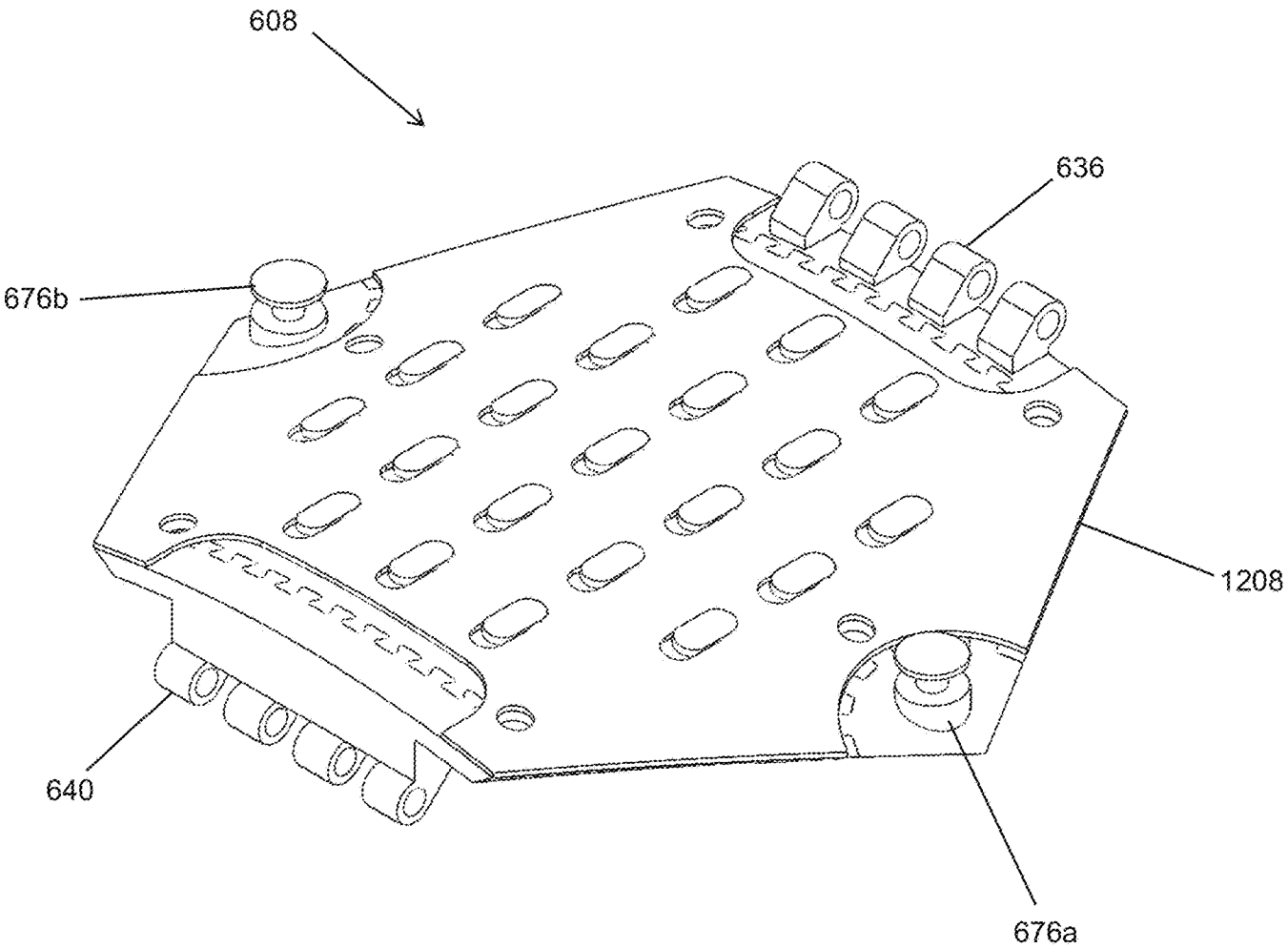
FIG. 12G is a perspective view of an example secondary cell assembled using the detachable components of FIG. 12A.
Figure 12H:
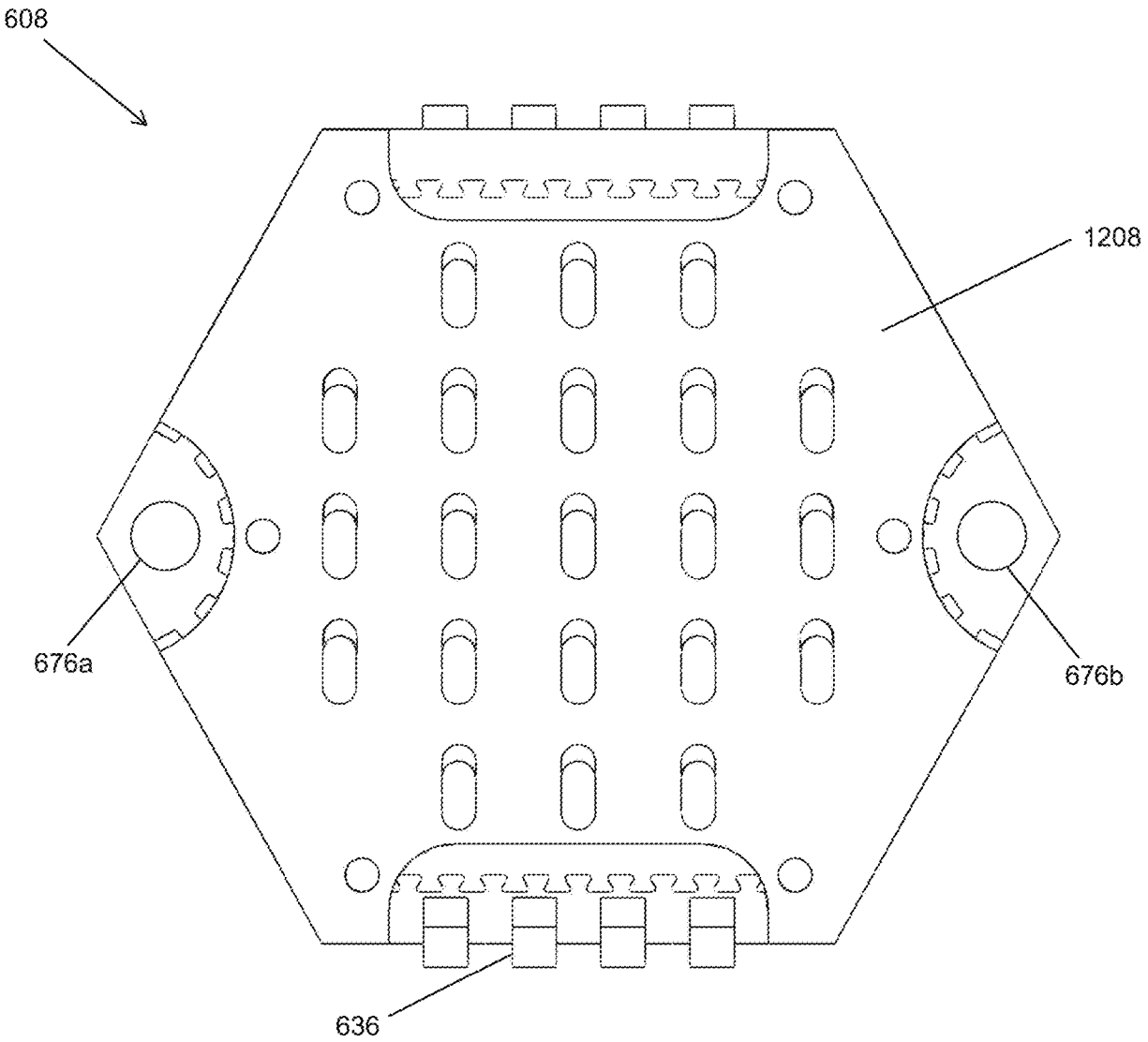
FIG. 12H is a top view of the assembled example secondary cell of FIG. 12G.

Referring now to FIGS. 12G and 12H, shown therein are a perspective view and a top view respectively of secondary cell 608 assembled using the detachable components shown in FIGS. 12A to 12C. Secondary cell 608 may include cell base 1204, first secondary cell hinge element 636, second secondary cell hinge element 640, secondary cell connection elements 676*a* and 676*b*, and fabric plate 1208. The bolts connecting the cell base to hinge elements 636 and 640 can also extend to fabric plate 1208 to fully lock the assembled structure in place. In the assembled configuration, the extrusions of the cell base can latch on to the notches of the fabric plate coupling the cell based and the fabric plate together.

The assembled secondary cell 608 may be disassembled by first removing the bolts and detaching the first secondary cell hinge element 636*a*, second secondary cell hinge element 640, and secondary cell connection elements 676*a* and 676*b*. The cell base can then be dislodged from the notches in fabric plate 1208 and then detached from fabric plate 1208. The fabric plate 1208 can remain attached to the outer fabric layer.

Figure 13A:
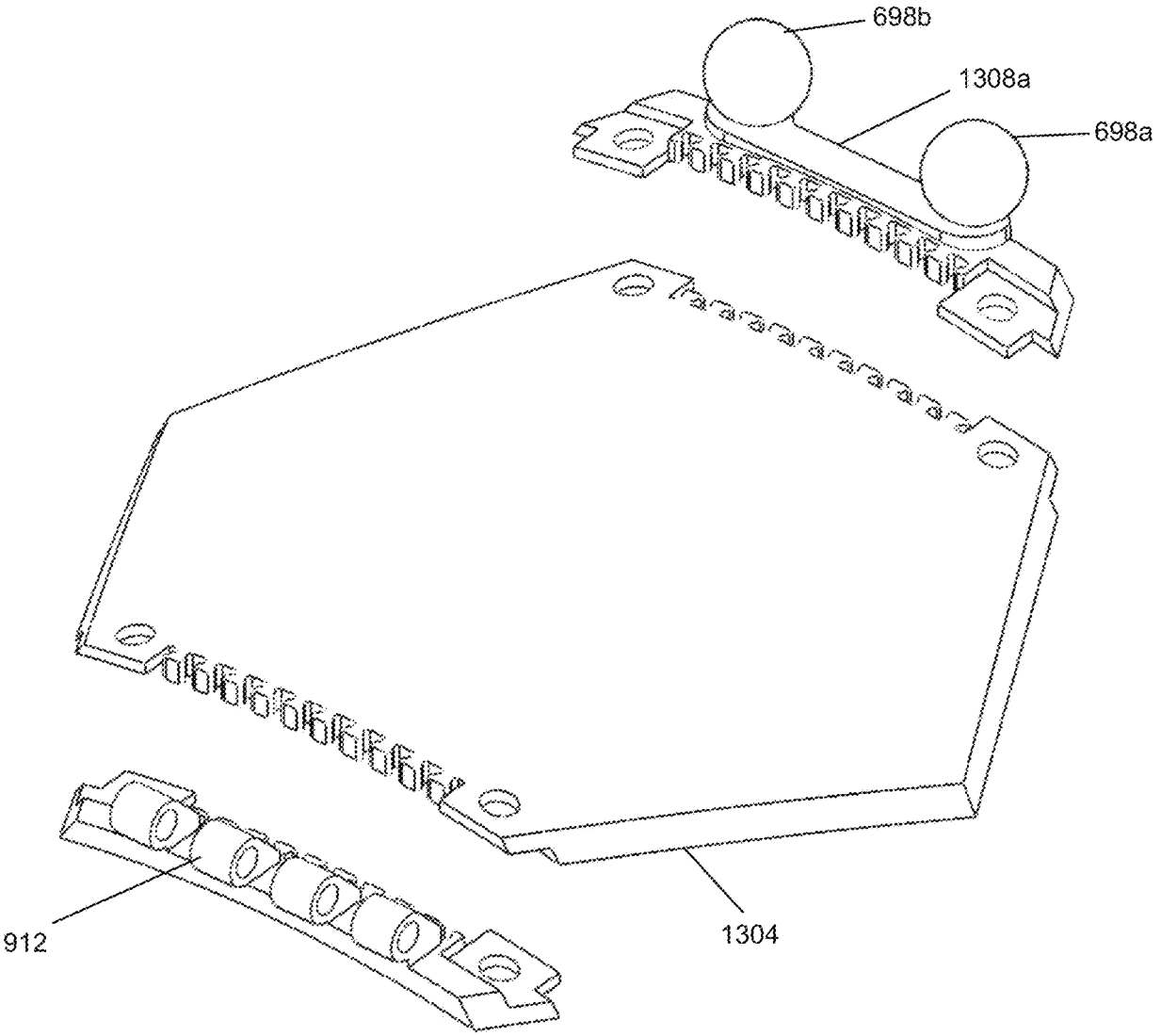
FIG. 13A is a perspective view of the detachable components of an example intermediary cell, in accordance with an embodiment.
Figure 13B:
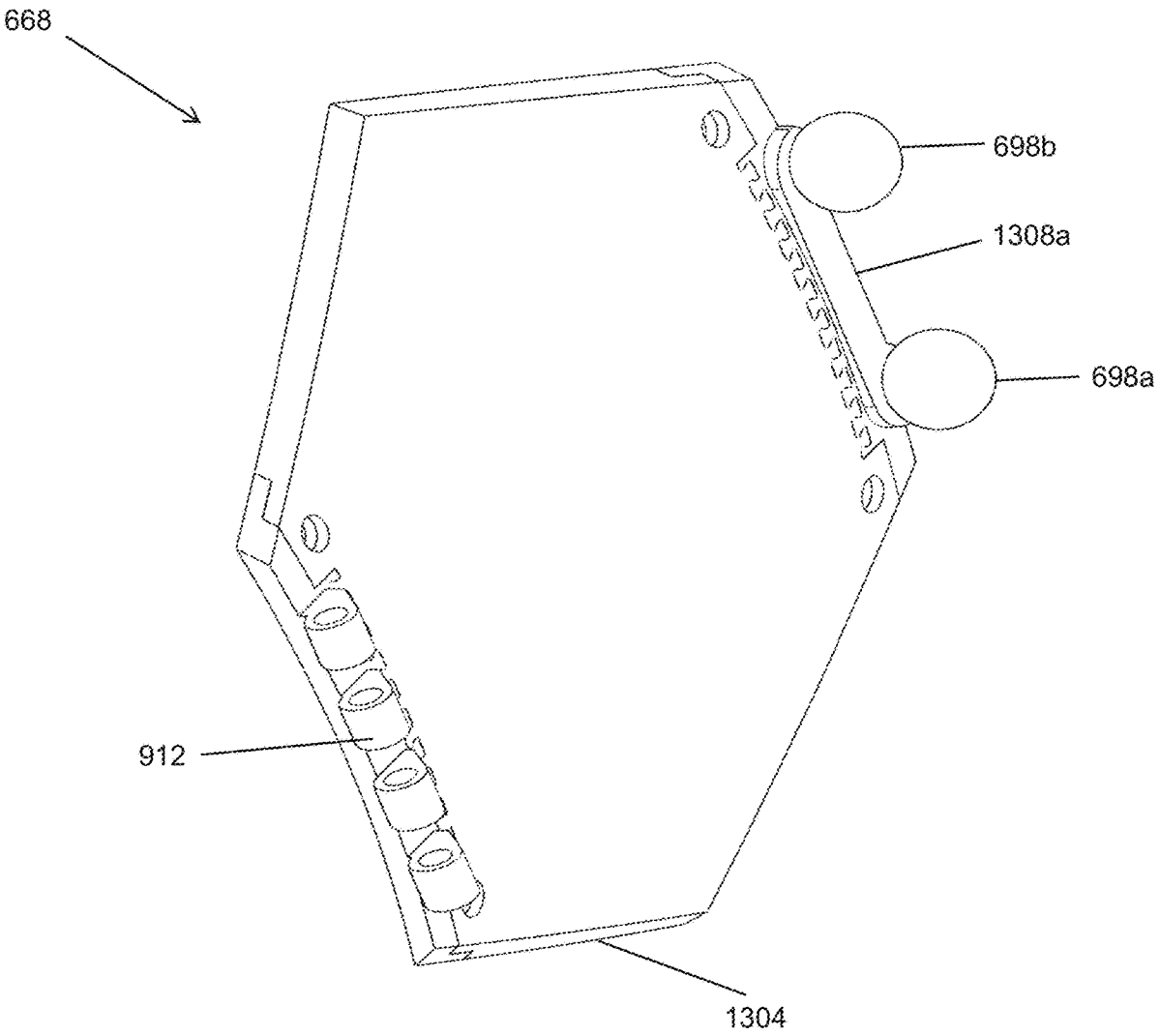
FIG. 13B is a perspective view of the assembled example intermediary cell of FIG. 13A.

Referring now to FIG. 13A, shown therein are detachable components that can be assembled to form an example intermediary cell 668. FIG. 13A shows a perspective view of the detachable components that can be assembled to form the example intermediary cell 668. The detachable components may include cell base 1304, intermediary cell hinge element 912 and connection element 1308*a*. Connection element 1308*a* includes intermediary cell connection elements 698*a* and 698*b*. FIG. 13B shows a perspective view of the assembled intermediary cell 668.

Figure 13C:
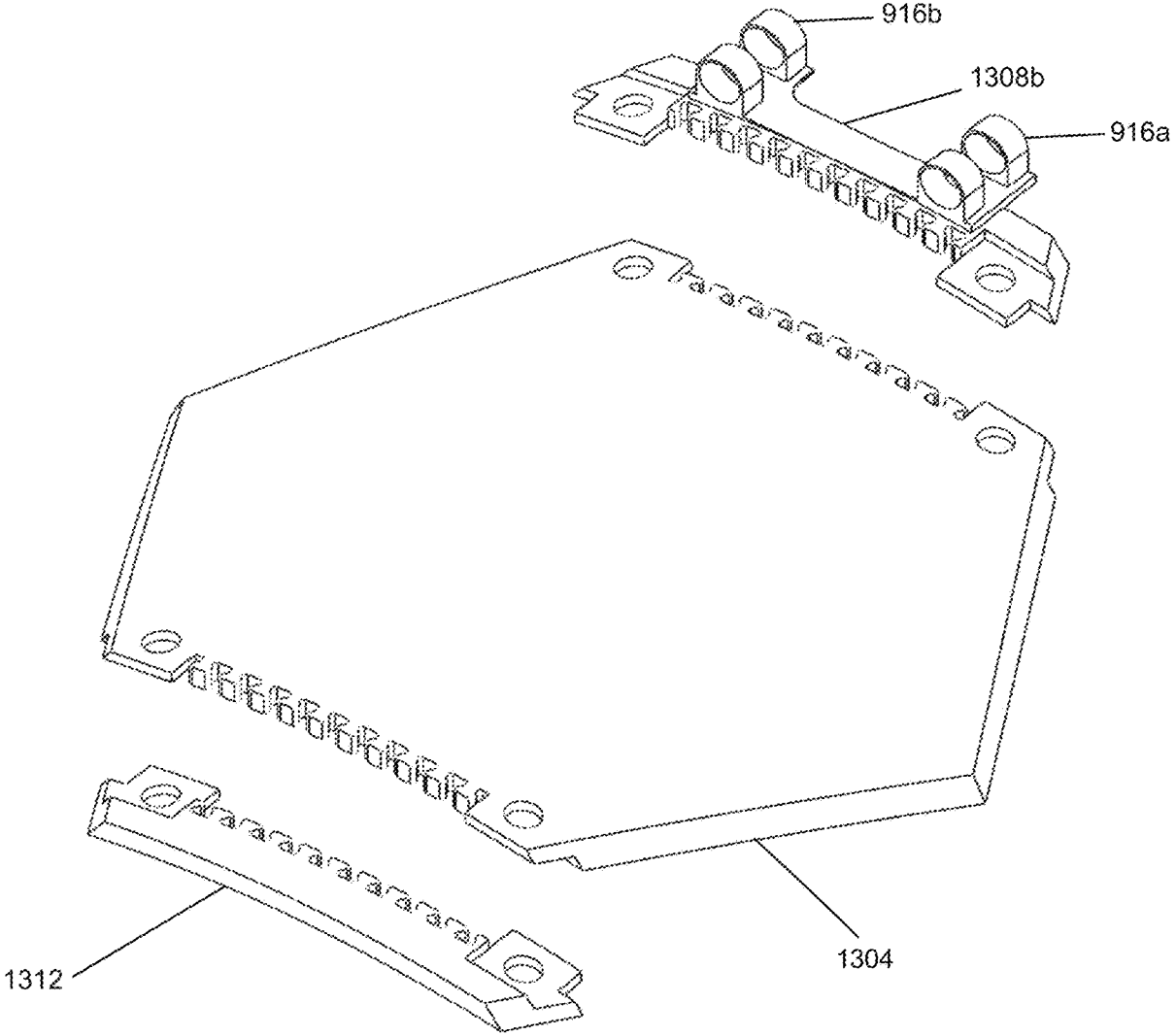
FIG. 13C is a perspective view of the detachable components of an example intermediary cell, in accordance with an embodiment.
Figure 13D:
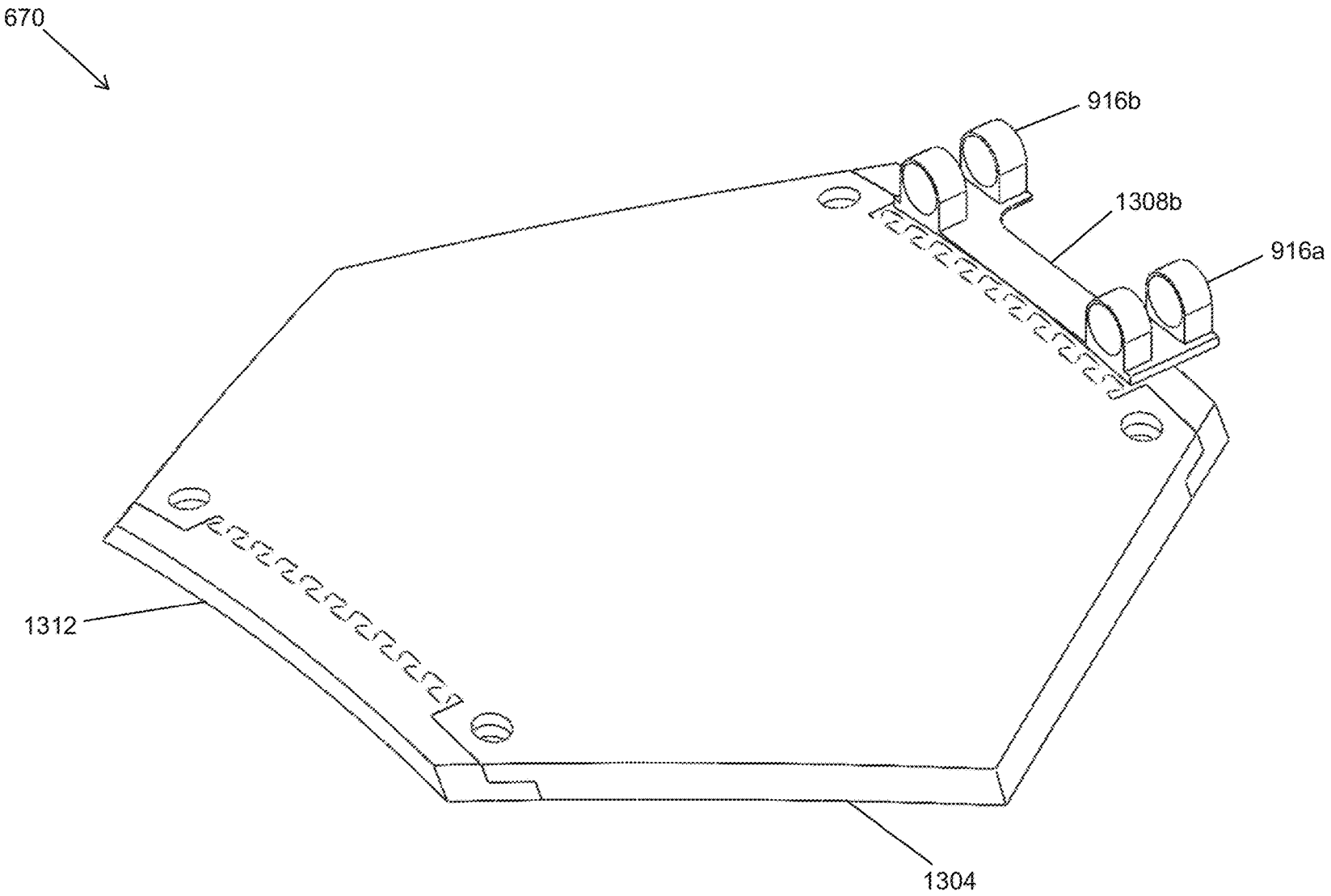
FIG. 13D is a perspective view of the assembled example intermediary cell of FIG. 13C.

Referring now to FIG. 13C, shown therein are detachable components that can be assembled to form an example intermediary cell 670. FIG. 13C shows a perspective view of the detachable components that can be assembled to form the example intermediary cell 670. The detachable components may include cell base 1304, blank element 1312 and connection element 1308*b*. Connection element 1308*b* includes intermediary cell connection elements 916*a* and 916*b*. FIG. 13D shows a perspective view of the assembled intermediary cell 670.

Figure 13E:
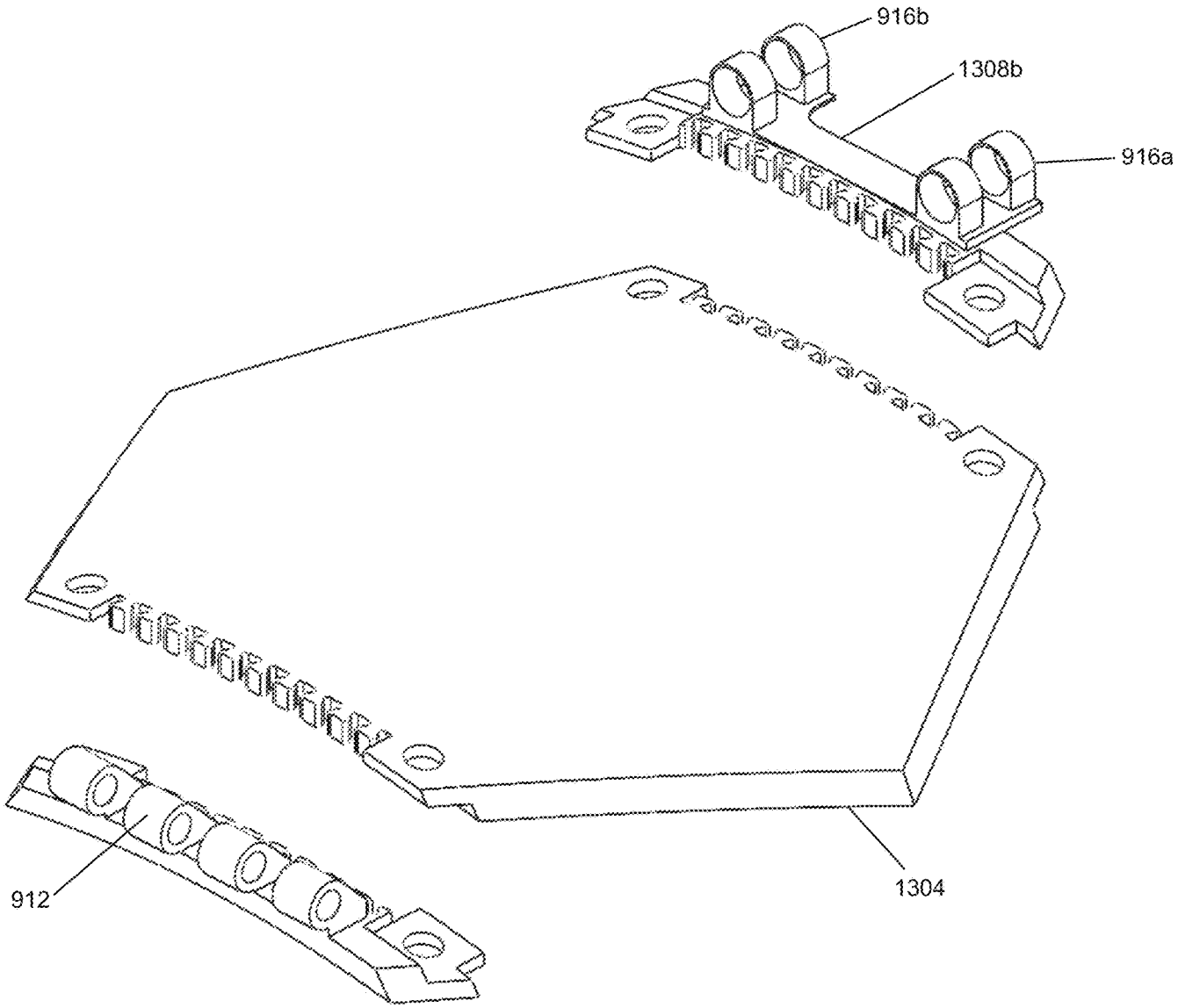
FIG. 13E is a perspective view of the detachable components of an example intermediary cell, in accordance with an embodiment.
Figure 13F:
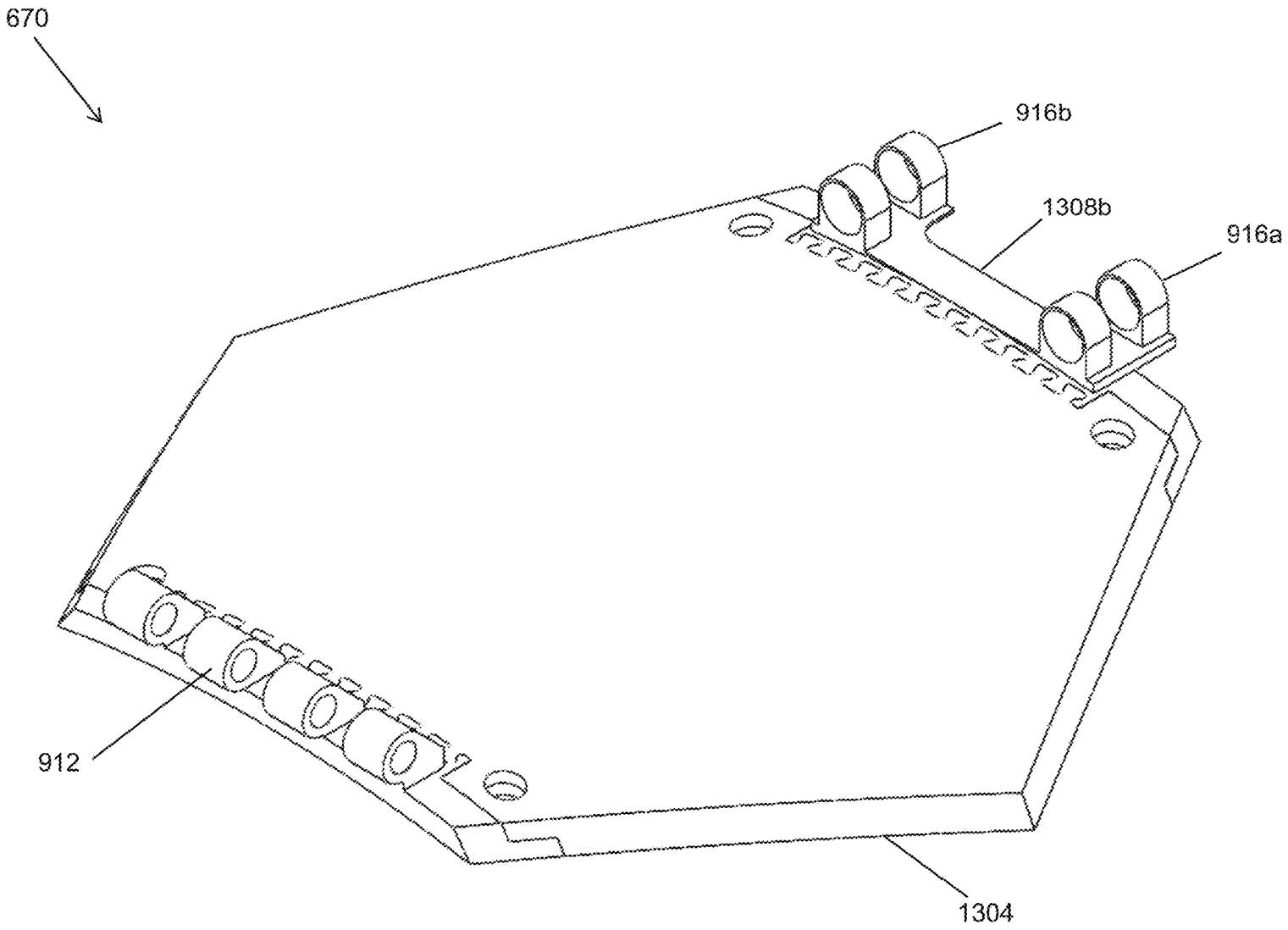
FIG. 13F is a perspective view of the assembled example intermediary cell of FIG. 13E.

Referring now to FIG. 13E, shown therein are detachable components that can be assembled to form another example of intermediary cell 670. FIG. 13E shows a perspective view of the detachable components that can be assembled to form the intermediary cell 670. The detachable components may include cell base 1304, intermediary cell hinge element 912 and connection element 1308*b*. Connection element 1308*b* includes intermediary cell connection elements 916*a* and 916*b*. FIG. 13F shows a perspective view of the assembled intermediary cell 670.

Figure 14A:
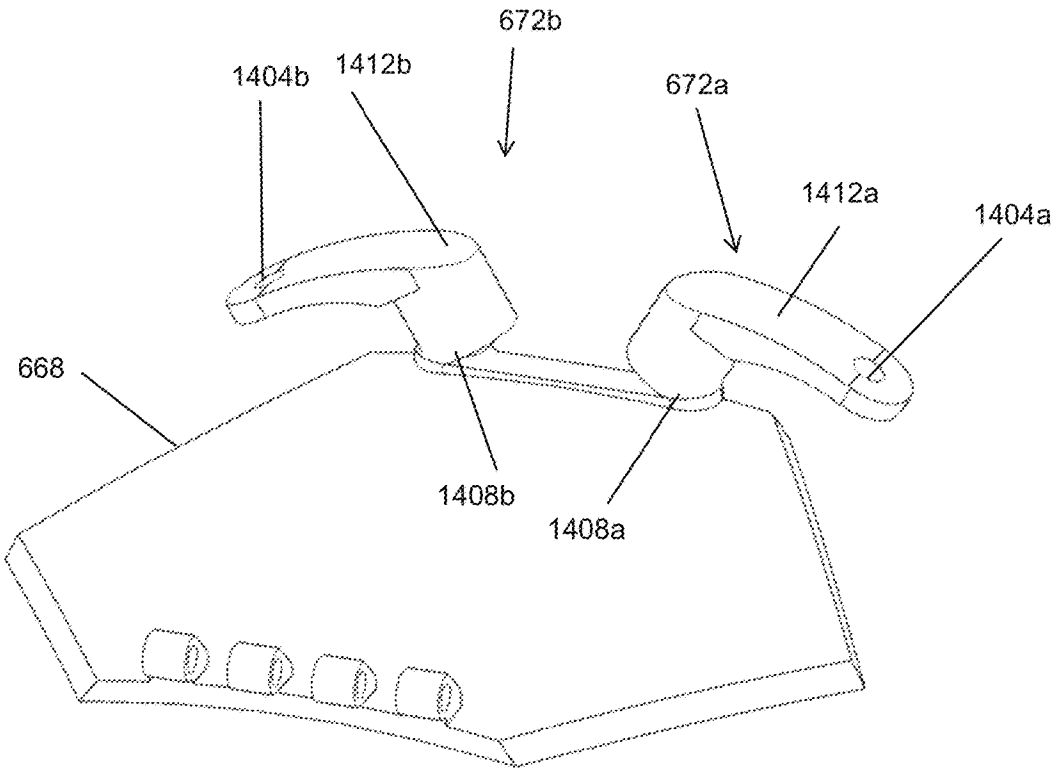
FIG. 14A is a perspective view of example coupling elements connected to intermediary cell connection elements, in accordance with an embodiment.
Figure 14B:
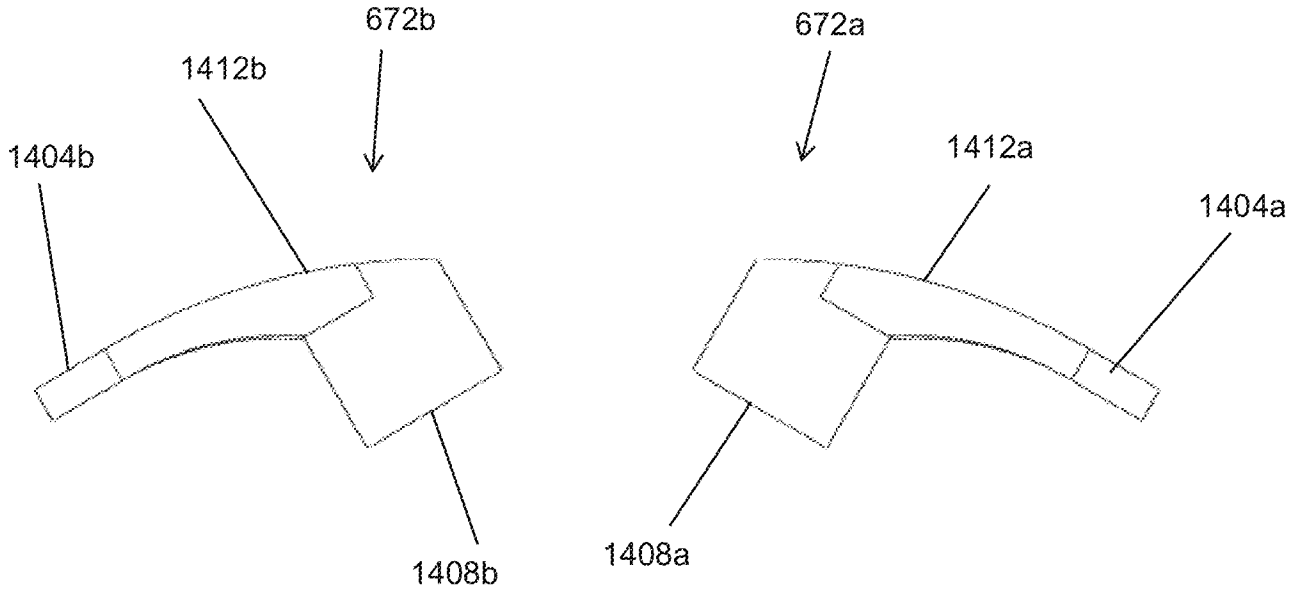
FIG. 14B is a front view of the example coupling elements of FIG. 14A.
Figure 14C:
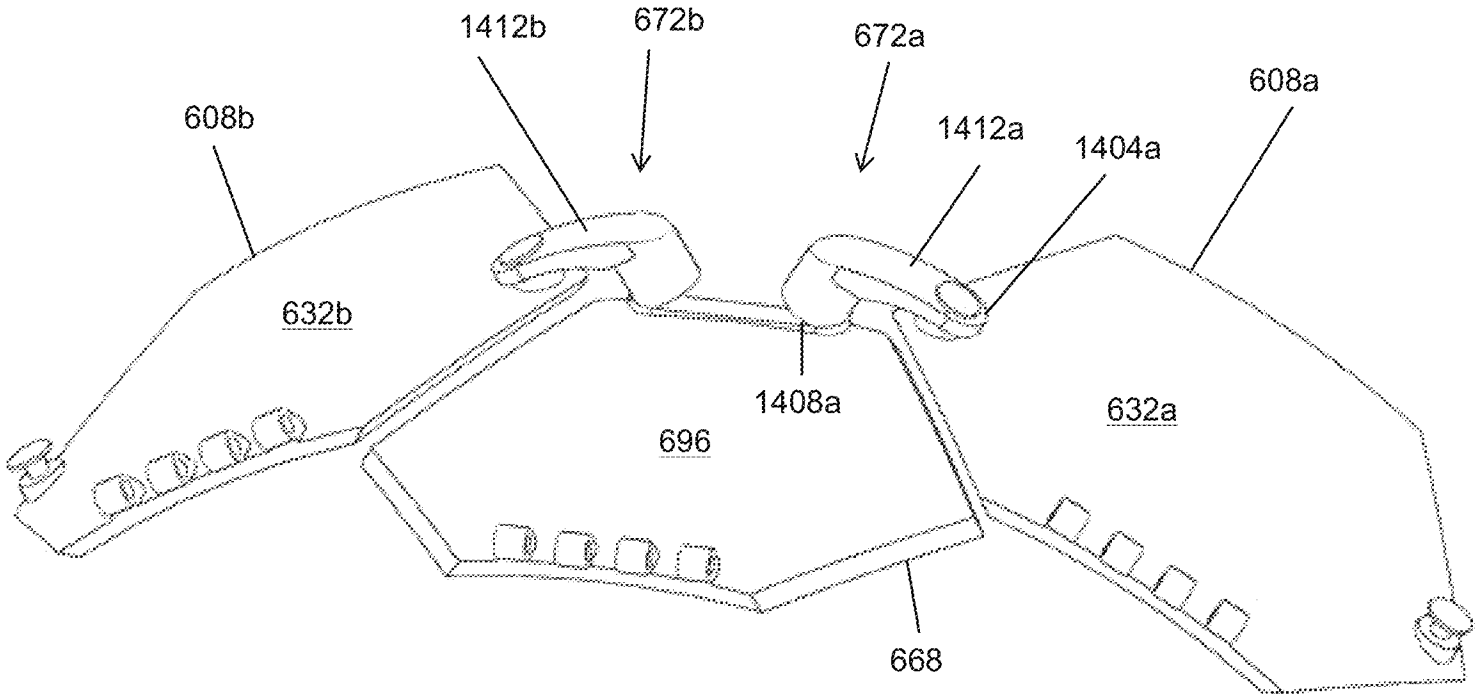
FIG. 14C is a perspective view of the example coupling elements of FIG. 14A connected between intermediary cell connection elements and corresponding secondary cell connection elements.
Figure 14D:
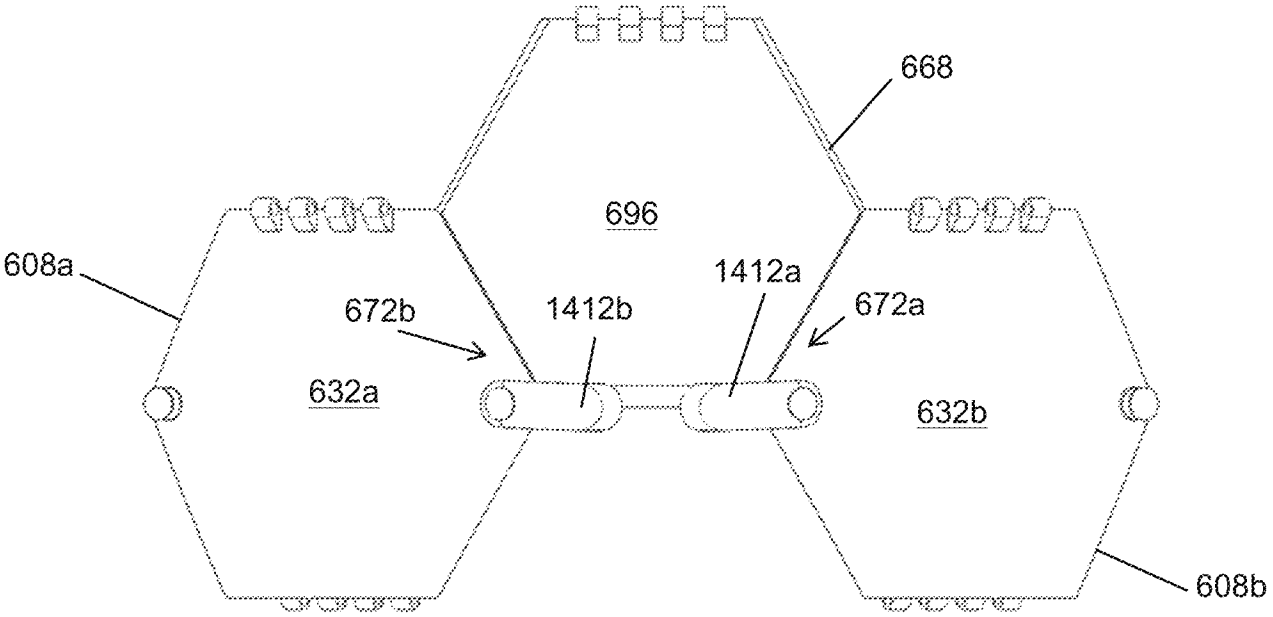
FIG. 14D is a top view of the example coupling elements of FIG. 14C.

Referring now to FIGS. 14A to 14D, shown therein are different views of coupling elements 672*a* and 672*b*. FIG. 14A is a perspective view of coupling elements 672*a* and 672*b* connected to the intermediary cell connection elements of intermediary cell 668. FIG. 14B is a front view of coupling elements 672*a* and 672*b*. FIG. 14C is a perspective view of coupling elements 672*a* and 672*b* connected between intermediary cell connection elements of intermediary cell 668 and corresponding secondary cell connection elements of secondary cells 608*a* and 608*b*. FIG. 14D is a top view of coupling elements 672*a* and 672*b* connected between intermediary cell connection elements of intermediary cell 668 and corresponding secondary cell connection elements of secondary cells 608*a* and 608*b*.

Each coupling element may include a first end 1408, a second end 1404 and an arm 1412. The arm 1412 may be a rigid structure. The design of the coupling elements can enable the collapsible movement of the collapsible assembly as describe herein above with reference to FIGS. 10A to 10F.

The intermediary cell connection elements of intermediary cell 668 may be shaped as ball connections (e.g., intermediary cell connection elements 698*a* and 698*b* shown in FIGS. 9A to 9D). The first end 1408*a* of coupling element 672*a* may be connected to intermediary cell connection element 698*a* forming a ball and socket joint. Similarly, the first end 1408*b* of coupling element 672*b* may be connected to intermediary cell connection element 698*b* forming a ball and socket joint.

The second end 1404*a* of coupling element 672*a* may be connected to secondary cell connection element of secondary cell 608*a* forming a two-dimensional hinge connection. The second end 1404*b* of coupling element 672*b* may be connected to secondary cell connection element of secondary cell 608*b* forming a two-dimensional hinge connection. In some embodiments, the secondary cell connection elements may be pin shaped (e.g., secondary cell connection elements 676*a* and 676*b* shown in FIGS. 8A to 8D) providing for a planar rotary motion of arm 1412.

Figure 15A:
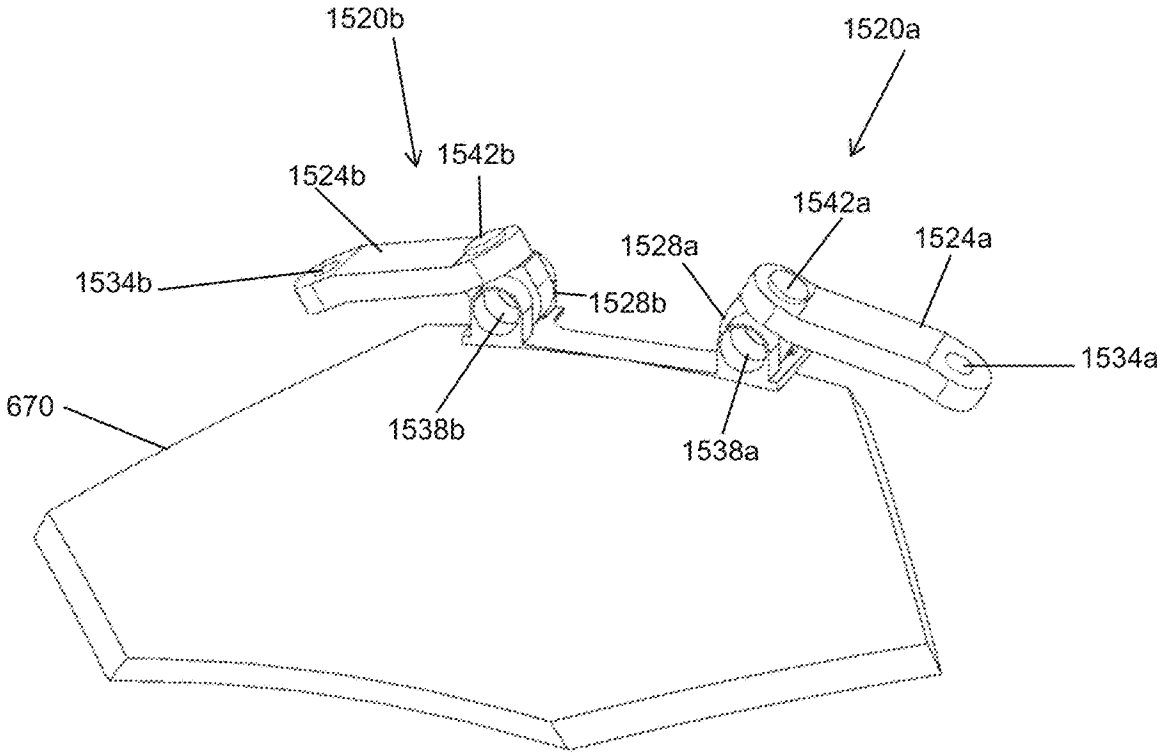
FIG. 15A is a perspective view of example coupling elements connected to intermediary cell connection elements, in accordance with an embodiment.
Figure 15B:
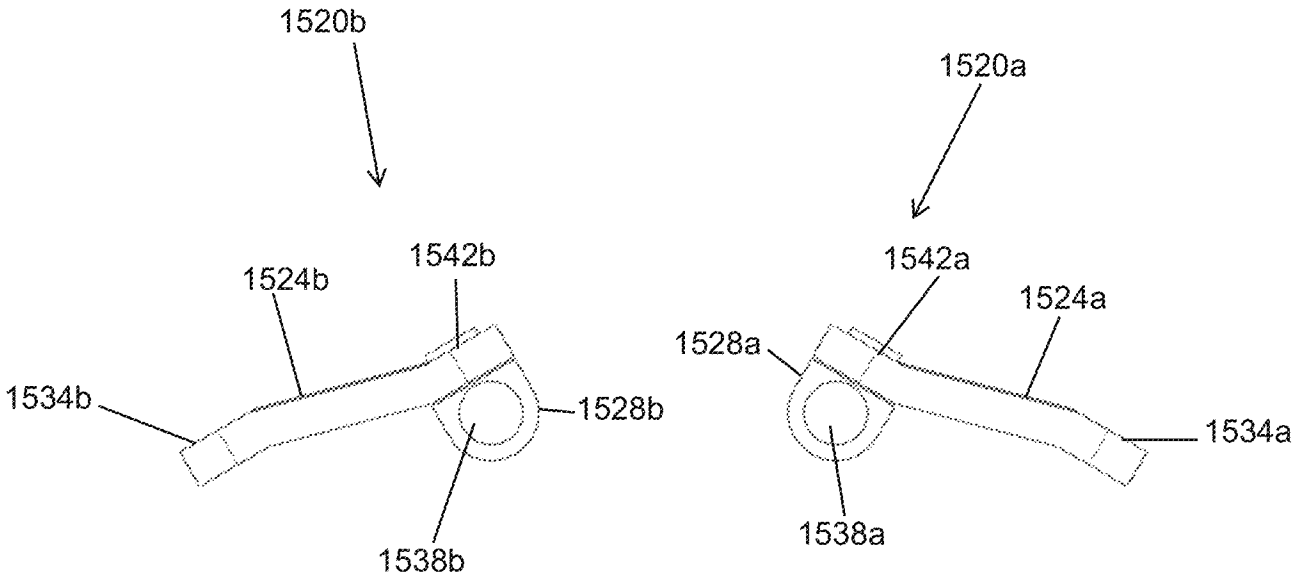
FIG. 15B is a front view of the example coupling elements of FIG. 15A.
Figure 15C:
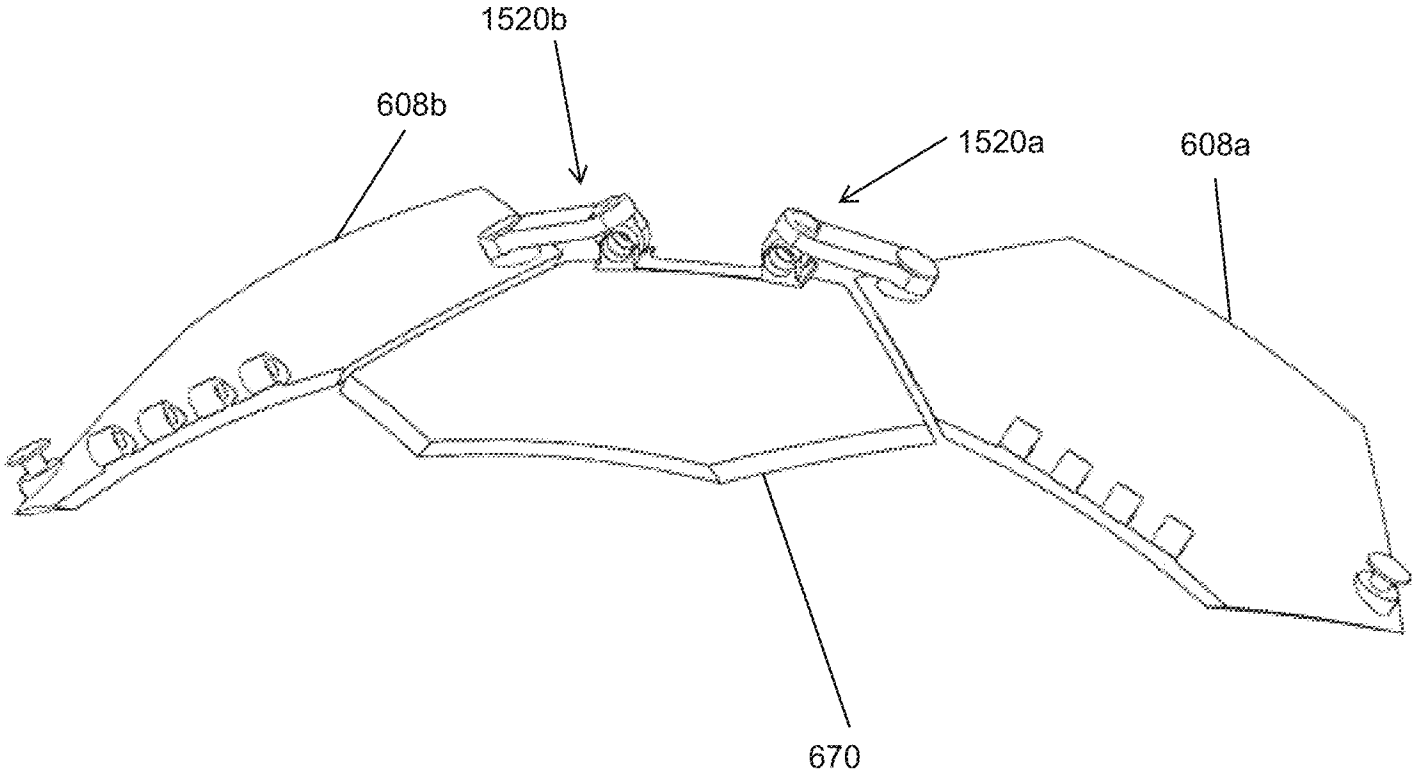
FIG. 15C is a perspective view of the example coupling elements of FIG. 15A connected between intermediary cell connection elements and corresponding secondary cell connection elements.
Figure 15D:
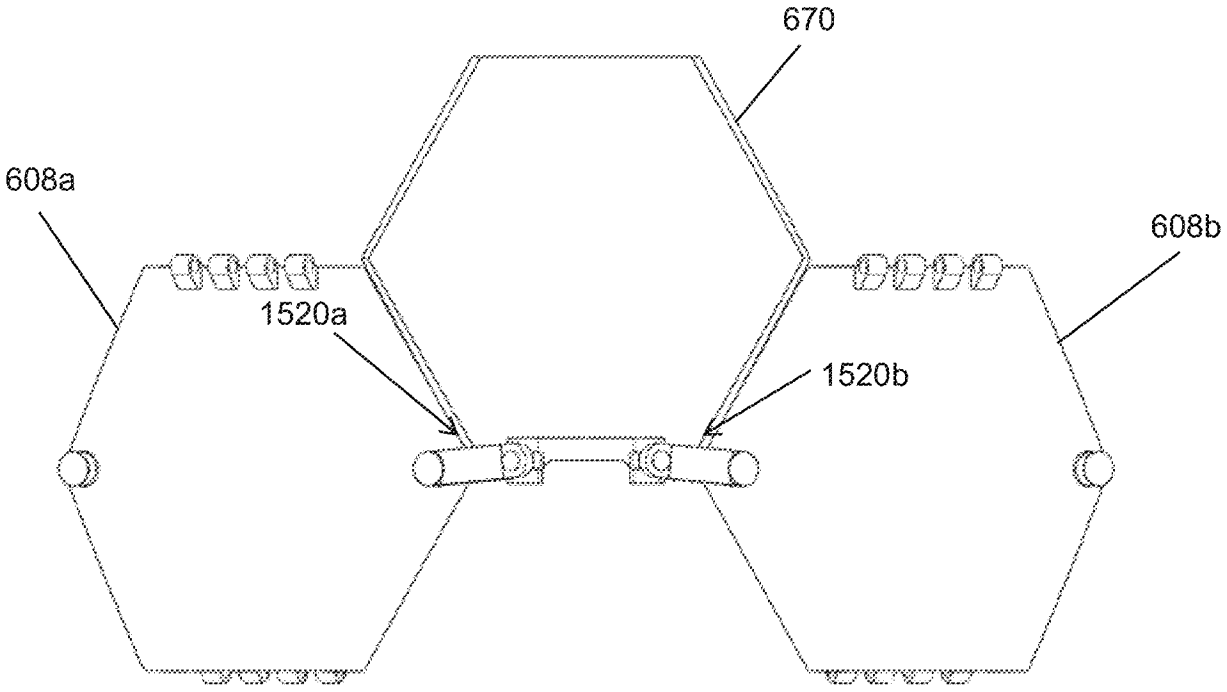
FIG. 15D is a top view of the example coupling elements of FIG. 15C.

Referring now to FIGS. 15A to 15D, shown therein are different views of coupling elements 1520*a* and 1520*b*. FIG. 15A is a perspective view of coupling elements 1520*a* and 1520*b* connected to the intermediary cell connection elements of intermediary cell 670. FIG. 15B is a front view of coupling elements 1520*a* and 1520*b*. FIG. 15C is a perspective view of coupling elements 1520*a* and 1520*b* connected between intermediary cell connection elements of intermediary cell 670 and corresponding secondary cell connection elements of secondary cells 608*a* and 608*b*. FIG. 15D is a top view of coupling elements 1520*a* and 1520*b* connected between intermediary cell connection elements of intermediary cell 670 and corresponding secondary cell connection elements of secondary cells 608*a* and 608*b*.

Each coupling element may include a first arm 1524, a second arm 1528, a first end 1538, a second end 1534, and an arm hinge 1542. The first arm 1524 and second arm 1528 may be rigid structures.

The intermediary cell connection elements of intermediary cell 670 may include a one degree of freedom hinge (as shown in FIGS. 9E to 9H) instead of the ball and socket joint included in intermediary cell 668). Second arm 1528 may be connected to the intermediary cell connection element at first end 1538 to provide a hinge connection with an axis of rotation parallel to collapsibility axis 112. Second arm 1528 may be connected to first arm 1524 at arm hinge 1542 to provide a second degree of freedom for second arm 1528. The axis of rotation at the arm hinge 1542 may be perpendicular to the axis of rotation for the hinge connection at first end 1538.

First arm 1524 may be connected to secondary cell connection element of secondary cell 608*a* at second end 1534 to provide a hinge connection with a single degree of freedom. The axis of rotation can be parallel to the axis of rotation at arm hinge 1542. The design of the coupling elements can enable the collapsible movement of the collapsible assembly as describe herein above with reference to FIGS. 10A to 10F.

Figure 16A:
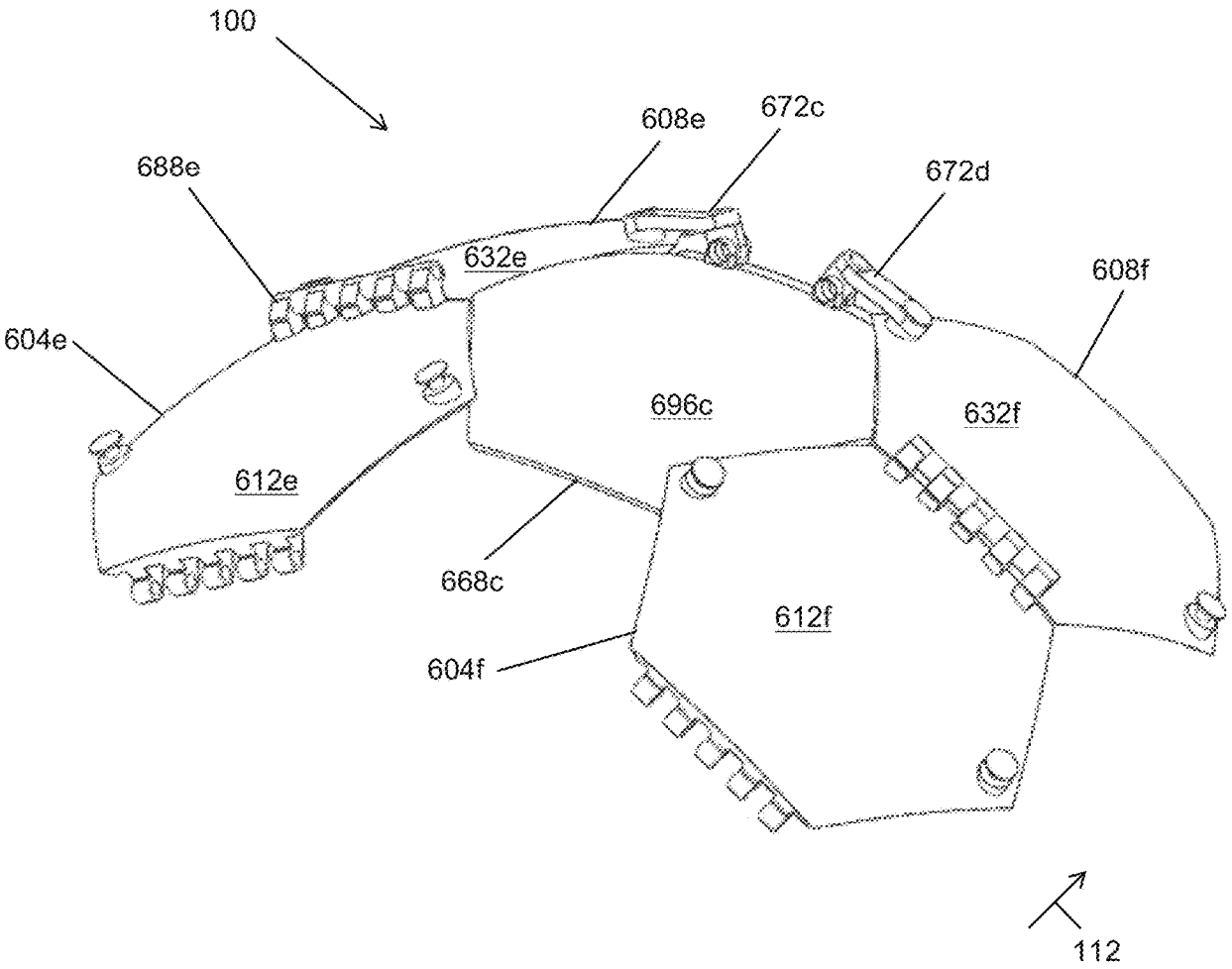
FIG. 16A is a perspective view of an example collapsible assembly in an extended configuration, in accordance with an embodiment.
Figure 16B:
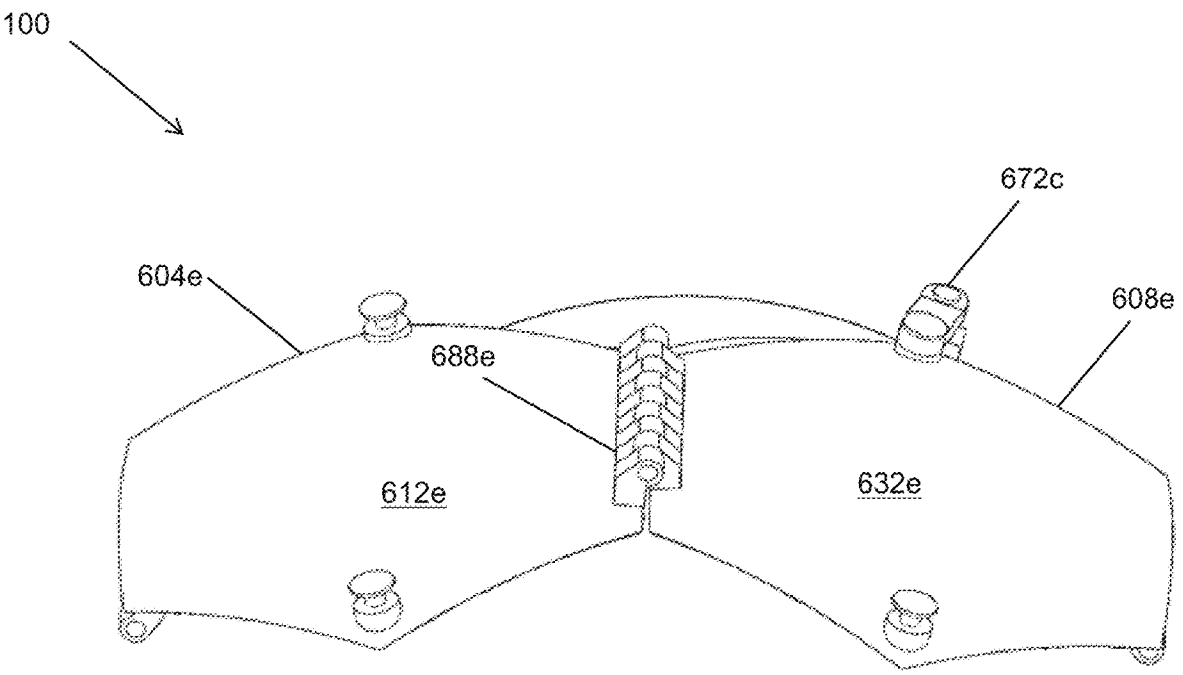
FIG. 16B is a side view of the example collapsible assembly of FIG. 16A.

Referring now to FIGS. 16A and 16B, shown therein is an example embodiment of collapsible assembly 100 that may be used to form a spherical structure. FIG. 16A shows a perspective view of collapsible assembly 100 in an extended configuration. FIG. 16B shows a side view of collapsible assembly 100 in the extended configuration. Collapsible assembly 100 may comprise primary cells 604*e* and 604*f*, secondary cells 608*e* and 608*f*, and intermediary cell 668*c*. As shown in FIG. 16B, the angle between surface 612*e* and 632*e* may be less than 180° (compared with the 180° angle between surface 612*a* and 632*a* shown in FIG. 10B) corresponding to the size of the spherical structure.

Figure 16C:
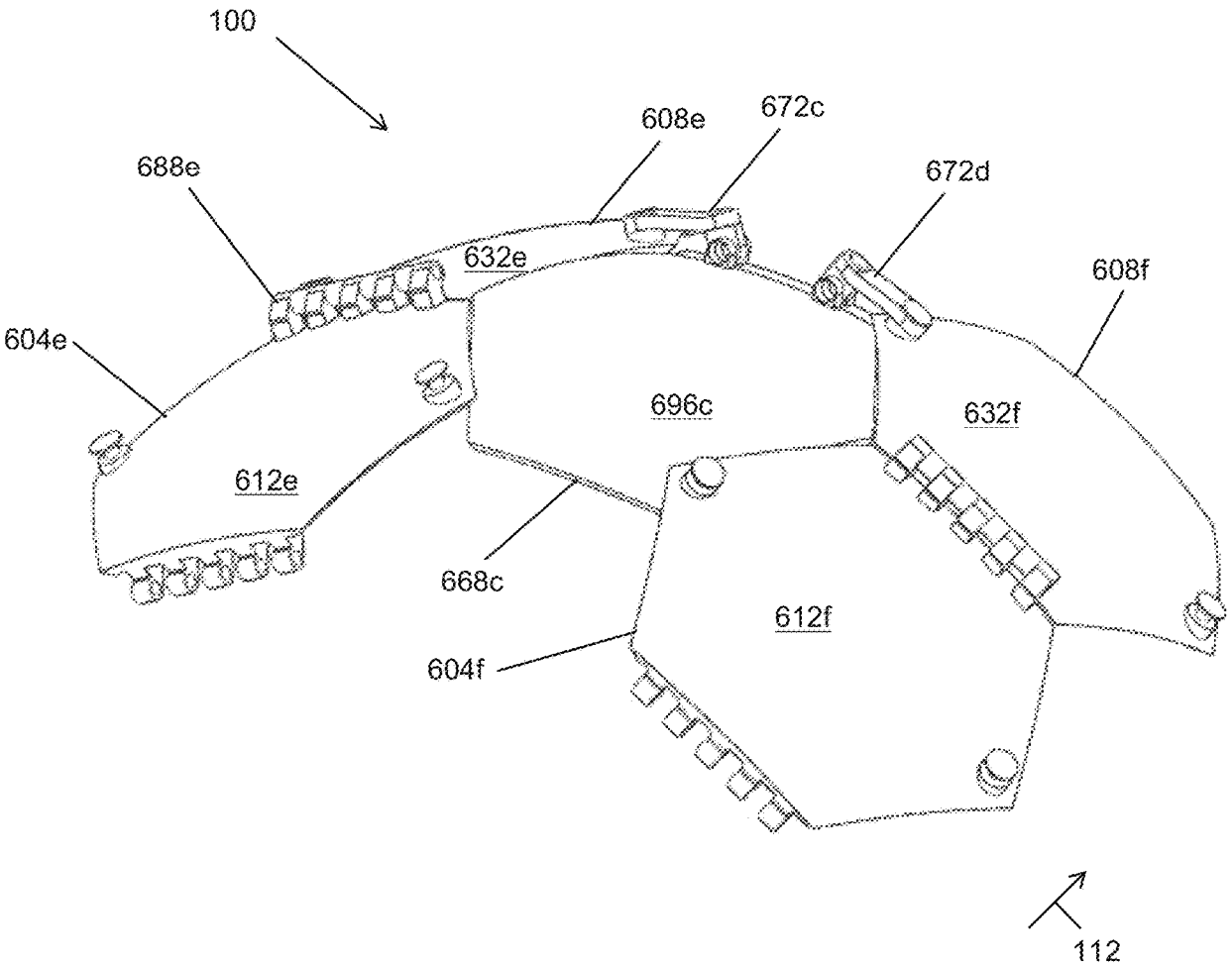
FIG. 16C is a perspective view of another example collapsible assembly in an extended configuration, in accordance with an embodiment.

Reference is briefly made to FIG. 16C, which illustrates a collapsible assembly 100' for a spherical structure. Collapsible assembly 100' of FIG. 16C is analogous to collapsible assembly 100 of FIG. 16A, with the exception that the primary cells used in the collapsible assembly 100' include connection elements as well.

Figure 17:
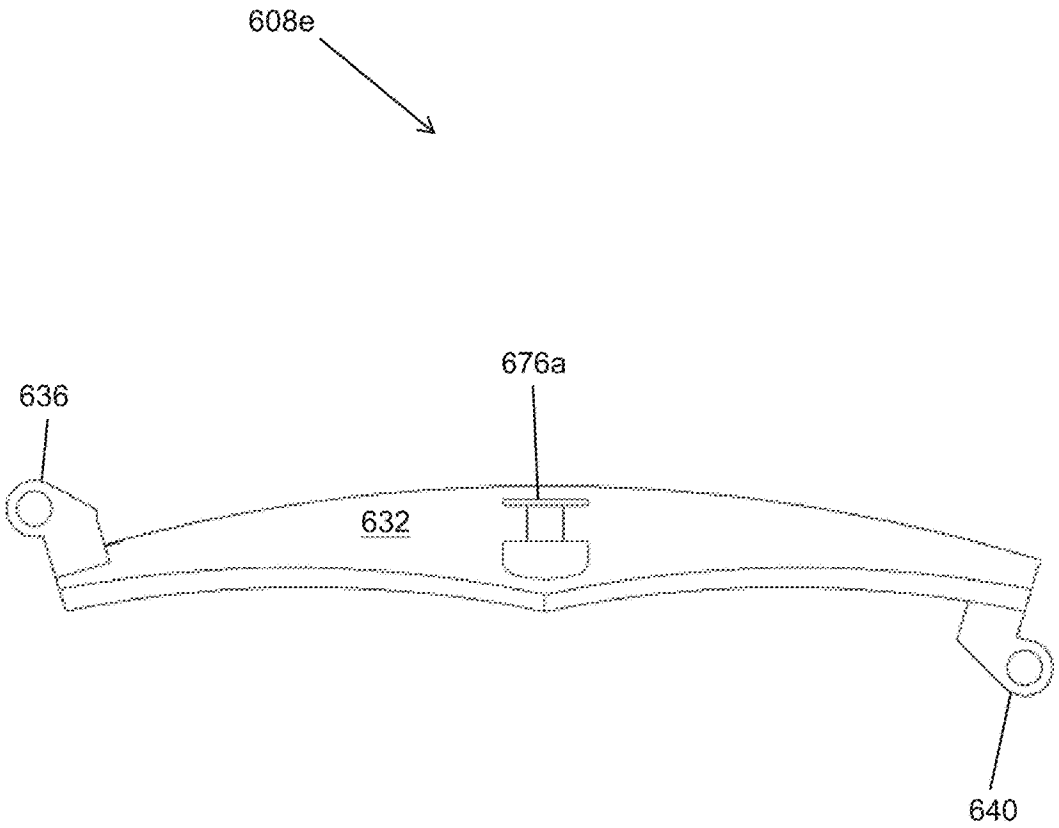
FIG. 17 is a side view of an example secondary cell of the example collapsible assembly of FIG. 16A.

Referring now to FIG. 17, shown therein is a side view of secondary cell 608*e*. As shown in FIG. 17, surface 632 of secondary cell 608*e* can be curved along two axes (compared with secondary cell 608 of FIG. 8C that is curved along one axis) corresponding to the curvature of the spherical structure.

Figure 18A:
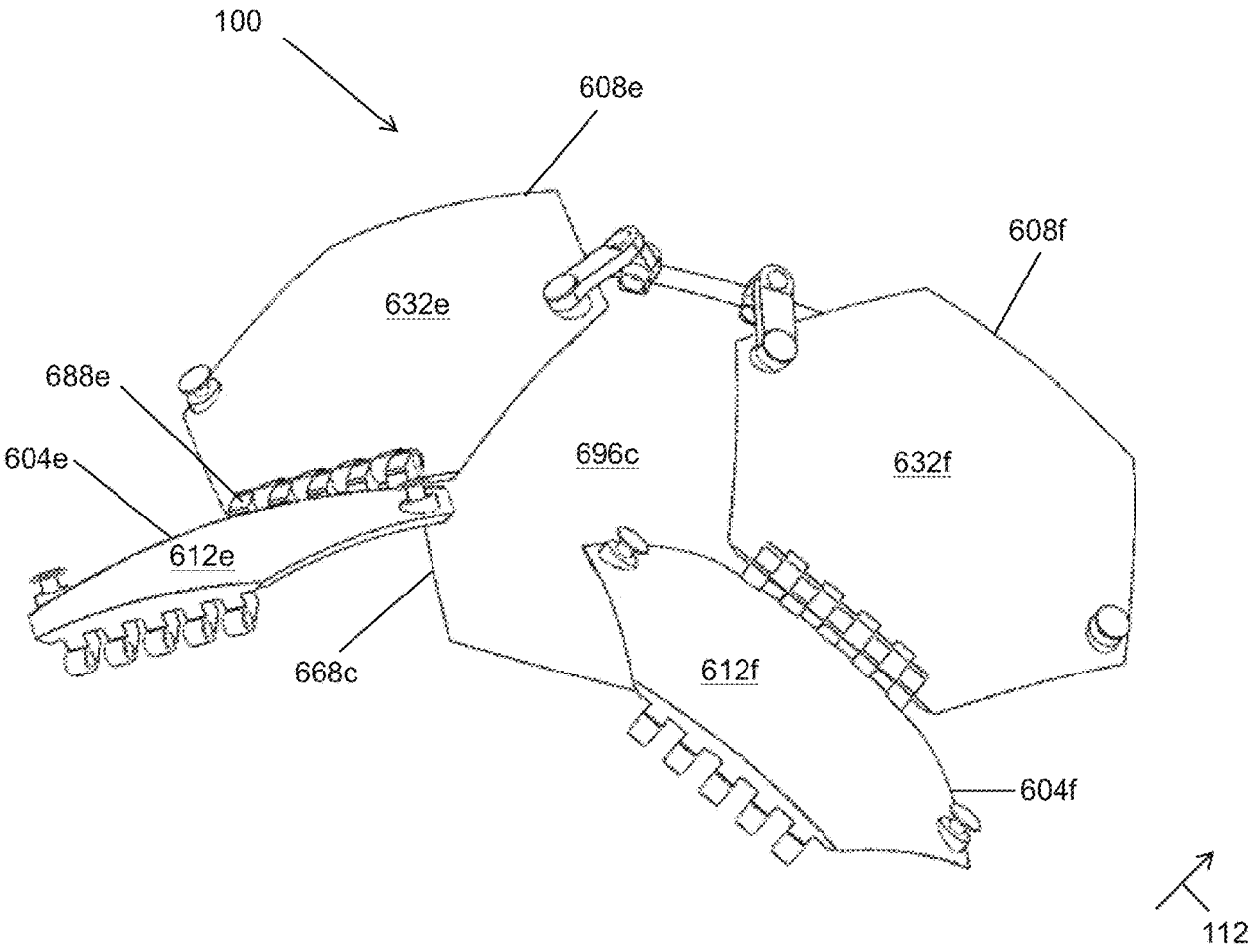
FIG. 18A is a perspective view of the example collapsible assembly of FIG. 16A in a partially collapsed configuration.
Figure 18B:
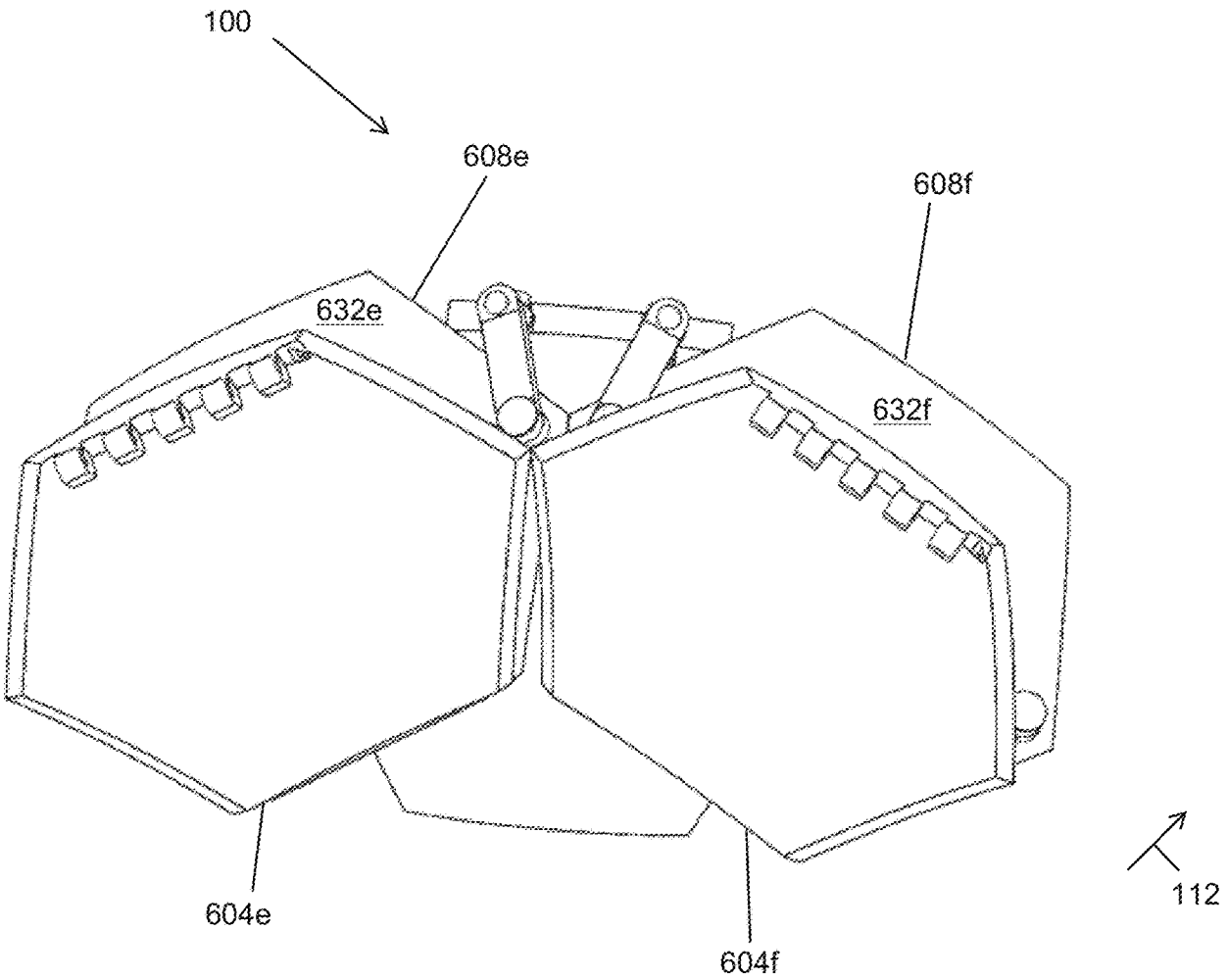
FIG. 18B is a perspective view of the example collapsible assembly of FIG. 16A in a fully collapsed configuration.

Referring now to FIGS. 18A and 18B, shown therein are perspective views of collapsible assembly 100 in a partially collapsed configuration and fully collapsed configuration respectively. As described herein above with reference to FIGS. 10A to 10F, when collapsible assembly 100 changes from the extended configuration to the fully collapsed configuration, the hinge connections between the primary cells and the secondary cells move in a corresponding direction causing movement of the corresponding primary and secondary cell surfaces from a first axis generally parallel to the collapsibility axis to a second axis generally perpendicular to the collapsibility axis. The coupling elements move in opposing directions causing movement of the intermediary cell surface from the first axis to the second axis such that the secondary cells fold above the intermediary cell.

Figure 19A:
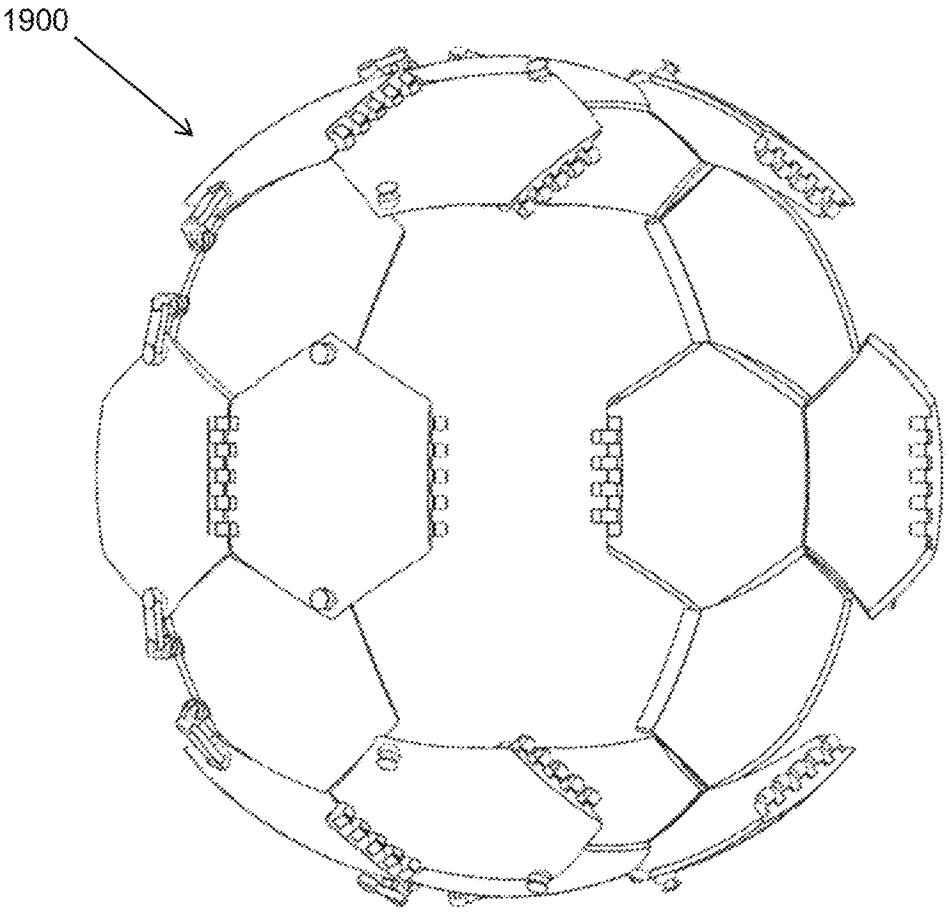
FIG. 19A is a perspective view of a spherical structure formed using multiple instances of the example collapsible assembly of FIG. 16A.
Figure 19B:
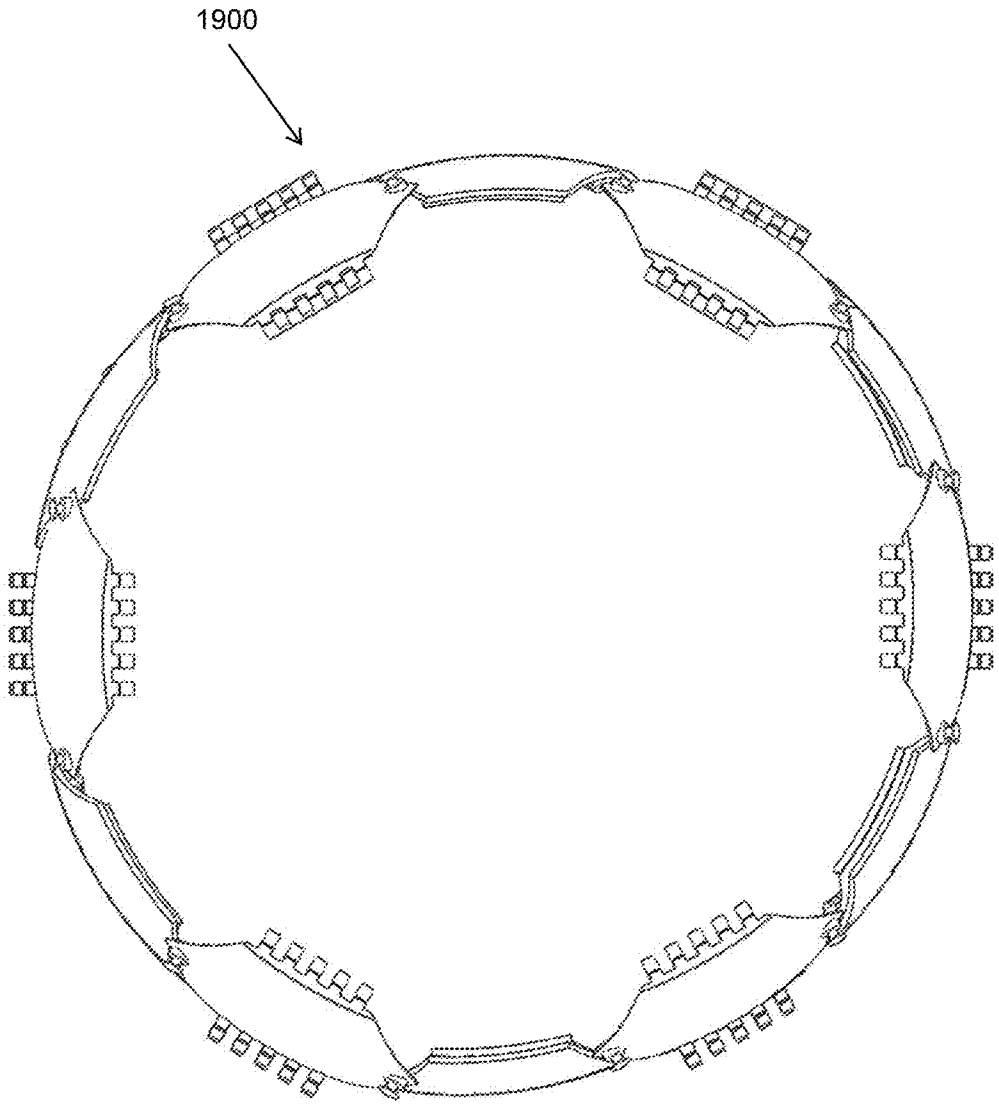
FIG. 19B is a side view of the spherical structure of FIG. 19A.

Referring now to FIGS. 19A and 19B, shown therein are a perspective view and a side view respectively of a spherical structure formed by arranging multiple instances of the collapsible assembly 100 of FIGS. 16 and 18 in multiple rows parallel to the collapsibility axis. Depending on the geometry and number of instances of collapsible assembly 100 and the geometry of the spherical structure, collapsible assembly 100 may cover small or large portions of the surface area of the spherical structure. Spherical structure 1900 may be used as a spherical endoskeleton structure to which an outer fabric layer may be attached. The outer fabric layer may provide a fully enclosed spherical structure.

Figure 20A:
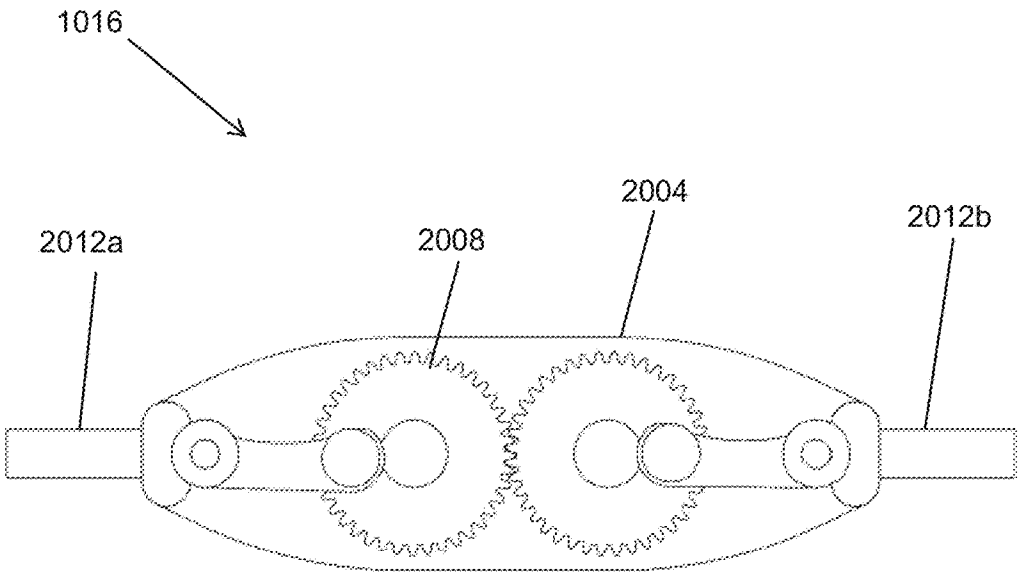
FIG. 20A is a top view of an example joint lock in a locked position, in accordance with an embodiment.
Figure 20B:
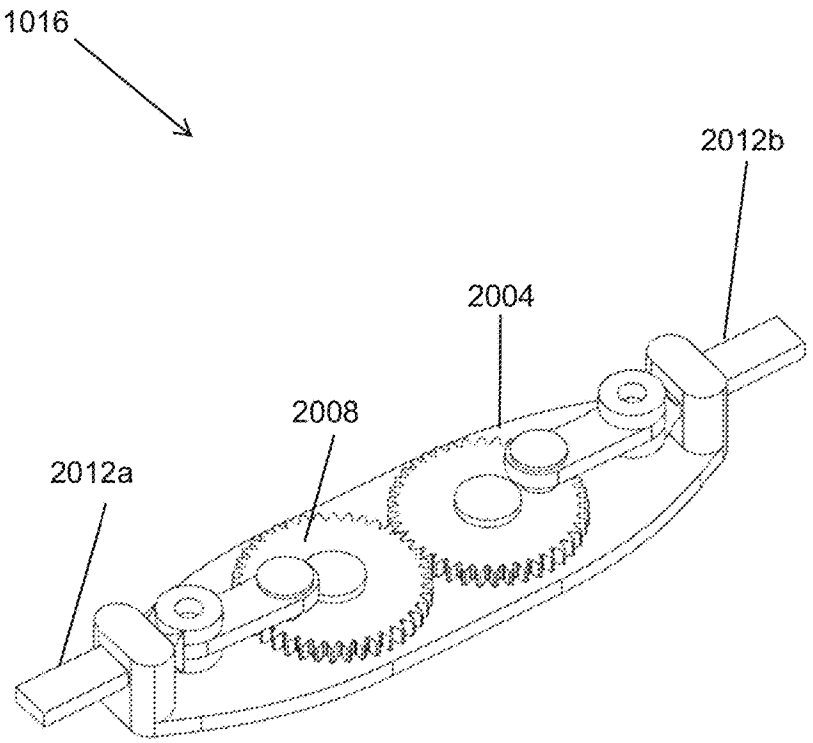
FIG. 20B is a perspective view of the example joint lock of FIG. 20A.
Figure 20C:
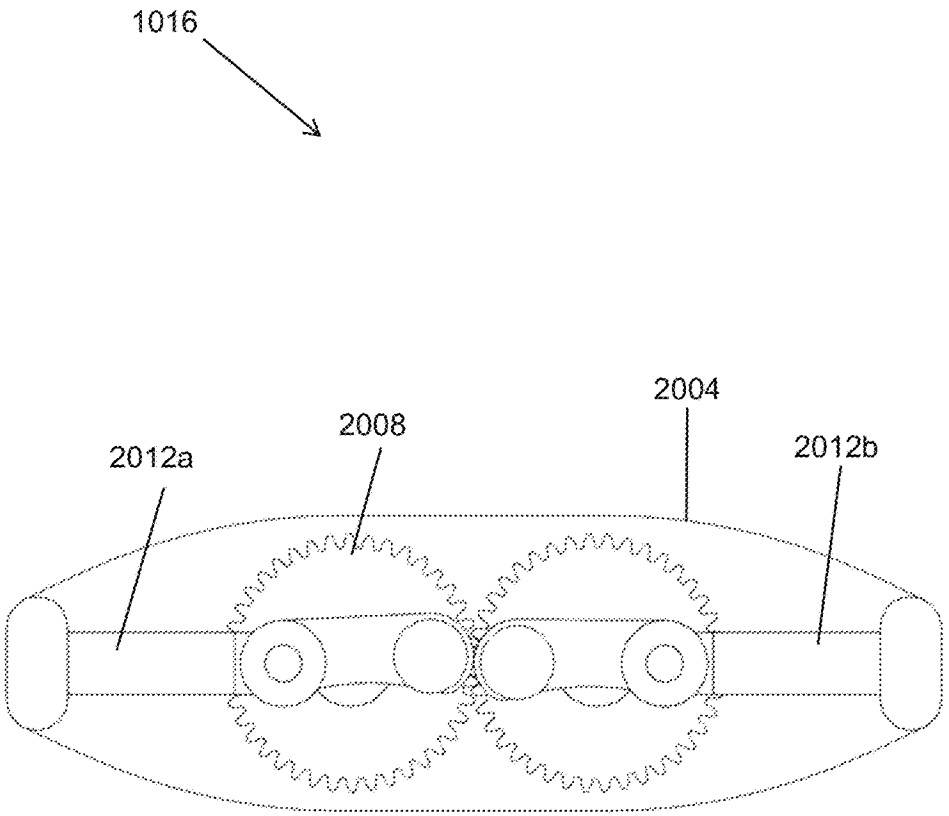
FIG. 20C is a top view of the example joint lock of FIG. 20A in an unlocked position.
Figure 20D:
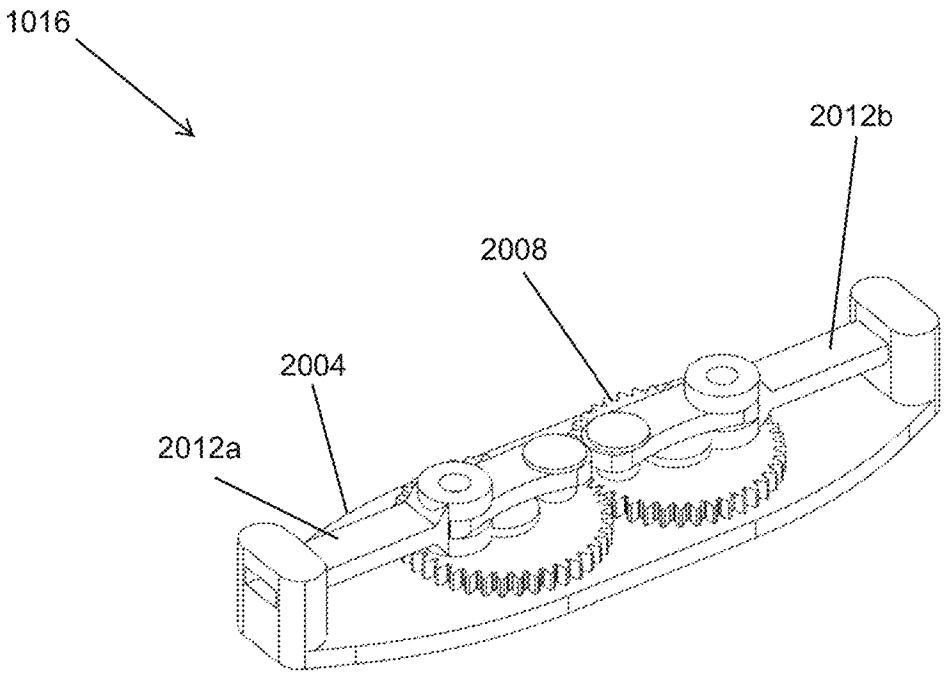
FIG. 20D is a perspective view of the example joint lock of FIG. 20C.

Referring now to FIGS. 20A to 20D, shown therein is an example embodiment of joint lock 1016. As described herein above with reference to FIG. 10A, joint lock 1016 may be used to provide locking operation for collapsible assembly 100. FIGS. 20A and 20B show a top view and a perspective view respectively of joint lock 1016 in a locked or extended position. FIGS. 20C and 20D show a top view and a perspective view respectively of joint lock 1016 in an unlocked or retracted position.

Joint lock 1016 can comprise an attachment plate 2004, a gear assembly 2008, and two locking elements 2012*a* and 2012*b*. A specific angular rotation of gear assembly 2008 can move locking elements 2012 between the locked and unlocked positions. The specific angular rotation for changing between the locked and unlocked positions can depend on the size of gear assembly 2008 and relative orientation of locking elements 2012. In some embodiments, joint lock 106 may include two linear actuators moving in opposite directions instead of gear assembly 2008 to move locking elements 2012 between the locked and unlocked positions.

Any electromechanical device may be used to operate joint lock 1016. For example, a motor including limits switches or a stepper motor can be used to actuate gear assembly 2008 to change between locked and unlocked positions. In some embodiments, control unit 128 may provide an electrical control signal to control the motor used to actuate gear assembly 2008.

Figure 21A:
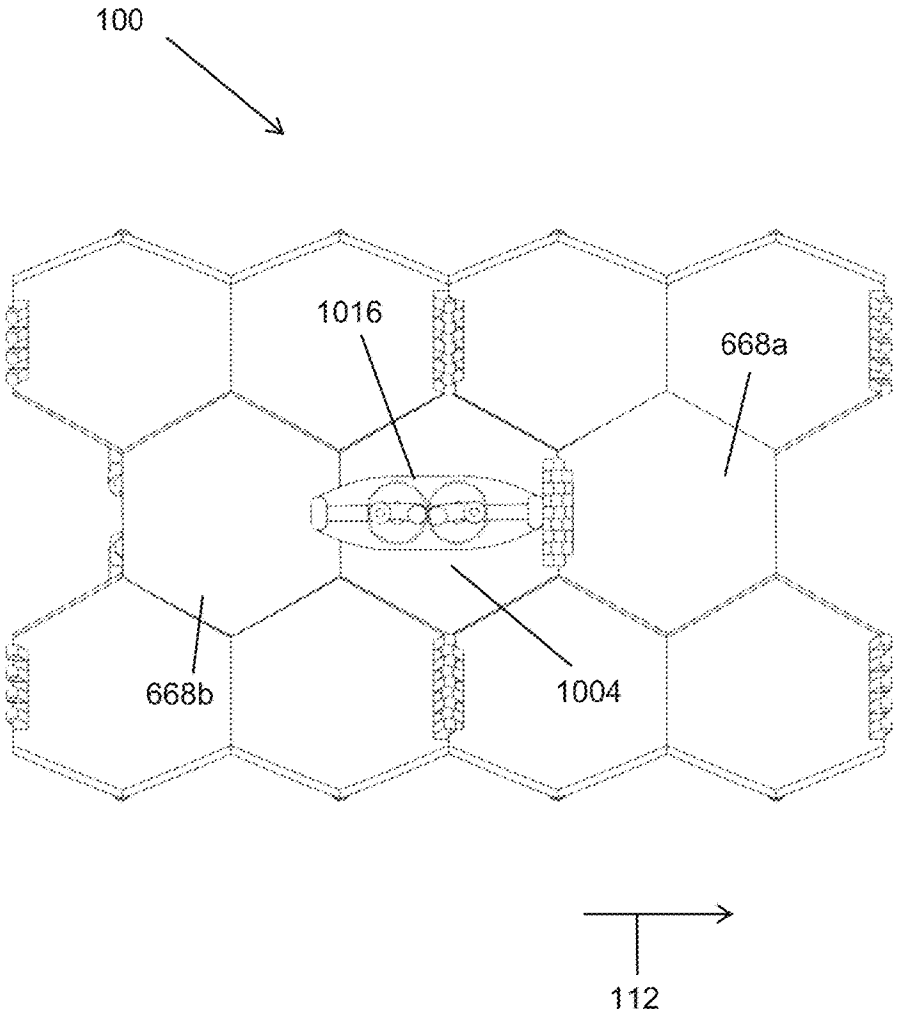
FIG. 21A is bottom view of an example collapsible assembly including the joint lock of FIG. 20 in unlocked position, in accordance with an embodiment.
Figure 21B:
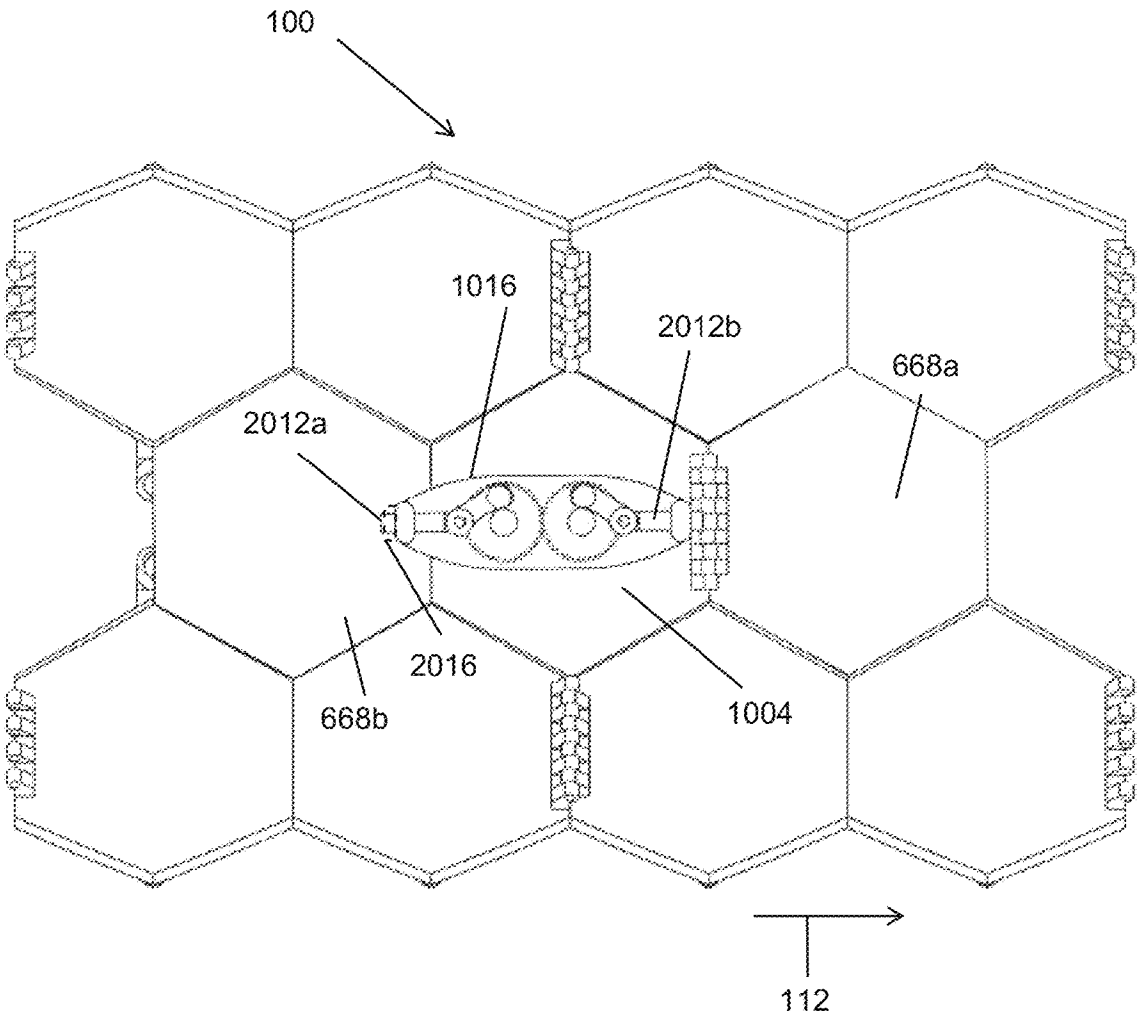
FIG. 21B is a bottom view of the example collapsible assembly of FIG. 21 with the joint lock in locked position.
Figure 21C:
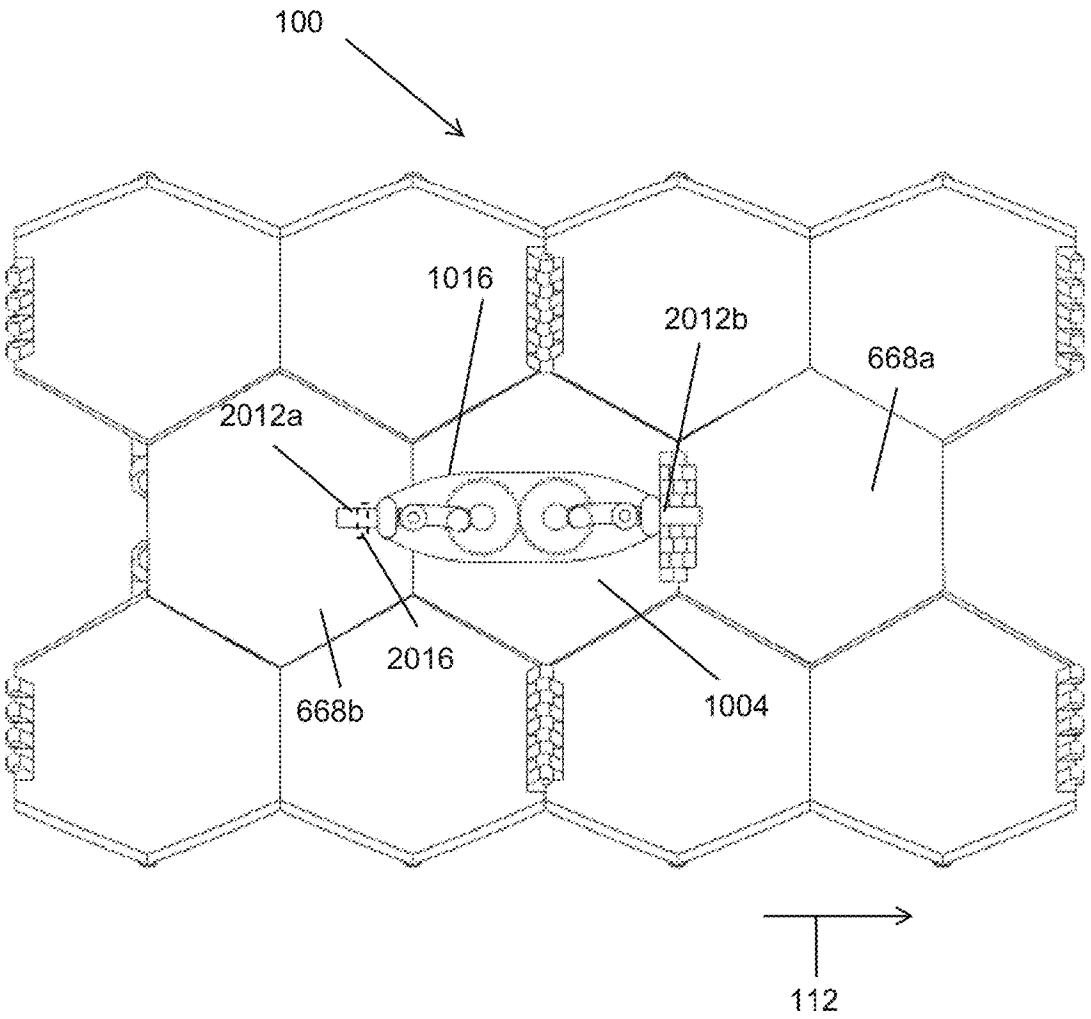
FIG. 21C is a bottom view of another example collapsible assembly of FIG. 21 with the joint lock in locked position.

Referring now to FIGS. 21A to 21C, shown therein is a collapsible assembly 100 (e.g., collapsible assembly 100 shown in FIG. 5) including joint lock 1016 attached to additional intermediary cell 1004. Joint lock 1016 may be attached to the opposing side of the additional intermediary cell surface. FIG. 21A shows joint lock 1016 in the unlocked position. FIG. 21B shows joint lock 1016 in the locked position. FIG. 21C shows another embodiment of joint lock 1016 in the locked position. Locking element 2012*a* can extend and prevent relative movement between intermediary cells 1004 and 668*b*. Locking element 2012*b* can extend and prevent relative movement between intermediary cells 1004 and 668*a*. Locking elements 2012 can be different lengths in different embodiments. For the example embodiment shown in FIG. 21C, locking elements 2012 can be longer (compared with the embodiment shown in FIG. 21B) to provide greater overlap of locking elements 2012 with neighboring intermediary cells 668*a* and 668*b*. In some embodiments, intermediary cells 668*a* and 668*b* may each include a hook element 2016 coupled to the opposing side of the intermediary cell surfaces. The hook element 2016 can be of any suitable design to allow the locking elements to slide through and provide locking mechanism.

Figure 22:
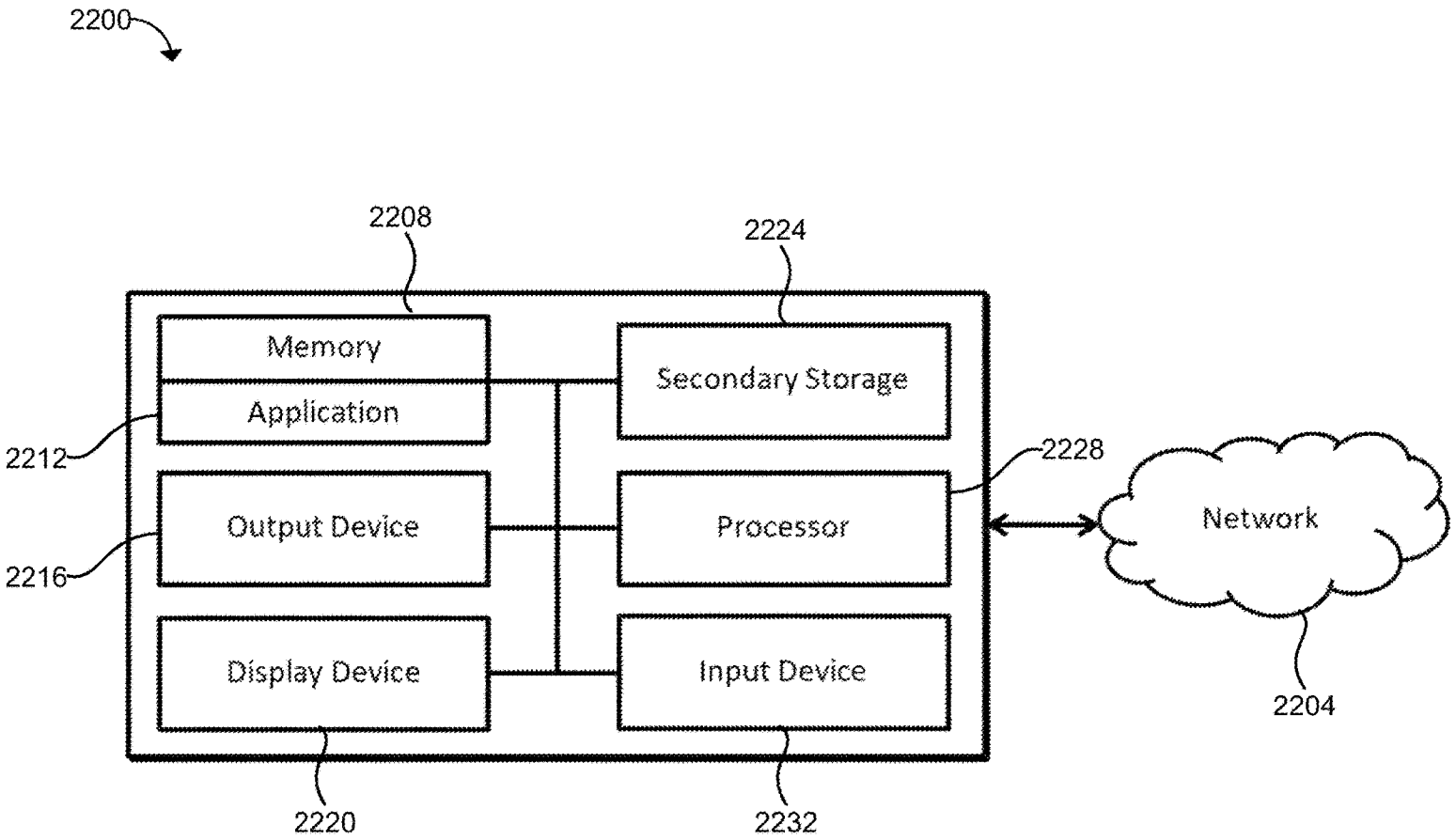
FIG. 22 is a schematic illustration of a device, in accordance with an embodiment.

Referring now to FIG. 22, shown therein is a schematic illustration of device 2200 that may represent the configuration of one or more of the elements of control unit 128 (shown in FIG. 1). Generally, device 2200 can be a server computer, desktop computer, notebook computer, tablet, PDA, smartphone, a PLC/special purpose device or another computing device. In at least one embodiment, device 2200 includes a connection with a network 2204 such as a wired or wireless connection to the Internet or to a private network. In some cases, network 2204 includes other types of computer or telecommunication networks.

In the example shown, device 2200 includes a memory 2208, an application 2212, an output device 2216, a display device 2220, a secondary storage device 2224, a processor 2228, and an input device 2232. In some embodiments, device 2200 includes multiple of any one or more of memory 2208, application 2212, output device 2216, display device 2220, secondary storage device 2224, processor 2228, and input device 2232. In some embodiments, device 2200 does not include one or more of applications 2212, secondary storage devices 2224, network connections, input devices 2232, output devices 2216, and display devices 2220.

Memory 2208 can include random access memory (RAM) or similar types of memory. Also, in some embodiments, memory 2208 stores one or more applications 2212 for execution by processor 2228. Applications 2212 correspond with software modules including computer executable instructions to perform processing for the functions and methods described herein. Secondary storage device 2224 can include a hard disk drive, floppy disk drive, CD drive, DVD drive, Blu-ray drive, solid state drive, flash memory or other types of non-volatile data storage.

In some embodiments, device 2200 stores information in a remote storage device, such as cloud storage, accessible across a network, such as network 2204 or another network. In some embodiments, device 2200 stores information distributed across multiple storage devices, such as memory 2208 and secondary storage device 2224 (i.e., each of the multiple storage devices stores a portion of the information and collectively the multiple storage devices store all of the information). Accordingly, storing data on a storage device as used herein and in the claims, means storing that data in a local storage device, storing that data in a remote storage device, or storing that data distributed across multiple storage devices, each of which can be local or remote.

Generally processor 2228 can execute applications, computer readable instructions or programs. The applications, computer readable instructions or programs can be stored in memory 2208 or in secondary storage 2224, or can be received from remote storage accessible through network 2204, for example. When executed, the applications, computer readable instructions or programs can configure the processor 2228 (or multiple processors 2228, collectively) to perform the acts described herein with reference to control unit 128, for example.

Input device 2232 can include any device for entering information into device 2200. For example, input device 2232 can be a keyboard, keypad, cursor-device, touchscreen, camera, or microphone. Input device 2232 can also include input ports and wireless radios (e.g., Bluetooth®, or 802.11x) for making wired and wireless connections to external devices.

Display device 2220 can include any type of device for presenting visual information. For example, display device 2220 can be a computer monitor, a flat-screen display, a projector or a display panel.

Output device 2216 can include any type of device for presenting a hard copy of information, such as a printer for example. Output device 2216 can also include other types of output devices such as speakers, for example. In at least one embodiment, output device 2216 includes one or more of output ports and wireless radios (e.g., Bluetooth®, or 802.11x) for making wired and wireless connections to external devices.

FIG. 22 illustrates one example hardware schematic of a device 2200. In alternative embodiments, device 2200 contains fewer, additional or different components. In addition, although aspects of an implementation of device 2200 are described as being stored in memory, one skilled in the art will appreciate that these aspects can also be stored on or read from other types of computer program products or computer-readable media, such as secondary storage devices, including hard disks, floppy disks, CDs, or DVDs; a carrier wave from the Internet or other network; or other forms of RAM or ROM.

Figure 23:
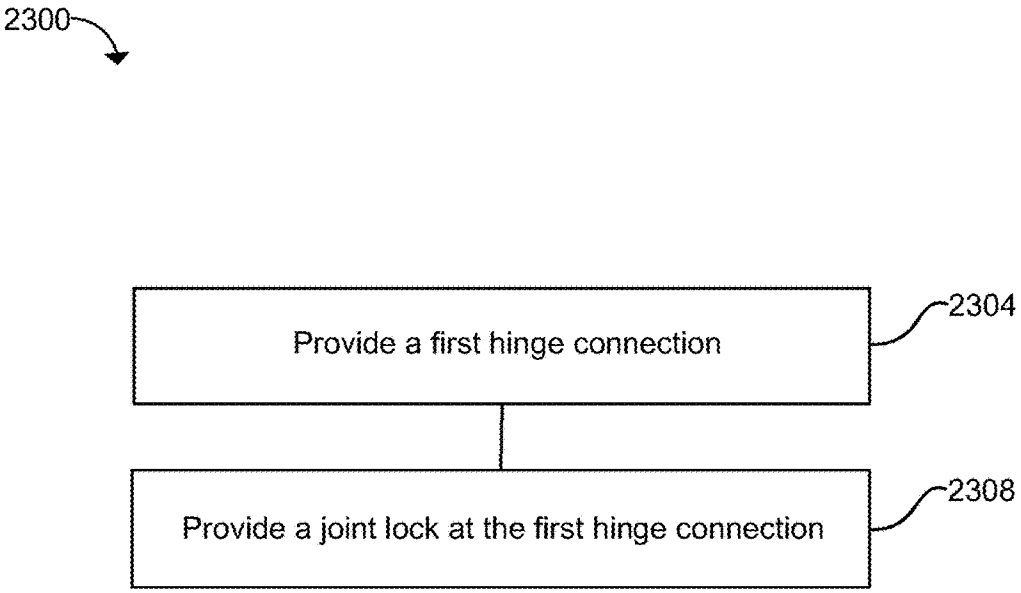
FIG. 23 is a flowchart illustrating an example method of manufacturing a collapsible assembly, in accordance with an embodiment.

Referring now to FIG. 23, shown therein a flowchart illustrating an example method 2300 of manufacturing a collapsible assembly that can move between an extended configuration and a collapsed configuration along a collapsibility axis. For example, method 2300 may be executed for manufacturing a collapsible assembly 100 in accordance with embodiments shown in FIGS. 5A to 5G.

At step 2304, a first hinge connection may be provided between the first primary cell hinge element and the first secondary cell hinge element. For example, hinge connection 252*a* between the first primary cell hinge element of primary cell 204*a* and the first secondary cell hinge element of secondary cell 208*a*. As described herein above with reference to FIGS. 5A to 5G, when the collapsible assembly changes from the extended configuration to the collapsed configuration, the first hinge connection moves in a corresponding direction causing movement of the primary cell surface of the first primary cell and the secondary cell surface of the first secondary cell from a first axis generally parallel to the collapsibility axis to a second axis generally perpendicular to the collapsibility axis to reduce a surface area of the collapsible assembly.

At step 2308, a joint lock may be provided at the first hinge connection. For example, joint lock 256 may be provided at hinge connection 252*a*. As described herein above with reference to FIGS. 5A to 5G, the joint lock can be configured to control the movement of the primary cell surface and the secondary cell surface from the first axis to the second axis.

Figure 24:
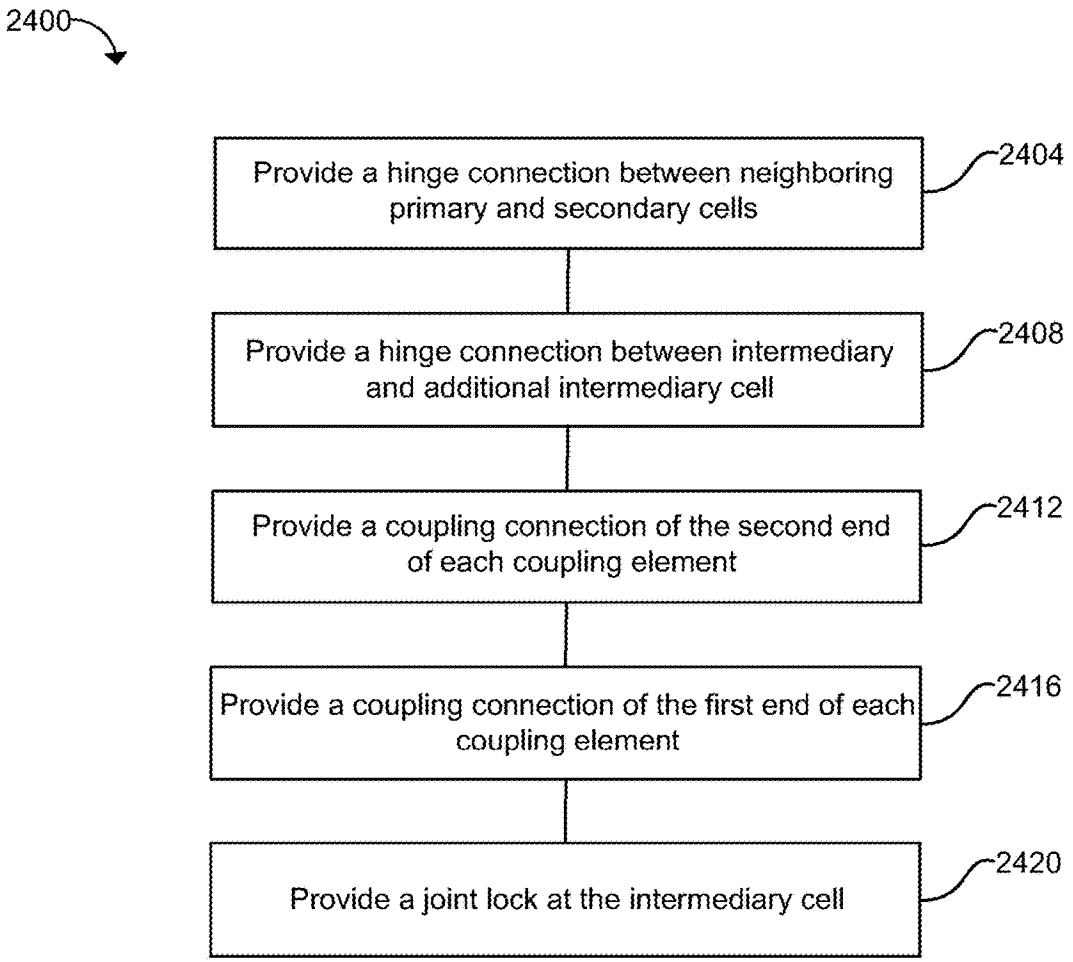
FIG. 24 is a flowchart illustrating an example method of manufacturing a collapsible assembly, in accordance with an embodiment.

Referring now to FIG. 24, shown therein a flowchart illustrating an example method 2400 of manufacturing a collapsible assembly that can move between an extended configuration and a collapsed configuration along a collapsibility axis. For example, method 2400 may be executed for manufacturing a collapsible assembly 100 in accordance with embodiments shown in FIGS. 10A to 10F.

At step 2404, a hinge connection may be provided between neighboring primary and secondary cells. For example, as shown in FIG. 10A, hinge connection 688*a* may be provided between primary cell 604*a* and secondary cell 608*a*. When the collapsible assembly changes from the extended configuration to the collapsed configuration, the hinge connection can move in a corresponding direction causing movement of the primary cell surface 612*a* and the secondary cell surface 632*a* from a first axis generally parallel to the collapsibility axis to a second axis generally perpendicular to the collapsibility axis to reduce a surface area of the collapsible assembly.

At step 2408, a hinge connection may be provided between an intermediary cell and an additional intermediary cell. For example, as shown in FIG. 10A, hinge connection 1008*a* may be provided between intermediary cell 668*b* and additional intermediary cell 1004. When the collapsible assembly changes from the extended configuration to the collapsed configuration, the hinge connection can move in a corresponding direction causing movement of the intermediary cell surface 696*b* and the additional intermediary cell surface 1006 from a first axis generally parallel to the collapsibility axis to a second axis generally perpendicular to the collapsibility axis to reduce a surface area of the collapsible assembly.

At step 2412, a coupling connection of the second end of each of the two coupling elements with the corresponding proximate secondary cell connection element may be provided. For example, a coupling connection of the second end of coupling elements 672*a* with the corresponding proximate secondary cell connection element of secondary cell 608*a* may be provided.

At step 2416, a coupling connection of the first end of each of the two coupling elements with corresponding intermediary cell connection element may be provided. For example, a coupling connection of the first end of coupling element 672*a* with corresponding intermediary cell connection element of intermediary cell 668*a* may be provided. As described herein above with reference to FIGS. 10A to 10F, when the collapsible assembly moves from the extended configuration to the collapsed configuration, the hinge connection for each peripheral unit assembly moves in a corresponding direction causing movement of the corresponding primary cell surface and the secondary cell surface from a first axis generally parallel to the collapsibility axis to a second axis generally perpendicular to the collapsibility axis, and the two coupling elements move in opposing directions causing movement of the intermediary cell surface from the first axis to the second axis such that the secondary cells of the two peripheral unit assemblies fold above the intermediary cell.

At step 2420, a joint lock position may be provided at the intermediary cell. For example, a joint lock position may be provided at intermediary cell 1004. As described herein above with reference to FIGS. 10A to 10F, the joint lock can be being configured to control movement of the intermediary cell surface from the first axis to the second axis.

Figure 25:
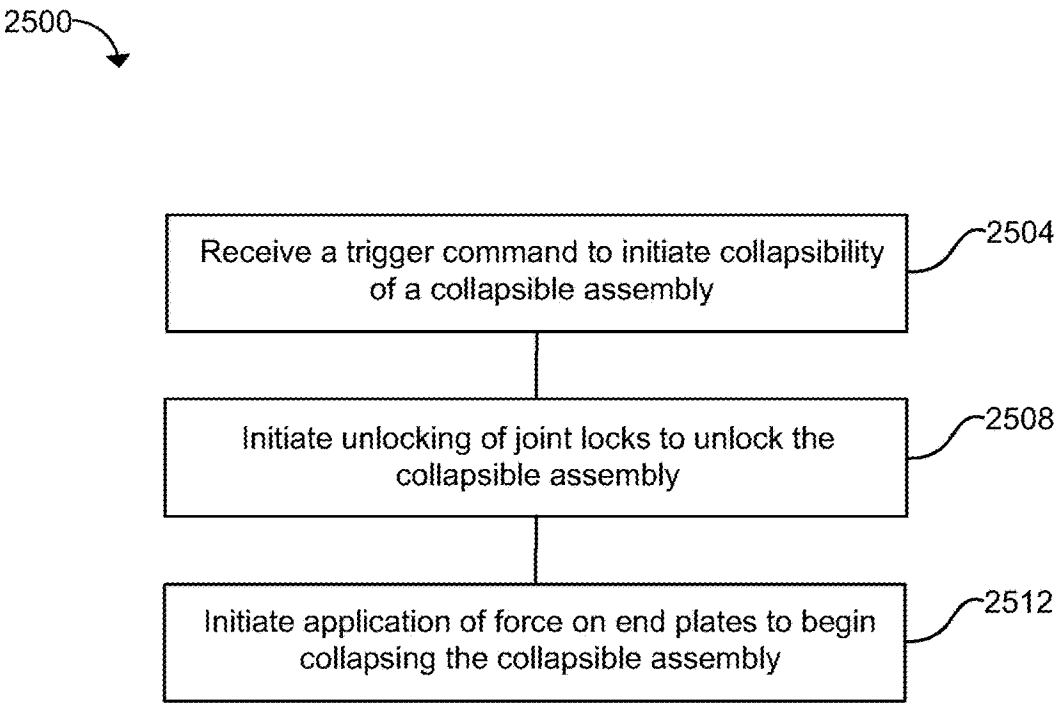
FIG. 25 is a flowchart illustrating an example method of controlling the collapsible movement of a collapsible assembly, in accordance with an embodiment.

Referring now to FIG. 25, shown therein a flowchart illustrating an example method 2500 of controlling the collapsible movement of a collapsible assembly that can move between an extended configuration and a collapsed configuration along a collapsibility axis. For example, method 2500 may be executed by control unit 128 shown in FIG. 1. The collapsible assembly may move between an extended configuration and a collapsed configuration as described herein with reference to FIGS. 5A to 5G and FIGS. 10A to 10F.

At step 2504, control unit 128 may receive a trigger command to initiate collapsibility of collapsible assembly 100. In some embodiments, the trigger command may be a human or operator-provided trigger. For example, in space exploration applications, the trigger command may be a trigger command provided by an astronaut. In some embodiments, the trigger command may be provided from a location remote from the location of control unit 128 and/or collapsible assembly 100. For example, the trigger command may be provided by space control from Earth or any other remote location.

At step 2508, unlocking of joint locks of the collapsible assembly may be initiated to unlock the collapsible movement of the collapsible assembly. For example, control unit 128 may initiate unlocking of joint lock 256 (shown in FIG. 5A) or joint lock 1016 (shown in FIG. 10A). The unlocking of the joint lock can unlock the collapsible movement of collapsible assembly 100, for example, as described herein with reference to FIGS. 21A and 21B.

At step 2512, application of force on end plates may be initiated to begin collapsing the collapsible assembly. For example, control unit 128 may initiate application of force on end plates 124 (shown in FIGS. 5A to 5G and FIGS. 10A to 10F). The application of the force may cause hinge connections between various cells (e.g., hinge connections 252, 688, and 1002 between primary cells and secondary cells, and hinge connections 1008 between intermediary cells) to start moving in corresponding directions, such that adjacent hinge connections move in opposing directions. This can cause folding of corresponding cell surfaces in a direction generally perpendicular to the collapsibility axis. In embodiments that include intermediary cells, the application of the force may also cause folding of secondary cells connected to an intermediary cell to fold above that intermediary cell. The movement of the cell surfaces caused the collapsible assembly to ultimately collapse into the fully collapsed configuration.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

CLAUSES

Clause 1: A collapsible assembly configured to change, along a collapsibility axis, between an extended configuration and a collapsed configuration, the collapsible assembly comprising: a first primary cell comprising: a corresponding primary cell surface; and a corresponding first primary cell hinge element coupled to the primary cell surface along a first primary cell edge; and a first secondary cell comprising: a corresponding secondary cell surface; a corresponding first secondary cell hinge element coupled to the secondary cell surface along a first secondary cell edge, wherein the first secondary cell hinge element is complementary to the first primary cell hinge element; wherein the first primary cell hinge element and the first secondary cell hinge element are coupled to provide a first hinge connection, and wherein, when the collapsible assembly changes from the extended configuration to the collapsed configuration, the first hinge connection moves in a corresponding direction causing movement of the primary cell surface of the first primary cell and the secondary cell surface of the first secondary cell from a first axis generally parallel to the collapsibility axis to a second axis generally perpendicular to the collapsibility axis to reduce a surface area of the collapsible assembly.

Clause 2: The collapsible assembly of any of the above clauses, wherein the first primary cell further comprises a corresponding second primary cell hinge element coupled to the primary cell surface along a second primary cell edge, the first primary cell edge and the second primary cell edge being opposing edges of the primary cell surface of the first primary cell.

Clause 3: The collapsible assembly of any of the above clauses, wherein the first secondary cell further comprises a corresponding second secondary cell hinge element coupled to the secondary cell surface along a second secondary cell edge, the first secondary cell edge and the second secondary cell edge being opposing edges of the secondary cell surface of the first secondary cell, and the second secondary cell hinge element being complementary to the second primary cell hinge element.

Clause 4: The collapsible assembly of any of the above clauses further comprising a second primary cell, wherein a corresponding second primary cell hinge element of the second primary cell and the second secondary cell hinge element of the first secondary cell are coupled to provide a second hinge connection; and wherein, when the collapsible assembly changes from the extended configuration to the collapsed configuration, the second hinge connection moves in a direction opposite to the direction of the first hinge connection, causing movement of a corresponding primary cell surface of the second primary cell from the first axis to the second axis.

Clause 5: The collapsible assembly of any of the above clauses, wherein the collapsible assembly comprises multiple primary cells and multiple secondary cells arranged alternatingly in a row along the collapsibility axis forming corresponding hinge connections between neighboring primary cells and secondary cells; and wherein, when the collapsible assembly changes from the extended configuration to the collapsed configuration, the alternating hinge connections move in the same corresponding direction causing movement of the surfaces of the multiple primary and secondary cells from the first axis to the second axis.

Clause 6: The collapsible assembly of any of the above clauses, wherein the movement of the alternating hinge connections provides an accordion style movement of the collapsible assembly.

Clause 7: The collapsible assembly of any of the above clauses, wherein the collapsible assembly further comprises a second row comprising multiple primary cells and multiple secondary cells arranged alternatingly along the collapsibility axis, the second row being parallel to the first row and separated from the first row by an intermediary distance.

Clause 8: The collapsible assembly of any of the above clauses, wherein the corresponding surfaces of the first primary cell and the first secondary cell are hexagonal in shape.

Clause 9: The collapsible assembly of any of the above clauses further comprising a joint lock at the first hinge connection.

Clause 10: A collapsible assembly configured to change, along a collapsibility axis, between an extended configuration and a collapsed configuration, the collapsible assembly comprising: two symmetrical peripheral unit assemblies separated from each other by an intermediary distance and being arranged in parallel rows along the collapsibility axis, each peripheral unit assembly comprising: a primary cell comprising: a primary cell surface; and a first primary cell hinge element coupled to the primary cell surface along a first primary cell edge; and a secondary cell comprising: a secondary cell surface; a first secondary cell hinge element coupled to the secondary cell surface along a first secondary cell edge, wherein the first secondary cell hinge element is complementary to the first primary cell hinge element, and wherein the first secondary cell hinge element connects with the first primary cell hinge element to form a hinge connection; and at least one secondary cell connection element coupled to the secondary cell surface, the secondary cell connection element being offset from the hinge connection; an intermediary cell positioned within the two peripheral unit assemblies, the intermediary cell comprising: an intermediary cell surface provided within the two peripheral unit assemblies such that the intermediary cell surface extends between at least a portion of side edges of the primary and the secondary cells of each peripheral unit assembly when the collapsible assembly is in the extended configuration, and wherein the intermediary cell surface is offset from the secondary cell surfaces of the secondary cells of the peripheral unit assemblies as the collapsible assembly changes from the extended configuration to the collapsed configuration; and two intermediary cell connection elements coupled to the intermediary cell surface along a first intermediary cell edge and each proximate to a secondary cell connection element of a corresponding secondary cell of each peripheral unit assembly; and two coupling elements, each coupling element comprising: a first end complementary to an intermediary cell connection element; and a second end complementary to the corresponding proximate secondary cell connection element; wherein when the collapsible assembly changes from the extended configuration to the collapsed configuration: the hinge connection for each peripheral unit assembly moves in a corresponding direction causing movement of the corresponding primary cell surface and the secondary cell surface from a first axis generally parallel to the collapsibility axis to a second axis generally perpendicular to the collapsibility axis, and the two coupling elements move in opposing directions causing movement of the intermediary cell surface from the first axis to the second axis such that the secondary cells of the two peripheral unit assemblies fold above the intermediary cell.

Clause 11: The collapsible assembly of any of the above clauses, wherein the primary cell further comprises a second primary cell hinge element coupled to the primary cell surface along a second primary cell edge, the first primary cell edge and the second primary cell edge being opposing edges of the primary cell surface.

Clause 12: The collapsible assembly of any of the above clauses, wherein the secondary cell further comprises a second secondary cell hinge element coupled to the secondary cell surface along a second secondary cell edge, the first secondary cell edge and the second secondary cell edge being opposing edges of the secondary cell surface, and the second secondary cell hinge element being complementary to the second primary cell hinge element.

Clause 13: The collapsible assembly of any of the above clauses, wherein the collapsible assembly further comprises an additional primary cell, wherein a second primary cell hinge element of the additional primary cell and the second secondary cell hinge element are coupled to provide a second hinge connection; and wherein, when the collapsible assembly changes from the extended configuration to the collapsed configuration, the second hinge connection moves in a direction opposite to the direction of the first hinge connection causing movement of a primary cell surface of the additional primary cell from the first axis to the second axis.

Clause 14: A collapsible structure comprising: at least two collapsible cell assemblies of clause 10 arranged in a row along the collapsibility axis forming corresponding hinge connections between neighboring primary cells and secondary cells; wherein, when the collapsible structure collapses along the collapsibility axis, the alternating hinge connections between neighboring primary cells and secondary cells move in the same corresponding direction causing movement of the surfaces of the multiple primary and secondary cells from the first axis to the second axis.

Clause 15: The collapsible structure of any of the above clauses further comprising at least one additional intermediary cell connecting the intermediary cells of neighboring collapsible assemblies along the collapsibility axis.

Clause 16: The collapsible structure of any of the above clauses, wherein the intermediary cell further comprises an intermediary cell hinge element coupled to the intermediary cell surface along a second intermediary cell edge, the first intermediary cell edge and the second intermediary cell edge being opposing edges of the intermediary cell surface.

Clause 17: The collapsible structure of any of the above clauses, wherein the movement of the alternating hinge connections provides an accordion style movement of the collapsible structure.

Clause 18: The collapsible structure of any of the above clauses, wherein multiple instances of the collapsible assembly of clause 10 are arranged in multiple rows parallel to the collapsibility axis forming a cylindrical structure.

Clause 19: The collapsible structure of any of the above clauses, wherein multiple instances of the collapsible assembly of clause 10 are arranged in multiple rows parallel to the collapsibility axis forming a spherical structure.

Clause 20: The collapsible assembly of any of the above clauses, wherein the primary cell surface, the secondary cell surface and the intermediary cell surface are hexagonal in shape.

Clause 21: The collapsible assembly of any of the above clauses further comprising a joint lock positioned at the intermediary cell, the joint lock being configured to control the movement of the intermediary cell surface from the first axis to the second axis.

Clause 22: The collapsible assembly of any of the above clauses, wherein the second end of each of the two coupling elements forms a two-dimensional hinge connection with the corresponding proximate secondary cell connection element; and the first end of each of the two coupling elements forms a ball and socket joint with corresponding intermediary cell connection element.

Clause 23: The collapsible assembly of any of the above clauses, wherein the secondary cell further includes a fabric plate coupled to the secondary cell surface, wherein the fabric plate is attached to a fabric layer.

Clause 24: A method of manufacturing a collapsible assembly configured to change between an extended configuration and a collapsed configuration along a collapsibility axis, wherein the collapsible assembly comprises: a first primary cell comprising: a corresponding primary cell surface; and a corresponding first primary cell hinge element coupled to the primary cell surface along a first primary cell edge; and a first secondary cell comprising: a corresponding secondary cell surface; a corresponding first secondary cell hinge element coupled to the secondary cell surface along a first secondary cell edge, wherein the first secondary cell hinge element is complementary to the first primary cell hinge element, wherein the method comprises: providing a first hinge connection between the first primary cell hinge element and the first secondary cell hinge element, wherein, when the collapsible assembly changes from the extended configuration to the collapsed configuration, the first hinge connection moves in a corresponding direction causing movement of the primary cell surface of the first primary cell and the secondary cell surface of the first secondary cell from a first axis generally parallel to the collapsibility axis to a second axis generally perpendicular to the collapsibility axis to reduce a surface area of the collapsible assembly; and providing a joint lock at the first hinge connection, the joint lock configured to control the movement of the primary cell surface and the secondary cell surface from the first axis to the second axis.

Clause 25: The method of any of the above clauses, wherein the first primary cell further comprises a corresponding second primary cell hinge element coupled to the primary cell surface along a second primary cell edge, the first primary cell edge and the second primary cell edge being opposing edges of the primary cell surface of the first primary cell.

Clause 26: The method of any of the above clauses, wherein the first secondary cell further comprises a corresponding second secondary cell hinge element coupled to the secondary cell surface along a second secondary cell edge, the first secondary cell edge and the second secondary cell edge being opposing edges of the secondary cell surface of the first secondary cell, and the second secondary cell hinge element being complementary to the second primary cell hinge element.

Clause 27: The method of any of the above clauses, wherein the collapsible assembly further comprises a second primary cell and the method further comprises providing a second hinge connection between a corresponding second primary cell hinge element of the second primary cell and the second secondary cell hinge element of the first secondary cell; and wherein, when the collapsible assembly changes from the extended configuration to the collapsed configuration, the second hinge connection moves in a direction opposite to the direction of the first hinge connection, causing movement of a corresponding primary cell surface of the second primary cell from the first axis to the second axis.

Clause 28: The method of any of the above clauses, wherein the collapsible assembly comprises multiple primary cells and multiple secondary cells arranged alternatingly in a row along the collapsibility axis and the method further comprises providing corresponding hinge connections between neighboring primary cells and secondary cells; and wherein, when the collapsible assembly changes from the extended configuration to the collapsed configuration, the alternating hinge connections move in the same corresponding direction causing movement of the surfaces of the multiple primary and secondary cells from the first axis to the second axis.

Clause 29: The method of any of the above clauses, wherein the movement of the alternating hinge connections provides an accordion style movement of the collapsible assembly.

Clause 30: The method of any of the above clauses, wherein the collapsible assembly further comprises a second row comprising multiple primary cells and multiple secondary cells arranged alternatingly along the collapsibility axis, the second row being parallel to the first row and separated from the first row by an intermediary distance.

Clause 31: The method of any of the above clauses, wherein the corresponding surfaces of the first primary cell and the first secondary cell are hexagonal in shape.

Clause 32: A method of manufacturing a collapsible assembly configured to change between an extended configuration and a collapsed configuration along a collapsibility axis, wherein the collapsible assembly comprises: two symmetrical peripheral unit assemblies separated from each other by an intermediary distance and being arranged in parallel rows along the collapsibility axis, each peripheral unit assembly comprising: a primary cell comprising: a primary cell surface; and a first primary cell hinge element coupled to the primary cell surface along a first primary cell edge; and a secondary cell comprising: a secondary cell surface; a first secondary cell hinge element coupled to the secondary cell surface along a first secondary cell edge, wherein the first secondary cell hinge element is complementary to the first primary cell hinge element, and wherein the first secondary cell hinge element connects with the first primary cell hinge element to form a hinge connection; and at least one secondary cell connection element coupled to the secondary cell surface, the secondary cell connection element being offset from the hinge connection; an intermediary cell positioned within the two peripheral unit assemblies, the intermediary cell comprising: an intermediary cell surface provided within the two peripheral unit assemblies such that the intermediary cell surface extends between at least a portion of side edges of the primary and the secondary cells of each peripheral unit assembly when the collapsible assembly is in the extended configuration, and wherein the intermediary cell surface is offset from the secondary cell surfaces of the secondary cells of the peripheral unit assemblies as the collapsible assembly changes from the extended configuration to the collapsed configuration; and two intermediary cell connection elements coupled to the intermediary cell surface along a first intermediary cell edge and each proximate to a secondary cell connection element of a corresponding secondary cell of each peripheral unit assembly; and two coupling elements, each coupling element comprising: a first end complementary to an intermediary cell connection element; and a second end complementary to the corresponding proximate secondary cell connection element, wherein the method comprises: providing a coupling connection of the second end of each of the two coupling elements with the corresponding proximate secondary cell connection element; providing a coupling connection of the first end of each of the two coupling elements with corresponding intermediary cell connection element, wherein when the collapsible assembly moves from the extended configuration to the collapsed configuration, the hinge connection for each peripheral unit assembly moves in a corresponding direction causing movement of the corresponding primary cell surface and the secondary cell surface from a first axis generally parallel to the collapsibility axis to a second axis generally perpendicular to the collapsibility axis, and the two coupling elements move in opposing directions causing movement of the intermediary cell surface from the first axis to the second axis such that the secondary cells of the two peripheral unit assemblies fold above the intermediary cell; and providing a joint lock position at the intermediary cell, the joint lock being configured to control movement of the intermediary cell surface from the first axis to the second axis.

Clause 33: The method of any of the above clauses, wherein the primary cell further comprises a second primary cell hinge element coupled to the primary cell surface along a second primary cell edge, the first primary cell edge and the second primary cell edge being opposing edges of the primary cell surface.

Clause 34: The method of any of the above clauses, wherein the secondary cell further comprises a second secondary cell hinge element coupled to the secondary cell surface along a second secondary cell edge, the first secondary cell edge and the second secondary cell edge being opposing edges of the secondary cell surface, and the second secondary cell hinge element being complementary to the second primary cell hinge element.

Clause 35: The method of any of the above clauses, wherein the collapsible assembly further comprises an additional primary cell and the method further comprises providing a second hinge connection between a second primary cell hinge element of the additional primary cell and the second secondary cell hinge element; and wherein, when the collapsible assembly changes from the extended configuration to the collapsed configuration, the second hinge connection moves in a direction opposite to the direction of the first hinge connection causing movement of a primary cell surface of the additional primary cell from the first axis to the second axis.

Clause 36: The method of any of the above clauses further comprising, providing a collapsible structure by arranging at least two collapsible cell assemblies in a row along the collapsibility axis forming corresponding hinge connections between neighboring primary cells and secondary cells; wherein, when the collapsible structure collapses along the collapsibility axis, the alternating hinge connections between neighboring primary cells and secondary cells move in the same corresponding direction causing movement of the surfaces of the multiple primary and secondary cells from the first axis to the second axis.

Clause 37: The method of any of the above clauses, wherein the collapsible structure comprises at least one additional intermediary cell connecting the intermediary cells of neighboring collapsible cell assemblies along the collapsibility axis.

Clause 38: The method of any of the above clauses, wherein the intermediary cell further comprises an intermediary cell hinge element coupled to the intermediary cell surface along a second intermediary cell edge, the first intermediary cell edge and the second intermediary cell edge being opposing edges of the intermediary cell surface.

Clause 39: The method of any of the above clauses, wherein the movement of the alternating hinge connections provides an accordion style movement of the collapsible structure.

Clause 40: The method of any of the above clauses further comprising, arranging multiple instances of the collapsible assembly in multiple rows parallel to the collapsibility axis to form a cylindrical structure.

Clause 41: The method of any of the above clauses further comprising, arranging multiple instances of the collapsible assembly in multiple rows parallel to the collapsibility axis to form a spherical structure.

Clause 42: The method of any of the above clauses, wherein the primary cell surface, the secondary cell surface and the intermediary cell surface are hexagonal in shape.

Clause 43: The method of any of the above clauses, wherein the second end of each of the two coupling elements forms a two-dimensional hinge connection with the corresponding proximate secondary cell connection element; and the first end of each of the two coupling elements forms a ball and socket joint with corresponding intermediary cell connection element.

Clause 44: The method of any of the above clauses further comprising, providing a fabric plate configured to be coupled to the secondary cell surface, wherein the fabric plate is attached to a fabric layer.

We claim:

1. A collapsible assembly configured to change, along a collapsibility axis, between an extended configuration and a collapsed configuration, the collapsible assembly comprising:

two symmetrical peripheral unit assemblies separated from each other by an intermediary distance and being arranged in parallel rows along the collapsibility axis, each peripheral unit assembly comprising:

a primary cell comprising:

a primary cell surface; and a first primary cell hinge element coupled to the primary cell surface along a first primary cell edge; and a secondary cell comprising:

a secondary cell surface;

a first secondary cell hinge element coupled to the secondary cell surface along a first secondary cell edge, wherein the first secondary cell hinge element is complementary to the first primary cell hinge element, and wherein the first secondary cell hinge element connects with the first primary cell hinge element to form a hinge connection; and at least one secondary cell connection element coupled to the secondary cell surface, the secondary cell connection element being offset from the hinge connection;

an intermediary cell positioned within the two peripheral unit assemblies, the intermediary cell comprising:

an intermediary cell surface provided within the two peripheral unit assemblies such that the intermediary cell surface extends between at least a portion of side edges of the primary and the secondary cells of each peripheral unit assembly when the collapsible assembly is in the extended configuration, and wherein the intermediary cell surface is offset from the secondary cell surfaces of the secondary cells of the peripheral unit assemblies as the collapsible assembly changes from the extended configuration to the collapsed configuration; and two intermediary cell connection elements coupled to the intermediary cell surface along a first intermediary cell edge and each proximate to a secondary cell connection element of a corresponding secondary cell of each peripheral unit assembly; and two coupling elements, each coupling element comprising:

a first end complementary to an intermediary cell connection element; and a second end complementary to a corresponding proximate secondary cell connection element;

wherein when the collapsible assembly changes from the extended configuration to the collapsed configuration:

the hinge connection for each peripheral unit assembly moves in a corresponding direction causing movement of a corresponding primary cell surface and the secondary cell surface from a first axis generally parallel to the collapsibility axis to a second axis generally perpendicular to the collapsibility axis, and the two coupling elements move in opposing directions causing movement of the intermediary cell surface from the first axis to the second axis such that the secondary cells of the two peripheral unit assemblies fold above the intermediary cell.

2. The collapsible assembly of claim 1, wherein the primary cell further comprises a second primary cell hinge element coupled to the primary cell surface along a second primary cell edge, the first primary cell edge and the second primary cell edge being opposing edges of the primary cell surface.

3. The collapsible assembly of claim 2, wherein the secondary cell further comprises a second secondary cell hinge element coupled to the secondary cell surface along a second secondary cell edge, the first secondary cell edge and the second secondary cell edge being opposing edges of the secondary cell surface, and the second secondary cell hinge element being complementary to the second primary cell hinge element.

4. The collapsible assembly of claim 3, wherein the collapsible assembly further comprises an additional primary cell, wherein a second primary cell hinge element of the additional primary cell and the second secondary cell hinge element are coupled to provide a second hinge connection; and wherein, when the collapsible assembly changes from the extended configuration to the collapsed configuration, the second hinge connection moves in a direction opposite to the direction of the first hinge connection causing movement of a primary cell surface of the additional primary cell from the first axis to the second axis.

5. A collapsible structure comprising:

at least two collapsible cell assemblies of claim 1 arranged in a row along the collapsibility axis forming corresponding hinge connections between neighboring primary cells and secondary cells;

wherein, when the collapsible structure collapses along the collapsibility axis, the alternating hinge connections between neighboring primary cells and secondary cells move in a same corresponding direction causing movement of the surfaces of the multiple primary and secondary cells from the first axis to the second axis.

6. The collapsible structure of claim 5 further comprising at least one additional intermediary cell connecting the intermediary cells of neighboring collapsible assemblies along the collapsibility axis.

7. The collapsible structure of claim 6, wherein the intermediary cell further comprises an intermediary cell hinge element coupled to the intermediary cell surface along a second intermediary cell edge, the first intermediary cell edge and the second intermediary cell edge being opposing edges of the intermediary cell surface.

8. The collapsible structure of claim 5, wherein the movement of the alternating hinge connections provides an accordion style movement of the collapsible structure.

9. The collapsible structure of claim 5, wherein the at least two collapsible cell assemblies are arranged in multiple rows parallel to the collapsibility axis forming a cylindrical structure.

10. The collapsible structure of claim 5, wherein the at least two collapsible cell assemblies are arranged in multiple rows parallel to the collapsibility axis forming a spherical structure.

11. The collapsible assembly of claim 1, wherein the primary cell surface, the secondary cell surface and the intermediary cell surface are hexagonal in shape.

12. The collapsible assembly of claim 1 further comprising a joint lock positioned at the intermediary cell, the joint lock being configured to control the movement of the intermediary cell surface from the first axis to the second axis.

13. The collapsible assembly of claim 1, wherein the second end of each of the two coupling elements forms a two-dimensional hinge connection with the corresponding proximate secondary cell connection element; and the first end of each of the two coupling elements forms a ball and socket joint with a corresponding intermediary cell connection element.

14. The collapsible assembly of claim 1, wherein the secondary cell further includes a fabric plate coupled to the secondary cell surface, wherein the fabric plate is attached to a fabric layer.

15. A method of manufacturing a collapsible assembly configured to change between an extended configuration and a collapsed configuration along a collapsibility axis, wherein the collapsible assembly comprises:

two symmetrical peripheral unit assemblies separated from each other by an intermediary distance and being arranged in parallel rows along the collapsibility axis, each peripheral unit assembly comprising:

a primary cell comprising:

a primary cell surface; and a first primary cell hinge element coupled to the primary cell surface along a first primary cell edge; and a secondary cell comprising:

a secondary cell surface;

a first secondary cell hinge element coupled to the secondary cell surface along a first secondary cell edge, wherein the first secondary cell hinge element is complementary to the first primary cell hinge element, and wherein the first secondary cell hinge element connects with the first primary cell hinge element to form a hinge connection; and at least one secondary cell connection element coupled to the secondary cell surface, the secondary cell connection element being offset from the hinge connection;

an intermediary cell positioned within the two peripheral unit assemblies, the intermediary cell comprising:

an intermediary cell surface provided within the two peripheral unit assemblies such that the intermediary cell surface extends between at least a portion of side edges of the primary and the secondary cells of each peripheral unit assembly when the collapsible assembly is in the extended configuration, and wherein the intermediary cell surface is offset from the secondary cell surfaces of the secondary cells of the peripheral unit assemblies as the collapsible assembly changes from the extended configuration to the collapsed configuration; and two intermediary cell connection elements coupled to the intermediary cell surface along a first intermediary cell edge and each proximate to a secondary cell connection element of a corresponding secondary cell of each peripheral unit assembly; and two coupling elements, each coupling element comprising:

a first end complementary to an intermediary cell connection element; and a second end complementary to a corresponding proximate secondary cell connection element, wherein the method comprises:

providing a coupling connection of the second end of each of the two coupling elements with the corresponding proximate secondary cell connection element;

providing a coupling connection of the first end of each of the two coupling elements with a corresponding intermediary cell connection element, wherein when the collapsible assembly moves from the extended configuration to the collapsed configuration, the hinge connection for each peripheral unit assembly moves in a corresponding direction causing movement of a corresponding primary cell surface and the secondary cell surface from a first axis generally parallel to the collapsibility axis to a second axis generally perpendicular to the collapsibility axis, and the two coupling elements move in opposing directions causing movement of the intermediary cell surface from the first axis to the second axis such that the secondary cells of the two peripheral unit assemblies fold above the intermediary cell; and providing a joint lock position at the intermediary cell, the joint lock being configured to control movement of the intermediary cell surface from the first axis to the second axis.

16. The method of claim 15, wherein the primary cell further comprises a second primary cell hinge element coupled to the primary cell surface along a second primary cell edge, the first primary cell edge and the second primary cell edge being opposing edges of the primary cell surface.

17. The method of claim 16, wherein the secondary cell further comprises a second secondary cell hinge element coupled to the secondary cell surface along a second secondary cell edge, the first secondary cell edge and the second secondary cell edge being opposing edges of the secondary cell surface, and the second secondary cell hinge element being complementary to the second primary cell hinge element.

18. The method of claim 17, wherein the collapsible assembly further comprises an additional primary cell and the method further comprises providing a second hinge connection between a second primary cell hinge element of the additional primary cell and the second secondary cell hinge element; and wherein, when the collapsible assembly changes from the extended configuration to the collapsed configuration, the second hinge connection moves in a direction opposite to the direction of the first hinge connection causing movement of a primary cell surface of the additional primary cell from the first axis to the second axis.

19. The method of claim 15 further comprising, providing a collapsible structure by arranging at least two collapsible cell assemblies in a row along the collapsibility axis forming corresponding hinge connections between neighboring primary cells and secondary cells;

wherein, when the collapsible structure collapses along the collapsibility axis, the alternating hinge connections between neighboring primary cells and secondary cells move in a same corresponding direction causing movement of the surfaces of the multiple primary and secondary cells from the first axis to the second axis.

20. The method of claim 19, wherein the movement of the alternating hinge connections provides an accordion style movement of the collapsible structure.

* * * * *